US007891794B2

(12) United States Patent
Silverbrook

(10) Patent No.: US 7,891,794 B2
(45) Date of Patent: Feb. 22, 2011

(54) INK SENSING DEVICE

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 431 days.

(21) Appl. No.: 12/062,521

(22) Filed: Apr. 4, 2008

(65) Prior Publication Data

US 2009/0219329 A1 Sep. 3, 2009

Related U.S. Application Data

(60) Provisional application No. 61/033,357, filed on Mar. 3, 2008.

(51) Int. Cl.
*B41J 2/19* (2006.01)

(52) U.S. Cl. ..... 347/92; 347/19

(58) Field of Classification Search ..... 347/19, 347/61, 62, 85, 89, 92
See application file for complete search history.

(56) References Cited

U.S. PATENT DOCUMENTS 3,929,071 A 12/1975 Cialone et al.
6,174,052 B1 1/2001 Eremity et al.
6,428,156 B1 8/2002 Waller et al.
7,168,800 B2 * 1/2007 Katayama ..... 347/86
7,556,365 B2 * 7/2009 Stathem ..... 347/86
2005/0012795 A1 * 1/2005 Katayama ..... 347/92
2006/0209115 A1 9/2006 Espasa et al.
2007/0195136 A1 8/2007 Senor et al.
2007/0206072 A1 9/2007 Morgan et al.
2007/0222828 A1 9/2007 Stathem et al.

FOREIGN PATENT DOCUMENTS

EP 0002591 B1 1/1982
EP 1038680 A2 9/2000
GB 2265860 A 10/1993
WO WO 2008/006132 A1 1/2008

* cited by examiner

*Primary Examiner*—Ellen Kim

(57) ABSTRACT

An ink sensing device for an ink supply system, the device comprising: a bubble-bursting box comprising: one or more bubble-bursting chambers, each chamber having a respective chamber inlet for connection to an ink line; and an air outlet in fluid communication with each chamber; and a sensor positioned to sense ink above a bubble-bursting point in at least one of the bubble-bursting chambers; wherein the device is configured to minimize phantom sensing of ink caused by ink bubbles in the ink line.

20 Claims, 19 Drawing Sheets

INK SENSING DEVICE

FIELD OF THE INVENTION

The present invention relates to printers and in particular inkjet printers. It has been developed primarily to provide a fluidics system which controls a hydrostatic ink pressure during normal printing, whilst enabling priming and depriming for printhead replacement.

CO-PENDING APPLICATIONS

The following applications have been filed by the Applicant simultaneously with the present application:

| | | | | | | |
|---|---|---|---|---|---|---|
| 12/062,514 | 12/062,517 | 12/062,518 | 7,819,515 | 12/062,522 | 12/062,523 | 12/062,524 |
| 12/062,525 | 12/062,526 | 12/062,527 | 12/062,528 | 12/062,529 | 12/062,530 | 12/062,531 |

The disclosures of these co-pending applications are incorporated herein by reference.

CROSS REFERENCES

The following patents or patent applications filed by the applicant or assignee of the present invention are hereby incorporated by cross-reference.

| | | | | | | |
|---|---|---|---|---|---|---|
| 6,276,850 | 6,520,631 | 6,158,907 | 6,539,180 | 6,270,177 | 6,405,055 | 6,628,430 |
| 6,835,135 | 6,626,529 | 6,981,769 | 7,125,338 | 7,125,337 | 7,136,186 | 7,286,260 |
| 7,145,689 | 7,130,075 | 7,081,974 | 7,177,055 | 7,209,257 | 6,443,555 | 7,161,715 |
| 7,154,632 | 7,158,258 | 7,148,993 | 7,075,684 | 10/943,905 | 10/943,906 | 10/943,904 |
| 10/943,903 | 10/943,902 | 6,966,659 | 6,988,841 | 7,077,748 | 7,255,646 | 7,070,270 |
| 7,014,307 | 7,158,809 | 7,217,048 | 11/225,172 | 7,341,341 | 11/329,039 | 11/329,040 |
| 7,271,829 | 11/442,189 | 11/474,280 | 11/483,061 | 11/503,078 | 11/520,735 | 11/505,858 |
| 11/525,850 | 11/583,870 | 11/592,983 | 11/592,208 | 11/601,828 | 11/635,482 | 11/635,526 |
| 10/466,440 | 7,215,441 | 11/650,545 | 11/653,241 | 11/653,240 | 7,056,040 | 6,942,334 |
| 11/706,300 | 11/740,265 | 11/737,720 | 11/739,056 | 11/740,204 | 11/740,223 | 11/753,557 |
| 11/750,285 | 11,758,648 | 11/778,559 | 11,834,634 | 11/838,878 | 11,845,669 | 12/015,407 |
| 12/017,331 | 12/030,823 | 6,799,853 | 7,237,896 | 6,749,301 | 10/451,722 | 7,137,678 |
| 7,252,379 | 7,144,107 | 10/503,900 | 10/503,898 | 10/503,897 | 7,220,068 | 7,270,410 |
| 7,241,005 | 7,108,437 | 7,140,792 | 10/503,922 | 7,224,274 | 10/503,917 | 10/503,918 |
| 10/503,925 | 10/503,927 | 10/503,928 | 7,349,777 | 10/503,885 | 7,195,325 | 7,229,164 |
| 7,150,523 | 10/503,889 | 7,154,580 | 6,906,778 | 7,167,158 | 7,128,269 | 6,688,528 |
| 6,986,613 | 6,641,315 | 7,278,702 | 10/503,891 | 7,150,524 | 7,155,395 | 6,915,140 |
| 6,999,206 | 6,795,651 | 6,883,910 | 7,118,481 | 7,136,198 | 7,092,130 | 6,786,661 |
| 6,808,325 | 10/920,368 | 10/920,284 | 7,219,990 | 10/920,283 | 6,750,901 | 6,476,863 |
| 6,788,336 | 6,322,181 | 6,597,817 | 6,227,648 | 6,727,948 | 6,690,419 | 10/470,947 |
| 6,619,654 | 6,969,145 | 6,679,582 | 7,328,896 | 6,568,670 | 6,866,373 | 7,280,247 |
| 7,008,044 | 6,742,871 | 6,966,628 | 6,644,781 | 6,969,143 | 6,767,076 | 6,834,933 |
| 6,692,113 | 6,913,344 | 6,727,951 | 7,128,395 | 7,036,911 | 7,032,995 | 6,969,151 |
| 6,955,424 | 6,969,162 | 10/919,249 | 6,942,315 | 7,354,122 | 7,234,797 | 6,986,563 |
| 7,295,211 | 11/045,442 | 7,286,162 | 7,283,159 | 7,077,330 | 6,196,541 | 7,303,257 |
| 11/185,725 | 7,226,144 | 11/202,344 | 7,267,428 | 11/248,423 | 11/248,422 | 7,093,929 |
| 11/282,769 | 11/330,060 | 11/442,111 | 7,290,862 | 11/499,806 | 11/499,710 | 6,195,150 |
| 11,749,156 | 11,782,588 | 11/854,435 | 11/853,817 | 11/935,958 | 11,924,608 | 6,362,868 |
| 11,970,993 | 12/031,526 | 6,831,681 | 6,431,669 | 6,362,869 | 6,472,052 | 6,356,715 |
| 6,894,694 | 6,636,216 | 6,366,693 | 6,329,990 | 6,459,495 | 6,137,500 | 6,690,416 |
| 7,050,143 | 6,398,328 | 7,110,024 | 6,431,704 | 6,879,341 | 6,415,054 | 6,665,454 |
| 6,542,645 | 6,486,886 | 6,381,361 | 6,317,192 | 6,850,274 | 09/113,054 | 6,646,757 |
| 6,624,848 | 6,357,135 | 6,271,931 | 6,353,772 | 6,106,147 | 6,665,008 | 6,304,291 |
| 6,305,770 | 6,289,262 | 6,315,200 | 6,217,165 | 6,496,654 | 6,859,225 | 6,924,835 |
| 6,647,369 | 6,943,830 | 09/693,317 | 7,021,745 | 6,712,453 | 6,460,971 | 6,428,147 |
| 6,416,170 | 6,402,300 | 6,464,340 | 6,612,687 | 6,412,912 | 6,447,099 | 6,837,567 |
| 6,505,913 | 7,128,845 | 6,733,684 | 7,249,108 | 6,566,858 | 6,331,946 | 6,246,970 |
| 6,442,525 | 7,346,586 | 09/505,951 | 6,374,354 | 7,246,098 | 6,816,968 | 6,757,832 |
| 6,334,190 | 6,745,331 | 7,249,109 | 7,197,642 | 7,093,139 | 10/636,263 | 10/636,283 |
| 10/866,608 | 7,210,038 | 10/902,883 | 10/940,653 | 10/942,858 | 11/706,329 | 11/757,385 |
| 11/758,642 | 12/030,817 | 7,119,836 | 7,283,162 | 7,286,169 | 10/636,285 | 7,170,652 |
| 6,967,750 | 6,995,876 | 7,099,051 | 7,172,191 | 7,243,916 | 7,222,845 | 11/239,232 |
| 7,285,227 | 7,063,940 | 11/107,942 | 7,193,734 | 7,086,724 | 7,090,337 | 7,278,723 |
| 7,140,717 | 11/190,902 | 11/209,711 | 7,256,824 | 7,140,726 | 7,156,512 | 7,186,499 |
| 11/478,585 | 11/525,862 | 11/540,574 | 11/583,875 | 11/592,181 | 6,750,944 | 11/599,336 |
| 7,291,447 | 11,744,183 | 11/758,646 | 11/778,561 | 11/839,532 | 11/838,874 | 11/853,021 |
| 11/869,710 | 11/868,531 | 11,927,403 | 11,951,960 | 12/019,556 | 10/636,225 | 6,985,207 |
| 6,773,874 | 6,650,836 | 7,324,142 | 10/636,224 | 7,250,975 | 7,295,343 | 6,880,929 |
| 7,236,188 | 7,236,187 | 7,155,394 | 10/636,219 | 10/636,223 | 7,055,927 | 6,986,562 |
| 7,052,103 | 7,312,845 | 10/656,281 | 10/656,791 | 10/666,124 | 10/683,217 | 7,289,142 |
| 7,095,533 | 6,914,686 | 6,896,252 | 6,820,871 | 6,834,851 | 6,848,686 | 6,830,246 |

-continued

| | | | | | | |
|---|---|---|---|---|---|---|
| 6,851,671 | 10/729,098 | 7,092,011 | 7,187,404 | 10/729,159 | 10/753,458 | 6,878,299 |
| 6,929,348 | 6,921,154 | 10/780,625 | 10/804,042 | 6,913,346 | 10/831,238 | 10/831,237 |
| 10/831,239 | 10/831,240 | 10/831,241 | 10/831,234 | 10/831,233 | 7,246,897 | 7,077,515 |
| 10/831,235 | 10/853,336 | 10/853,117 | 10/853,659 | 10/853,681 | 6,913,875 | 7,021,758 |
| 7,033,017 | 7,161,709 | 7,099,033 | 7,147,294 | 7,156,494 | 11/012,024 | 11/011,925 |
| 7,032,998 | 7,044,585 | 7,296,867 | 6,994,424 | 11/006,787 | 7,258,435 | 7,097,263 |
| 7,001,012 | 7,004,568 | 7,040,738 | 7,188,933 | 7,027,080 | 7,025,446 | 6,991,321 |
| 7,131,715 | 7,261,392 | 7,207,647 | 7,182,435 | 7,097,285 | 7,331,646 | 7,097,284 |
| 7,083,264 | 7,147,304 | 7,232,203 | 7,156,498 | 7,201,471 | 11/501,772 | 11/503,084 |
| 11/513,073 | 7,210,764 | 11/635,524 | 11/706,379 | 11/730,386 | 11/730,784 | 11/753,568 |
| 11/782,591 | 11/859,783 | 12/015,243 | 12/037,069 | 6,710,457 | 6,775,906 | 6,507,099 |
| 7,221,043 | 7,107,674 | 7,154,172 | 11/442,400 | 7,247,941 | 11/736,540 | 7,307,354 |
| 11/940,304 | 6,530,339 | 6,631,897 | 6,851,667 | 6,830,243 | 6,860,479 | 6,997,452 |
| 7,000,913 | 7,204,482 | 11/212,759 | 11/281,679 | 11/730,409 | 6,238,044 | 6,425,661 |
| 11/003,786 | 7,258,417 | 7,293,853 | 7,328,968 | 7,270,395 | 11/003,404 | 11/003,419 |
| 7,334,864 | 7,255,419 | 7,284,819 | 7,229,148 | 7,258,416 | 7,273,263 | 7,270,393 |
| 6,984,017 | 7,347,526 | 11/071,473 | 7,156,497 | 11/601,670 | 11,748,482 | 11/778,563 |
| 11/779,851 | 11/778,574 | 11/853,816 | 11/853,814 | 11/853,786 | 11/872,037 | 11/856,694 |
| 11,965,703 | 11,971,170 | 12/023,011 | 12/036,896 | 12/050,154 | 11/003,463 | 11/003,701 |
| 12/056,247 | 11/003,683 | 12/050,001 | 11/003,614 | 7,284,820 | 7,341,328 | 7,246,875 |
| 7,322,669 | 11/764,760 | 11,853,777 | 11,955,354 | 12/022,994 | 11/293,800 | 11/293,802 |
| 11/293,801 | 11/293,808 | 11/293,809 | 11/482,975 | 11/482,970 | 11/482,968 | 11/482,972 |
| 11/482,971 | 11/482,969 | 6,431,777 | 6,334,664 | 6,447,113 | 7,239,407 | 6,398,359 |
| 6,652,089 | 6,652,090 | 7,057,759 | 6,631,986 | 7,187,470 | 7,280,235 | 11/501,775 |
| 11,744,210 | 11/859,784 | 6,471,331 | 6,676,250 | 6,347,864 | 6,439,704 | 6,425,700 |
| 6,588,952 | 6,626,515 | 6,722,758 | 6,871,937 | 11/060,803 | 7,344,226 | 7,328,976 |
| 11/685,084 | 11/685,086 | 11/685,090 | 11/740,925 | 11/763,444 | 11/763,443 | 11,946,840 |
| 11,961,712 | 12/017,771 | 7,249,942 | 7,206,654 | 7,162,324 | 7,162,325 | 7,231,275 |
| 7,146,236 | 7,278,847 | 10/753,499 | 6,997,698 | 7,220,112 | 7,231,276 | 10/753,440 |
| 7,220,115 | 7,195,475 | 7,144,242 | 7,306,323 | 7,306,319 | 11/525,858 | 7,322,674 |
| 11/599,335 | 11/706,380 | 11,736,545 | 11/736,554 | 11/739,047 | 11,749,159 | 11/739,073 |
| 11/775,160 | 11/853,755 | 11/940,291 | 11,934,071 | 11,951,913 | 6,786,420 | 6,827,282 |
| 6,948,661 | 7,073,713 | 10/983,060 | 7,093,762 | 7,083,108 | 7,222,799 | 7,201,319 |
| 11/442,103 | 11/739,071 | 11/518,238 | 11/518,280 | 11/518,244 | 11/518,243 | 11/518,242 |
| 7,032,899 | 6,854,724 | 7,331,651 | 7,334,870 | 7,334,875 | 11/357,296 | 11/357,298 |
| 11/357,297 | 12/015,479 | 12/017,270 | 12/015,218 | 6,350,023 | 6,318,849 | 6,592,207 |
| 6,439,699 | 6,312,114 | 11/246,676 | 11/246,677 | 11/246,678 | 11/246,679 | 11/246,680 |
| 11/246,681 | 11/246,714 | 11/246,713 | 11/246,689 | 11/246,671 | 11/246,670 | 11/246,669 |
| 11/246,704 | 11/246,710 | 11/246,688 | 11/246,716 | 11/246,715 | 11/246,707 | 11/246,706 |
| 11/246,705 | 11/246,708 | 11/246,693 | 11/246,692 | 11/246,696 | 11/246,695 | 11/246,694 |
| 11/482,958 | 11/482,955 | 11/482,962 | 11/482,963 | 11/482,956 | 11/482,954 | 11/482,974 |
| 11/482,957 | 11/482,987 | 11/482,959 | 11/482,960 | 11/482,961 | 11/482,964 | 11/482,965 |
| 11/482,976 | 11/482,973 | 11/495,815 | 11/495,816 | 11/495,817 | 60/992,635 | 60/992,637 |
| 60/992,641 | 12/050,078 | 12/050,066 | 10/803,074 | 10/803,073 | 7,040,823 | 10/803,076 |
| 10/803,077 | 10/803,078 | 10/803,079 | 10/922,971 | 10/922,970 | 10/922,836 | 10/922,842 |
| 10/922,848 | 10/922,843 | 7,125,185 | 7,229,226 | 11/513,386 | 11/753,559 | 12/056,276 |
| 10/815,621 | 7,243,835 | 10/815,630 | 10/815,637 | 10/815,638 | 7,251,050 | 10/815,642 |
| 7,097,094 | 7,137,549 | 10/815,618 | 7,156,292 | 11,738,974 | 12/047,321 | 10/815,635 |
| 10/815,647 | 10/815,634 | 7,137,566 | 7,131,596 | 7,128,265 | 7,207,485 | 7,197,374 |
| 7,175,089 | 10/815,617 | 10/815,620 | 7,178,719 | 10/815,613 | 7,207,483 | 7,296,737 |
| 7,270,266 | 10/815,614 | 7,314,181 | 11/488,162 | 11/488,163 | 11/488,164 | 11/488,167 |
| 11/488,168 | 11/488,165 | 11/488,166 | 7,267,273 | 11/834,628 | 11/839,497 | 11/944,449 |
| 12/043,851 | 10/815,636 | 7,128,270 | 11/041,650 | 11/041,651 | 11/041,652 | 11/041,649 |
| 11/041,610 | 11,863,253 | 11,863,255 | 11/863,257 | 11,863,258 | 11,863,262 | 11/041,609 |
| 11/041,626 | 11/041,627 | 11/041,624 | 11/041,625 | 11,863,268 | 11,863,269 | 11,863,270 |
| 11,863,271 | 11,863,273 | 12/056,260 | 12/056,254 | 76,584,733 | 11/041,556 | 11/041,580 |
| 11/041,723 | 11/041,698 | 11/041,648 | 11,863,263 | 11,863,264 | 11,863,265 | 11,863,266 |
| 11,863,267 | 10/815,609 | 7,150,398 | 7,159,777 | 10/815,610 | 7,188,769 | 7,097,106 |
| 7,070,110 | 7,243,849 | 7,314,177 | 11/480,957 | 11/764,694 | 11,957,470 | 6,227,652 |
| 6,213,588 | 6,213,589 | 6,231,163 | 6,247,795 | 6,394,581 | 6,244,691 | 6,257,704 |
| 6,416,168 | 6,220,694 | 6,257,705 | 6,247,794 | 6,234,610 | 6,247,793 | 6,264,306 |
| 6,241,342 | 6,247,792 | 6,264,307 | 6,254,220 | 6,234,611 | 6,302,528 | 6,283,582 |
| 6,239,821 | 6,338,547 | 6,247,796 | 6,557,977 | 6,390,603 | 6,362,843 | 6,293,653 |
| 6,312,107 | 6,227,653 | 6,234,609 | 6,238,040 | 6,188,415 | 6,227,654 | 6,209,989 |
| 6,247,791 | 6,336,710 | 6,217,153 | 6,416,167 | 6,243,113 | 6,283,581 | 6,247,790 |
| 6,260,953 | 6,267,469 | 6,588,882 | 6,742,873 | 6,918,655 | 6,547,371 | 6,938,989 |
| 6,598,964 | 6,923,526 | 6,273,544 | 6,309,048 | 6,420,196 | 6,443,558 | 6,439,689 |
| 6,378,989 | 6,848,181 | 6,634,735 | 6,299,289 | 6,299,290 | 6,425,654 | 6,902,255 |
| 6,623,101 | 6,406,129 | 6,505,916 | 6,457,809 | 6,550,895 | 6,457,812 | 7,152,962 |
| 6,428,133 | 7,216,956 | 7,080,895 | 11/144,844 | 7,182,437 | 11/599,341 | 11/635,533 |
| 11/607,976 | 11/607,975 | 11/607,999 | 11/607,980 | 11/607,979 | 11/607,978 | 11/735,961 |
| 11/685,074 | 11/696,126 | 11/696,144 | 11/696,650 | 11/763,446 | 12/043,820 | 6,224,780 |
| 6,235,212 | 6,280,643 | 6,284,147 | 6,214,244 | 6,071,750 | 6,267,905 | 6,251,298 |
| 6,258,285 | 6,225,138 | 6,241,904 | 6,299,786 | 6,866,789 | 6,231,773 | 6,190,931 |
| 6,248,249 | 6,290,862 | 6,241,906 | 6,565,762 | 6,241,905 | 6,451,216 | 6,231,772 |
| 6,274,056 | 6,290,861 | 6,248,248 | 6,306,671 | 6,331,258 | 6,110,754 | 6,294,101 |
| 6,416,679 | 6,264,849 | 6,254,793 | 6,245,246 | 6,855,264 | 6,235,211 | 6,491,833 |
| 6,264,850 | 6,258,284 | 6,312,615 | 6,228,668 | 6,180,427 | 6,171,875 | 6,267,904 |
| 6,245,247 | 6,315,914 | 7,169,316 | 6,526,658 | 7,210,767 | 11/056,146 | 11/635,523 |

-continued

| | | | | | | |
|---|---|---|---|---|---|---|
| 6,665,094 | 6,450,605 | 6,512,596 | 6,654,144 | 7,125,090 | 6,687,022 | 7,072,076 |
| 7,092,125 | 7,215,443 | 7,136,195 | 7,077,494 | 6,877,834 | 6,969,139 | 10/636,227 |
| 7,283,280 | 6,912,067 | 7,277,205 | 7,154,637 | 10/636,230 | 7,070,251 | 6,851,782 |
| 10/636,211 | 10/636,247 | 6,843,545 | 7,079,286 | 7,064,867 | 7,065,247 | 7,027,177 |
| 7,218,415 | 7,064,873 | 6,954,276 | 7,061,644 | 7,092,127 | 7,059,695 | 10/990,382 |
| 7,177,052 | 7,270,394 | 11/124,231 | 7,188,921 | 7,187,469 | 7,196,820 | 11/281,445 |
| 7,283,281 | 7,251,051 | 7,245,399 | 11/524,911 | 11/640,267 | 11/706,297 | 11/730,387 |
| 7,349,125 | 7,336,397 | 11/834,637 | 11/853,019 | 11/863,239 | 12/015,485 | 12/030,797 |
| 12/050,933 | 11/305,274 | 11/305,273 | 11/305,275 | 11/305,152 | 11/305,158 | 11/305,008 |
| 6,231,148 | 6,293,658 | 6,614,560 | 6,238,033 | 6,312,070 | 6,238,111 | 6,378,970 |
| 6,196,739 | 6,270,182 | 6,152,619 | 7,006,143 | 6,876,394 | 6,738,096 | 6,970,186 |
| 6,287,028 | 6,412,993 | 11/033,145 | 11/102,845 | 11/102,861 | 11/248,421 | 11/672,878 |
| 7,204,941 | 7,282,164 | 10/815,628 | 11,845,672 | 7,278,727 | 10/913,373 | 10/913,374 |
| 10/913,372 | 7,138,391 | 7,153,956 | 10/913,380 | 10/913,379 | 10/913,376 | 7,122,076 |
| 7,148,345 | 11/172,816 | 11/172,815 | 11/172,814 | 11/482,990 | 11/482,986 | 11/482,985 |
| 11/454,899 | 11/583,942 | 11/592,990 | 11,849,360 | 11/831,961 | 11/831,962 | 11/831,963 |
| 60/951,700 | 11/832,629 | 11/832,637 | 60/971,535 | 61/027,756 | 12/055,316 | 10/407,212 |
| 7,252,366 | 10/683,064 | 10/683,041 | 7,275,811 | 10/884,889 | 10/922,890 | 7,334,874 |
| 10/922,885 | 10/922,889 | 10/922,884 | 10/922,879 | 10/922,887 | 10/922,888 | 10/922,874 |
| 7,234,795 | 10/922,871 | 7,328,975 | 7,293,855 | 10/922,882 | 10/922,883 | 10/922,878 |
| 10/922,872 | 10/922,876 | 10/922,886 | 10/922,877 | 7,147,792 | 7,175,774 | 11/159,193 |
| 11/491,378 | 11,766,713 | 11/841,647 | 12/018,040 | 12/035,410 | 12/037,054 | 11/482,980 |
| 11/563,684 | 11/482,967 | 11/482,966 | 11/482,988 | 11/482,989 | 11/293,832 | 11/293,838 |
| 11/293,825 | 11/293,841 | 11/293,799 | 11/293,796 | 11/293,797 | 11/293,798 | 11/124,158 |
| 11/124,196 | 11/124,199 | 11/124,162 | 11/124,202 | 11/124,197 | 11/124,154 | 11/124,198 |
| 7,284,921 | 11/124,151 | 11/124,160 | 11/124,192 | 11/124,175 | 11/124,163 | 11/124,149 |
| 11/124,152 | 11/124,173 | 11/124,155 | 7,236,271 | 11/124,174 | 11/124,194 | 11/124,164 |
| 11/124,200 | 11/124,195 | 11/124,166 | 11/124,150 | 11/124,172 | 11/124,165 | 11/124,186 |
| 11/124,185 | 11/124,184 | 11/124,182 | 11/124,201 | 11/124,171 | 11/124,181 | 11/124,161 |
| 11/124,156 | 11/124,191 | 11/124,159 | 11/124,176 | 11/124,188 | 11/124,170 | 11/124,187 |
| 11/124,189 | 11/124,190 | 11/124,180 | 11/124,193 | 11/124,183 | 11/124,178 | 11/124,177 |
| 11/124,148 | 11/124,168 | 11/124,167 | 11/124,179 | 11/124,169 | 11/187,976 | 11/188,011 |
| 11/188,014 | 11/482,979 | 11/735,490 | 11/853,018 | 11/944,450 | 12/023,815 | 12/035,414 |
| 12/056,232 | 11/228,540 | 11/228,500 | 11/228,501 | 11/228,530 | 11/228,490 | 11/228,531 |
| 11/228,504 | 11/228,533 | 11/228,502 | 11/228,507 | 11/228,482 | 11/228,505 | 11/228,497 |
| 11/228,487 | 11/228,529 | 11/228,484 | 11/228,489 | 11/228,518 | 11/228,536 | 11/228,496 |
| 11/228,488 | 11/228,506 | 11/228,516 | 11/228,526 | 11/228,539 | 11/228,538 | 11/228,524 |
| 11/228,523 | 11/228,519 | 11/228,528 | 11/228,527 | 11/228,525 | 11/228,520 | 11/228,498 |
| 11/228,511 | 11/228,522 | 11/228,515 | 11/228,537 | 11/228,534 | 11/228,491 | 11/228,499 |
| 11/228,509 | 11/228,492 | 11/228,493 | 11/228,510 | 11/228,508 | 11/228,512 | 11/228,514 |
| 11/228,494 | 11/228,495 | 11/228,486 | 11/228,481 | 11/228,477 | 11/228,485 | 11/228,483 |
| 11/228,521 | 11/228,517 | 11/228,532 | 11/228,513 | 11/228,503 | 11/228,480 | 11/228,535 |
| 11/228,478 | 11/228,479 | 12/035,419 | 6,238,115 | 6,386,535 | 6,398,344 | 6,612,240 |
| 6,752,549 | 6,805,049 | 6,971,313 | 6,899,480 | 6,860,664 | 6,925,935 | 6,966,636 |
| 7,024,995 | 7,284,852 | 6,926,455 | 7,056,038 | 6,869,172 | 7,021,843 | 6,988,845 |
| 6,964,533 | 6,981,809 | 7,284,822 | 7,258,067 | 7,322,757 | 7,222,941 | 7,284,925 |
| 7,278,795 | 7,249,904 | 11/737,726 | 11,772,240 | 11/863,246 | 11/863,145 | 11/865,650 |
| 12/050,091 | 12/050,106 | 6,087,638 | 6,340,222 | 6,041,600 | 6,299,300 | 6,067,797 |
| 6,286,935 | 6,044,646 | 6,382,769 | 6,787,051 | 6,938,990 | 11/242,916 | 11/144,799 |
| 11/198,235 | 11,861,282 | 11,861,284 | 11/766,052 | 7,152,972 | 11/592,996 | D529952 |
| 6,390,605 | 6,322,195 | 6,612,110 | 6,480,089 | 6,460,778 | 6,305,788 | 6,426,014 |
| 6,364,453 | 6,457,795 | 6,315,399 | 6,338,548 | 7,040,736 | 6,938,992 | 6,994,425 |
| 6,863,379 | 6,540,319 | 6,994,421 | 6,984,019 | 7,008,043 | 6,997,544 | 6,328,431 |
| 6,991,310 | 10/965,772 | 7,140,723 | 6,328,425 | 6,982,184 | 7,267,423 | 7,134,741 |
| 7,066,577 | 7,152,945 | 7,303,689 | 7,021,744 | 6,991,320 | 7,155,911 | 11/107,799 |
| 6,595,624 | 7,152,943 | 7,125,103 | 7,328,971 | 7,290,857 | 7,285,437 | 7,229,151 |
| 7,341,331 | 7,237,873 | 11/329,163 | 11/442,180 | 11/450,431 | 7,213,907 | 6,417,757 |
| 11/482,951 | 11/545,566 | 11/583,826 | 11/604,315 | 11/604,323 | 11/643,845 | 11/706,950 |
| 11/730,399 | 11,749,121 | 11/753,549 | 11/834,630 | 11/935,389 | 11/869,670 | 7,095,309 |
| 11/945,157 | 11,957,473 | 11,967,235 | 12/017,896 | 6,854,825 | 6,623,106 | 6,672,707 |
| 6,575,561 | 6,817,700 | 6,588,885 | 7,075,677 | 6,428,139 | 6,575,549 | 6,846,692 |
| 6,425,971 | 7,063,993 | 6,383,833 | 6,955,414 | 6,412,908 | 6,746,105 | 6,953,236 |
| 6,412,904 | 7,128,388 | 6,398,343 | 6,652,071 | 6,793,323 | 6,659,590 | 6,676,245 |
| 7,201,460 | 6,464,332 | 6,659,593 | 6,478,406 | 6,978,613 | 6,439,693 | 6,502,306 |
| 6,966,111 | 6,863,369 | 6,428,142 | 6,874,868 | 6,390,591 | 6,799,828 | 6,896,358 |
| 7,018,016 | 10/296,534 | 6,328,417 | 6,322,194 | 6,382,779 | 6,629,745 | 6,565,193 |
| 6,609,786 | 6,609,787 | 6,439,908 | 6,684,503 | 6,843,551 | 6,764,166 | 6,561,617 |
| 7,328,967 | 6,557,970 | 6,546,628 | 10/510,098 | 6,652,074 | 6,820,968 | 7,175,260 |
| 6,682,174 | 7,303,262 | 6,648,453 | 6,834,932 | 6,682,176 | 6,998,062 | 6,767,077 |
| 7,278,717 | 6,755,509 | 7,347,537 | 6,692,108 | 10/534,811 | 6,672,709 | 7,303,263 |
| 7,086,718 | 10/534,881 | 6,672,710 | 10/534,812 | 6,669,334 | 7,322,686 | 7,152,958 |
| 7,281,782 | 6,824,246 | 7,264,336 | 6,669,333 | 10/534,815 | 6,820,967 | 7,306,326 |
| 6,736,489 | 7,264,335 | 6,719,406 | 7,222,943 | 7,188,419 | 7,168,166 | 6,974,209 |
| 7,086,719 | 6,974,210 | 7,195,338 | 7,252,775 | 7,101,025 | 11/474,281 | 11/485,258 |
| 11/706,304 | 11/706,324 | 11/706,326 | 11/706,321 | 11/772,239 | 11/782,598 | 11/829,941 |
| 11/852,991 | 11,852,986 | 11/936,062 | 11/934,027 | 11,955,028 | 12/034,578 | 12/036,908 |
| 11/763,440 | 11/763,442 | 11/246,687 | 11/246,718 | 7,322,681 | 11/246,686 | 11/246,703 |
| 11/246,691 | 11/246,711 | 11/246,690 | 11/246,712 | 11/246,717 | 11/246,709 | 11/246,700 |
| 11/246,701 | 11/246,702 | 11/246,668 | 11/246,697 | 11/246,698 | 11/246,699 | 11/246,675 |

-continued

| | | | | | | |
|---|---|---|---|---|---|---|
| 11/246,674 | 11/246,667 | 11/829,957 | 11/829,960 | 11/829,961 | 11/829,962 | 11/829,963 |
| 11/829,966 | 11/829,967 | 11/829,968 | 11/829,969 | 11,946,839 | 11,946,838 | 11,946,837 |
| 11,951,230 | 7,156,508 | 7,159,972 | 7,083,271 | 7,165,834 | 7,080,894 | 7,201,469 |
| 7,090,336 | 7,156,489 | 10/760,233 | 10/760,246 | 7,083,257 | 7,258,422 | 7,255,423 |
| 7,219,980 | 10/760,253 | 10/760,255 | 10/760,209 | 7,118,192 | 10/760,194 | 7,322,672 |
| 7,077,505 | 7,198,354 | 7,077,504 | 10/760,189 | 7,198,355 | 10/760,232 | 7,322,676 |
| 7,152,959 | 7,213,906 | 7,178,901 | 7,222,938 | 7,108,353 | 7,104,629 | 11/446,227 |
| 11/454,904 | 11/472,345 | 11/474,273 | 7,261,401 | 11/474,279 | 11/482,939 | 7,328,972 |
| 7,322,673 | 7,306,324 | 7,306,325 | 11/603,824 | 11/601,756 | 11/601,672 | 7,303,261 |
| 11/653,253 | 11/706,328 | 11/706,299 | 11/706,965 | 11/737,080 | 11/737,041 | 11/778,062 |
| 11/778,566 | 11/782,593 | 11/934,018 | 11/945,157 | 11,951,095 | 11,951,828 | 11,954,906 |
| 11,954,949 | 11,967,226 | 7,303,930 | 11/246,672 | 11/246,673 | 11/246,683 | 11/246,682 |
| 60/939,086 | 11,860,538 | 11,860,539 | 11/860,540 | 11,860,541 | 11,860,542 | 11/936,060 |
| 11,877,667 | 11,877,668 | 12/046,451 | 12/046,452 | 12/046,453 | 12/046,454 | 7,246,886 |
| 7,128,400 | 7,108,355 | 6,991,322 | 7,287,836 | 7,118,197 | 10/728,784 | 10/728,783 |
| 7,077,493 | 6,962,402 | 10/728,803 | 7,147,308 | 10/728,779 | 7,118,198 | 7,168,790 |
| 7,172,270 | 7,229,155 | 6,830,318 | 7,195,342 | 7,175,261 | 10/773,183 | 7,108,356 |
| 7,118,202 | 10/773,186 | 7,134,744 | 10/773,185 | 7,134,743 | 7,182,439 | 7,210,768 |
| 10/773,187 | 7,134,745 | 7,156,484 | 7,118,201 | 7,111,926 | 10/773,184 | 7,018,021 |
| 11/060,751 | 11/060,805 | 11/188,017 | 7,128,402 | 11/298,774 | 11/329,157 | 11/490,041 |
| 11/501,767 | 7,284,839 | 7,246,885 | 7,229,156 | 11/505,846 | 11/505,857 | 7,293,858 |
| 11/524,908 | 11/524,938 | 7,258,427 | 11/524,912 | 7,278,716 | 11/592,995 | 11/603,825 |
| 11/649,773 | 11/650,549 | 11/653,237 | 11/706,378 | 11/706,962 | 11,749,118 | 11/754,937 |
| 11,749,120 | 11/744,885 | 11/779,850 | 11/765,439 | 11/842,950 | 11/839,539 | 11/926,121 |
| 12/025,621 | 11/097,308 | 11/097,309 | 7,246,876 | 11/097,299 | 11/097,310 | 11/097,213 |
| 7,328,978 | 7,334,876 | 7,147,306 | 7,261,394 | 11/764,806 | 11/782,595 | 11,965,696 |
| 12/027,286 | 11/482,953 | 11/482,977 | 11/544,778 | 11/544,779 | 12/056,149 | 11/764,808 |
| 11/756,624 | 11/756,625 | 11/756,626 | 11/756,627 | 11/756,628 | 11/756,629 | 11/756,630 |
| 11/756,631 | 7,156,289 | 7,178,718 | 7,225,979 | 11/712,434 | 11/084,796 | 11/084,742 |
| 11/084,806 | 09/575,197 | 09/575,197 | 7,079,712 | 7,079,712 | 6,825,945 | 6,825,945 |
| 7,330,974 | 7,330,974 | 6,813,039 | 6,813,039 | 7,190,474 | 6,987,506 | 6,987,506 |
| 6,824,044 | 7,038,797 | 7,038,797 | 6,980,318 | 6,980,318 | 6,816,274 | 6,816,274 |
| 7,102,772 | 7,102,772 | 7,350,236 | 7,350,236 | 6,681,045 | 6,681,045 | 6,678,499 |
| 6,679,420 | 6,963,845 | 6,976,220 | 6,728,000 | 6,728,000 | 7,110,126 | 7,173,722 |
| 7,173,722 | 6,976,035 | 6,813,558 | 6,766,942 | 6,965,454 | 6,995,859 | 7,088,459 |
| 7,088,459 | 6,720,985 | 7,286,113 | 6,922,779 | 6,978,019 | 6,847,883 | 7,131,058 |
| 7,295,839 | 09/607,843 | 09/693,690 | 6,959,298 | 6,973,450 | 7,150,404 | 6,965,882 |
| 7,233,924 | 09/575,181 | 09/575,181 | 09/722,174 | 7,175,079 | 7,162,259 | 6,718,061 |
| 10/291,523 | 10/291,471 | 7,012,710 | 6,825,956 | 10/291,481 | 7,222,098 | 10/291,825 |
| 7,263,508 | 7,031,010 | 6,972,864 | 6,862,105 | 7,009,738 | 6,989,911 | 6,982,807 |
| 10/291,576 | 6,829,387 | 6,714,678 | 6,644,545 | 6,609,653 | 6,651,879 | 10/291,555 |
| 7,293,240 | 10/291,592 | 10/291,542 | 7,044,363 | 7,004,390 | 6,867,880 | 7,034,953 |
| 6,987,581 | 7,216,224 | 10/291,821 | 7,162,269 | 7,162,222 | 7,290,210 | 7,293,233 |
| 7,293,234 | 6,850,931 | 6,865,570 | 6,847,961 | 10/685,523 | 10/685,583 | 7,162,442 |
| 10/685,584 | 7,159,784 | 10/804,034 | 10/793,933 | 6,889,896 | 10/831,232 | 7,174,056 |
| 6,996,274 | 7,162,088 | 10/943,874 | 10/943,872 | 10/944,044 | 7,259,884 | 10/944,043 |
| 7,167,270 | 10/943,877 | 6,986,459 | 10/954,170 | 7,181,448 | 10/981,626 | 10/981,616 |
| 7,324,989 | 7,231,293 | 7,174,329 | 10/992,713 | 7,295,922 | 7,200,591 | 11/020,106 |
| 11/020,260 | 11/020,321 | 11/020,319 | 11/026,045 | 7,347,357 | 11/051,032 | 11/059,674 |
| 11/107,944 | 11/107,941 | 11/082,940 | 11/082,815 | 11/082,827 | 11/082,829 | 6,991,153 |
| 6,991,154 | 11/124,256 | 11/123,136 | 11/154,676 | 7,322,524 | 11/182,002 | 11/202,251 |
| 11/202,252 | 11/202,253 | 11/203,200 | 11/202,218 | 11/206,778 | 11/203,424 | 11/222,977 |
| 7,327,485 | 11/227,239 | 11/286,334 | 7,225,402 | 11/329,187 | 11/349,143 | 11/491,225 |
| 11/491,121 | 11/442,428 | 11/454,902 | 11/442,385 | 11/478,590 | 7,271,931 | 11/520,170 |
| 11/603,057 | 11/706,964 | 11/739,032 | 11,739,014 | 7,336,389 | 11/830,848 | 11/830,849 |
| 11/839,542 | 11/866,394 | 11/934,077 | 11,951,874 | 12/015,487 | 12/023,860 | 12/023,005 |
| 12/036,266 | 12/047,311 | 12/047,276 | 12/050,927 | 7,068,382 | 7,068,382 | 7,007,851 |
| 6,957,921 | 6,457,883 | 10/743,671 | 7,044,381 | 11/203,205 | 7,094,910 | 7,091,344 |
| 7,122,685 | 7,038,066 | 7,099,019 | 7,062,651 | 7,062,651 | 6,789,194 | 6,789,194 |
| 6,789,191 | 6,789,191 | 10/900,129 | 7,278,018 | 10/913,350 | 10/982,975 | 10/983,029 |
| 11/331,109 | 6,644,642 | 6,644,642 | 6,502,614 | 6,502,614 | 6,622,999 | 6,622,999 |
| 6,669,385 | 6,669,385 | 6,827,116 | 7,011,128 | 10/949,307 | 6,549,935 | 6,549,935 |
| 6,987,573 | 6,987,573 | 6,727,996 | 6,727,996 | 6,591,884 | 6,591,884 | 6,439,706 |
| 6,439,706 | 6,760,119 | 6,760,119 | 7,295,332 | 7,295,332 | 7,064,851 | 6,826,547 |
| 6,290,349 | 6,290,349 | 6,428,155 | 6,428,155 | 6,785,016 | 6,785,016 | 6,831,682 |
| 6,741,871 | 6,927,871 | 6,980,306 | 6,965,439 | 6,840,606 | 7,036,918 | 6,977,746 |
| 6,970,264 | 7,068,389 | 7,093,991 | 7,190,491 | 10/901,154 | 10/932,044 | 10/962,412 |
| 7,177,054 | 10/962,552 | 10/965,733 | 10/965,933 | 10/974,742 | 10/982,974 | 7,180,609 |
| 10/986,375 | 11/107,817 | 7,292,363 | 11/149,160 | 11/206,756 | 11/250,465 | 7,202,959 |
| 11/653,219 | 11/706,309 | 11/730,389 | 11/730,392 | 60/953,443 | 11/866,387 | 60/974,077 |
| 12/050,161 | 6,982,798 | 6,870,966 | 6,870,966 | 6,822,639 | 6,822,639 | 6,474,888 |
| 6,627,870 | 6,724,374 | 6,788,982 | 7,263,270 | 6,788,293 | 6,946,672 | 6,737,591 |
| 6,737,591 | 7,091,960 | 09/693,514 | 6,792,165 | 7,105,753 | 6,795,593 | 6,980,704 |
| 6,768,821 | 7,132,612 | 7,041,916 | 6,797,895 | 7,015,901 | 7,289,882 | 7,148,644 |
| 10/778,056 | 10/778,058 | 10/778,060 | 10/778,059 | 10/778,063 | 10/778,062 | 10/778,061 |
| 10/778,057 | 7,096,199 | 7,286,887 | 10/917,467 | 10/917,466 | 7,324,859 | 7,218,978 |
| 7,245,294 | 7,277,085 | 7,187,370 | 10/917,436 | 10/943,856 | 10/919,379 | 7,019,319 |
| 10/943,878 | 10/943,849 | 7,043,096 | 7,148,499 | 11/144,840 | 11/155,556 | 11/155,557 |
| 11/193,481 | 11/193,435 | 11/193,482 | 11/193,479 | 7,336,267 | 11/281,671 | 11/298,474 |

-continued

| | | | | | | |
|---|---|---|---|---|---|---|
| 7,245,760 | 11/488,832 | 11/495,814 | 11/495,823 | 11/495,822 | 11/495,821 | 11/495,820 |
| 11/653,242 | 11/754,370 | 60/911,260 | 11/829,936 | 11/839,494 | 11,866,305 | 11,866,313 |
| 11,866,324 | 11,866,336 | 11,866,348 | 11,866,359 | 11,970,951 | 12/036,264 | 7,055,739 |
| 7,055,739 | 7,233,320 | 7,233,320 | 6,830,196 | 6,830,196 | 6,832,717 | 6,832,717 |
| 7,182,247 | 7,120,853 | 7,082,562 | 6,843,420 | 10/291,718 | 6,789,731 | 7,057,608 |
| 6,766,944 | 6,766,945 | 7,289,103 | 10/291,559 | 7,299,969 | 7,264,173 | 10/409,864 |
| 7,108,192 | 10/537,159 | 7,111,791 | 7,077,333 | 6,983,878 | 10/786,631 | 7,134,598 |
| 10/893,372 | 6,929,186 | 6,994,264 | 7,017,826 | 7,014,123 | 7,134,601 | 7,150,396 |
| 10/971,146 | 7,017,823 | 7,025,276 | 7,284,701 | 7,080,780 | 11/074,802 | 7,334,739 |
| 11,749,158 | 11/842,948 | 12/015,477 | 12/025,746 | 12/025,747 | 12/025,748 | 12/025,749 |
| 12/025,750 | 12/025,751 | 12/025,754 | 12/025,756 | 12/025,757 | 12/025,759 | 12/025,760 |
| 12/025,761 | 12/025,762 | 12/025,764 | 12/025,765 | 12/025,766 | 12/025,767 | 12/025,768 |
| 10/492,169 | 10/492,152 | 10/492,168 | 10/492,161 | 7,308,148 | 10/502,575 | 10/531,229 |
| 10/683,151 | 10/531,733 | 10/683,040 | 10/510,391 | 10/510,392 | 10/778,090 | 11/944,404 |
| 11/936,638 | 12/031,615 | 6,957,768 | 6,957,768 | 09/575,172 | 09/575,172 | 7,170,499 |
| 7,170,499 | 7,106,888 | 7,106,888 | 7,123,239 | 7,123,239 | 6,982,701 | 6,982,703 |
| 7,227,527 | 6,786,397 | 6,947,027 | 6,975,299 | 7,139,431 | 7,048,178 | 7,118,025 |
| 6,839,053 | 7,015,900 | 7,010,147 | 7,133,557 | 6,914,593 | 10/291,546 | 6,938,826 |
| 7,278,566 | 7,123,245 | 6,992,662 | 7,190,346 | 11/074,800 | 11/074,782 | 11/074,777 |
| 11/075,917 | 7,221,781 | 11/102,843 | 7,213,756 | 11/188,016 | 7,180,507 | 7,263,225 |
| 7,287,688 | 11/737,094 | 11/753,570 | 11/782,596 | 11/865,711 | 12/054,194 | 12/049,376 |
| 12/049,377 | 12/049,379 | 12/049,987 | 12/050,005 | 12/050,014 | 12/050,025 | 12/050,054 |
| 12/050,067 | 12/050,080 | 12/050,092 | 12/050,101 | 12/036,904 | 11,856,061 | 11,856,062 |
| 11,856,064 | 11,856,066 | 11/672,522 | 11/672,950 | 11/672,947 | 11/672,891 | 11/672,954 |
| 11/672,533 | 11,754,310 | 11/754,321 | 11/754,320 | 11/754,319 | 11/754,318 | 11/754,317 |
| 11/754,316 | 11/754,315 | 11/754,314 | 11/754,313 | 11/754,312 | 11/754,311 | 12/015,507 |
| 12/015,508 | 12/015,509 | 12/015,510 | 12/015,511 | 12/015,512 | 12/015,513 | 6,593,166 |
| 7,132,679 | 6,940,088 | 7,119,357 | 7,307,272 | 6,755,513 | 6,974,204 | 6,409,323 |
| 7,055,930 | 6,281,912 | 6,893,109 | 6,604,810 | 6,824,242 | 6,318,920 | 7,210,867 |
| 6,488,422 | 6,655,786 | 6,457,810 | 6,485,135 | 6,796,731 | 6,904,678 | 6,641,253 |
| 7,125,106 | 6,786,658 | 7,097,273 | 6,824,245 | 7,222,947 | 6,918,649 | 6,860,581 |
| 6,929,351 | 7,063,404 | 6,969,150 | 7,004,652 | 6,871,938 | 6,905,194 | 6,846,059 |
| 6,997,626 | 7,303,256 | 7,029,098 | 6,966,625 | 7,114,794 | 7,207,646 | 7,077,496 |
| 7,284,831 | 11/072,529 | 7,152,938 | 7,182,434 | 7,182,430 | 7,306,317 | 7,032,993 |
| 7,325,905 | 11/155,545 | 11/144,813 | 7,172,266 | 7,258,430 | 7,128,392 | 7,210,866 |
| 7,306,322 | 11/505,933 | 11/540,727 | 11/635,480 | 7,354,208 | 11/706,303 | 11/709,084 |
| 11/730,776 | 11/744,143 | 11/779,845 | 11/782,589 | 11/863,256 | 11/940,302 | 11/940,235 |
| 11,955,359 | 12/019,583 | 12/019,566 | 12/036,910 | 12/043,795 | 11/066,161 | 7,341,330 |
| 11/066,159 | 11/066,158 | 7,287,831 | 11/875,936 | 12/017,818 | 6,804,030 | 6,807,315 |
| 6,771,811 | 6,683,996 | 7,271,936 | 7,304,771 | 6,965,691 | 7,058,219 | 7,289,681 |
| 7,187,807 | 7,181,063 | 11/338,783 | 11/603,823 | 7,349,572 | 12/025,633 | 10/727,181 |
| 10/727,162 | 10/727,163 | 10/727,245 | 7,121,639 | 7,165,824 | 7,152,942 | 10/727,157 |
| 7,181,572 | 7,096,137 | 7,302,592 | 7,278,034 | 7,188,282 | 10/727,159 | 10/727,180 |
| 10/727,179 | 10/727,192 | 10/727,274 | 10/727,164 | 10/727,161 | 10/727,198 | 10/727,158 |
| 10/754,536 | 10/754,938 | 10/727,160 | 10/934,720 | 7,171,323 | 7,278,697 | 11/442,131 |
| 11/474,278 | 11/488,853 | 7,328,115 | 11,749,750 | 11,749,749 | 11,955,127 | 11,951,213 |
| 12/050,941 | 12/043,844 | 12/047,315 | 10/296,522 | 6,795,215 | 7,070,098 | 7,154,638 |
| 6,805,419 | 6,859,289 | 6,977,751 | 6,398,332 | 6,394,573 | 6,622,923 | 6,747,760 |
| 6,921,144 | 10/884,881 | 7,092,112 | 7,192,106 | 11/039,866 | 7,173,739 | 6,986,560 |
| 7,008,033 | 11/148,237 | 7,222,780 | 7,270,391 | 7,150,510 | 11/478,599 | 11/499,749 |
| 11/521,388 | 11/738,518 | 11/482,981 | 11/743,662 | 11/743,661 | 11/743,659 | 11/743,655 |
| 11/743,657 | 11/752,900 | 11,926,109 | 11/927,163 | 11,929,567 | 7,195,328 | 7,182,422 |
| 11/650,537 | 11/712,540 | 10/854,521 | 10/854,522 | 10/854,488 | 7,281,330 | 10/854,503 |
| 7,328,956 | 10/854,509 | 7,188,928 | 7,093,989 | 10/854,497 | 10/854,495 | 10/854,498 |
| 10/854,511 | 10/854,512 | 10/854,525 | 10/854,526 | 10/854,516 | 7,252,353 | 10/854,515 |
| 7,267,417 | 10/854,505 | 10/854,493 | 7,275,805 | 7,314,261 | 10/854,490 | 7,281,777 |
| 7,290,852 | 10/854,528 | 10/854,523 | 10/854,527 | 10/854,524 | 10/854,520 | 10/854,514 |
| 10/854,519 | 10/854,513 | 10/854,499 | 10/854,501 | 7,266,661 | 7,243,193 | 10/854,518 |
| 10/854,517 | 10/934,628 | 7,163,345 | 7,322,666 | 11/601,757 | 11/706,295 | 11/735,881 |
| 11,748,483 | 11,749,123 | 11/766,061 | 11,775,135 | 11,772,235 | 11/778,569 | 11/829,942 |
| 11/870,342 | 11/935,274 | 11/937,239 | 11,961,907 | 11,961,940 | 11,961,961 | 12/055,314 |
| 11/014,731 | D529081 | D541848 | D528597 | 6,924,907 | 6,712,452 | 6,416,160 |
| 6,238,043 | 6,958,826 | 6,812,972 | 6,553,459 | 6,967,741 | 6,956,669 | 6,903,766 |
| 6,804,026 | 7,259,889 | 6,975,429 | 10/636,234 | 10/636,233 | 7,301,567 | 10/636,216 |
| 7,274,485 | 7,139,084 | 7,173,735 | 7,068,394 | 7,286,182 | 7,086,644 | 7,250,977 |
| 7,146,281 | 7,023,567 | 7,136,183 | 7,083,254 | 6,796,651 | 7,061,643 | 7,057,758 |
| 6,894,810 | 6,995,871 | 7,085,010 | 7,092,126 | 7,123,382 | 7,061,650 | 10/853,143 |
| 6,986,573 | 6,974,212 | 7,307,756 | 7,173,737 | 10/954,168 | 7,246,868 | 11/065,357 |
| 7,137,699 | 11/107,798 | 7,148,994 | 7,077,497 | 11/176,372 | 7,248,376 | 11/225,158 |
| 7,306,321 | 7,173,729 | 11/442,132 | 11/478,607 | 11/503,085 | 11/545,502 | 11/583,943 |
| 11/585,946 | 11/653,239 | 11/653,238 | 11/764,781 | 11/764,782 | 11/779,884 | 11,845,666 |
| 11/872,637 | 11/944,401 | 11/940,215 | 11/544,764 | 11/544,765 | 11/544,772 | 11/544,773 |
| 11/544,774 | 11/544,775 | 11/544,776 | 11/544,766 | 11/544,767 | 11/544,771 | 11/544,770 |
| 11/544,769 | 11/544,777 | 11/544,768 | 11/544,763 | 11/293,804 | 11/293,840 | 11/293,803 |
| 11/293,833 | 11/293,834 | 11/293,835 | 11/293,836 | 11/293,837 | 11/293,792 | 11/293,794 |
| 11/293,839 | 11/293,826 | 11/293,829 | 11/293,830 | 11/293,827 | 11/293,828 | 7,270,494 |
| 11/293,823 | 11/293,824 | 11/293,831 | 11/293,815 | 11/293,819 | 11/293,818 | 11/293,817 |
| 11/293,816 | 11/838,875 | 11/482,978 | 11/640,356 | 11/640,357 | 11/640,358 | 11/640,359 |
| 11/640,360 | 11/640,355 | 11/679,786 | 11/872,714 | 10/760,254 | 10/760,210 | 10/760,202 |

-continued

| | | | | | | |
|---|---|---|---|---|---|---|
| 7,201,468 | 10/760,198 | 10/760,249 | 7,234,802 | 7,303,255 | 7,287,846 | 7,156,511 |
| 10/760,264 | 7,258,432 | 7,097,291 | 10/760,222 | 10/760,248 | 7,083,273 | 10/760,192 |
| 10/760,203 | 10/760,204 | 10/760,205 | 10/760,206 | 10/760,267 | 10/760,270 | 7,198,352 |
| 10/760,271 | 7,303,251 | 7,201,470 | 7,121,655 | 7,293,861 | 7,232,208 | 7,328,985 |
| 7,344,232 | 7,083,272 | 7,261,400 | 11/474,272 | 11/474,315 | 7,311,387 | 11/583,874 |
| 7,303,258 | 11/706,322 | 11/706,968 | 11/749,119 | 11,749,157 | 11,779,848 | 11/782,590 |
| 11/855,152 | 11,855,151 | 11/870,327 | 11/934,780 | 11/935,992 | 11,951,193 | 12/017,327 |
| 12/015,273 | 12/036,882 | 12/050,164 | 12/050,166 | 11/014,764 | 11/014,763 | 7,331,663 |
| 11/014,747 | 7,328,973 | 11/014,760 | 11/014,757 | 7,303,252 | 7,249,822 | 11/014,762 |
| 7,311,382 | 11/014,723 | 11/014,756 | 11/014,736 | 11/014,759 | 11/014,758 | 11/014,725 |
| 7,331,660 | 11/014,738 | 11/014,737 | 7,322,684 | 7,322,685 | 7,311,381 | 7,270,405 |
| 7,303,268 | 11/014,735 | 11/014,734 | 11/014,719 | 11/014,750 | 11/014,749 | 7,249,833 |
| 11/758,640 | 11/775,143 | 11/838,877 | 11,944,453 | 11/944,633 | 11,955,065 | 12/003,875 |
| 12/003,952 | 12/007,818 | 12/007,817 | 12/068,679 | 12/071,187 | TBA | TBA |
| 11/014,769 | 11/014,729 | 7,331,661 | 11/014,733 | 7,300,140 | 11/014,755 | 11/014,765 |
| 11/014,766 | 11/014,740 | 7,284,816 | 7,284,845 | 7,255,430 | 11/014,744 | 7,328,984 |
| 11/014,768 | 7,322,671 | 11/014,718 | 11/014,717 | 11/014,716 | 11/014,732 | 7,347,534 |
| 11/097,268 | 11/097,185 | 11/097,184 | 11/778,567 | 11,852,958 | 11,852,907 | 11/872,038 |
| 11,955,093 | 11,961,578 | 12/022,023 | 12/023,000 | 12/023,018 | 12/031,582 | 12/043,708 |
| 11/293,820 | 11/293,813 | 11/293,822 | 11/293,812 | 11/293,821 | 11/293,814 | 11/293,793 |
| 11/293,842 | 11/293,811 | 11/293,807 | 11/293,806 | 11/293,805 | 11/293,810 | 12/050,021 |
| 11/688,863 | 11/688,864 | 11/688,865 | 11/688,866 | 11/688,867 | 11/688,868 | 11/688,869 |
| 11/688,871 | 11/688,872 | 11/688,873 | 11/741,766 | 12/014,767 | 12/014,768 | 12/014,769 |
| 12/014,770 | 12/014,771 | 12/014,772 | 12/014,773 | 12/014,774 | 12/014,775 | 12/014,776 |
| 12/014,777 | 12/014,778 | 12/014,779 | 12/014,780 | 12/014,781 | 12/014,782 | 12/014,783 |
| 12/014,784 | 12/014,785 | 12/014,787 | 12/014,788 | 12/014,789 | 12/014,790 | 12/014,791 |
| 12/014,792 | 12/014,793 | 12/014,794 | 12/014,796 | 12/014,798 | 12/014,801 | 12/014,803 |
| 12/014,804 | 12/014,805 | 12/014,806 | 12/014,807 | 12/049,371 | 12/049,372 | 12/049,373 |
| 12/049,374 | 12/049,375 | 61/034,147 | 11/482,982 | 11/482,983 | 11/482,984 | 11/495,818 |
| 11/495,819 | 11/677,049 | 11/677,050 | 11/677,051 | 11,872,719 | 11,872,718 | 12/046,449 |
| 61/033,357 | 7,306,320 | 11/934,781 | D528156 | 10/760,180 | 7,111,935 | 10/760,213 |
| 10/760,219 | 10/760,237 | 7,261,482 | 10/760,220 | 7,002,664 | 10/760,252 | 10/760,265 |
| 7,088,420 | 11/446,233 | 11/503,083 | 11/503,081 | 11/516,487 | 11/599,312 | 6,364,451 |
| 6,533,390 | 6,454,378 | 7,224,478 | 6,559,969 | 6,896,362 | 7,057,760 | 6,982,799 |
| 11/202,107 | 11/743,672 | 11,744,126 | 11/743,673 | 7,093,494 | 7,143,652 | 7,089,797 |
| 7,159,467 | 7,234,357 | 7,124,643 | 7,121,145 | 7,089,790 | 7,194,901 | 6,968,744 |
| 7,089,798 | 7,240,560 | 7,137,302 | 11/442,177 | 7,171,855 | 7,260,995 | 7,260,993 |
| 7,165,460 | 7,222,538 | 7,258,019 | 11/543,047 | 7,258,020 | 11/604,324 | 7,334,480 |
| 11/706,305 | 11/707,056 | 11/744,211 | 11/767,526 | 11/779,846 | 11/764,227 | 11/829,943 |
| 11/829,944 | 12/015,390 | 12/031,475 | 12/056,274 | 6,454,482 | 6,808,330 | 6,527,365 |
| 6,474,773 | 6,550,997 | 7,093,923 | 6,957,923 | 7,131,724 | 10/949,288 | 7,168,867 |
| 7,125,098 | 11/706,966 | 11/185,722 | 7,249,901 | 7,188,930 | 11/014,728 | 11/014,727 |
| D536031 | D531214 | 7,237,888 | 7,168,654 | 7,201,272 | 6,991,098 | 7,217,051 |
| 6,944,970 | 10/760,215 | 7,108,434 | 10/760,257 | 7,210,407 | 7,186,042 | 10/760,266 |
| 6,920,704 | 7,217,049 | 10/760,214 | 10/760,260 | 7,147,102 | 7,287,828 | 7,249,838 |
| 10/760,241 | 10/962,413 | 10/962,427 | 7,261,477 | 7,225,739 | 10/962,402 | 10/962,425 |
| 10/962,428 | 7,191,978 | 10/962,426 | 10/962,409 | 10/962,417 | 10/962,403 | 7,163,287 |
| 7,258,415 | 7,322,677 | 7,258,424 | 10/962,410 | 7,195,412 | 7,207,670 | 7,270,401 |
| 7,220,072 | 11/474,267 | 11/544,547 | 11/585,925 | 11/593,000 | 11/706,298 | 11/706,296 |
| 11/706,327 | 11/730,760 | 11/730,407 | 11/730,787 | 11/735,977 | 11/736,527 | 11/753,566 |
| 11/754,359 | 11/778,061 | 11/765,398 | 11/778,556 | 11/829,937 | 11/780,470 | 11/866,399 |
| 12/050,157 | 11/223,262 | 11/223,018 | 11/223,114 | 11,955,366 | 7,322,761 | 11/223,021 |
| 11/223,020 | 11/223,019 | 11/014,730 | D541849 | 29/279,123 | 6,716,666 | 6,949,217 |
| 6,750,083 | 7,014,451 | 6,777,259 | 6,923,524 | 6,557,978 | 6,991,207 | 6,766,998 |
| 6,967,354 | 6,759,723 | 6,870,259 | 10/853,270 | 6,925,875 | 10/898,214 | 7,095,109 |
| 7,145,696 | 10/976,081 | 7,193,482 | 7,134,739 | 7,222,939 | 7,164,501 | 7,118,186 |
| 7,201,523 | 7,226,159 | 7,249,839 | 7,108,343 | 7,154,626 | 7,079,292 | 10/980,184 |
| 7,233,421 | 7,063,408 | 10/983,082 | 10/982,804 | 7,032,996 | 10/982,834 | 10/982,833 |
| 7,349,216 | 7,217,046 | 6,948,870 | 7,195,336 | 7,070,257 | 10/986,813 | 10/986,785 |
| 7,093,922 | 6,988,789 | 10/986,788 | 7,246,871 | 10/992,748 | 10/992,747 | 7,187,468 |
| 10/992,828 | 7,196,814 | 10/992,754 | 7,268,911 | 7,265,869 | 7,128,384 | 7,164,505 |
| 7,284,805 | 7,025,434 | 7,298,519 | 7,280,244 | 7,206,098 | 7,265,877 | 7,193,743 |
| 7,168,777 | 11/006,734 | 7,195,329 | 7,198,346 | 7,281,786 | 11/013,363 | 11/013,881 |
| 6,959,983 | 7,128,386 | 7,097,104 | 11/013,636 | 7,083,261 | 7,070,258 | 7,083,275 |
| 7,110,139 | 6,994,419 | 6,935,725 | 11/026,046 | 7,178,892 | 7,219,429 | 6,988,784 |
| 11/026,135 | 7,289,156 | 11/064,005 | 7,284,976 | 7,178,903 | 7,273,274 | 7,083,256 |
| 7,325,986 | 7,278,707 | 7,325,918 | 6,974,206 | 11/064,004 | 7,066,588 | 7,222,940 |
| 11/075,918 | 7,018,025 | 7,221,867 | 7,290,863 | 7,188,938 | 7,021,742 | 7,083,262 |
| 7,192,119 | 11/083,021 | 7,036,912 | 7,175,256 | 7,182,441 | 7,083,258 | 7,114,796 |
| 7,147,302 | 11/084,757 | 7,219,982 | 7,118,195 | 7,229,153 | 6,991,318 | 7,108,346 |
| 11/248,429 | 11/239,031 | 7,178,899 | 7,066,579 | 11/281,419 | 20060087544 | 11/329,188 |
| 11/329,140 | 7,270,397 | 7,258,425 | 7,237,874 | 7,152,961 | 7,333,235 | 7,207,658 |
| 11/484,744 | 7,311,257 | 7,207,659 | 11/525,857 | 11/540,569 | 11/583,869 | 11/592,985 |
| 11/585,947 | 7,306,307 | 11/604,316 | 11/604,309 | 11/604,303 | 11/643,844 | 7,329,061 |
| 11/655,940 | 11/653,320 | 7,278,713 | 11/706,381 | 11/706,323 | 11/706,963 | 11/713,660 |
| 7,290,853 | 11/696,186 | 11/730,390 | 11/737,139 | 11/737,749 | 11/740,273 | 11,749,122 |
| 11/754,361 | 11,766,043 | 11/764,775 | 11/768,872 | 11/775,156 | 11/779,271 | 11/779,272 |
| 11/829,938 | 11/839,502 | 11,858,852 | 11/862,188 | 11,859,790 | 11/872,618 | 11/923,651 |
| 11,950,255 | 11,930,001 | 11,955,362 | 12/015,368 | 11,965,718 | 12/049,975 | 12/050,946 |

-continued

| | | | | | | |
|---|---|---|---|---|---|---|
| 6,485,123 | 6,425,657 | 6,488,358 | 7,021,746 | 6,712,986 | 6,981,757 | 6,505,912 |
| 6,439,694 | 6,364,461 | 6,378,990 | 6,425,658 | 6,488,361 | 6,814,429 | 6,471,336 |
| 6,457,813 | 6,540,331 | 6,454,396 | 6,464,325 | 6,443,559 | 6,435,664 | 6,412,914 |
| 6,488,360 | 6,550,896 | 6,439,695 | 6,447,100 | 09/900,160 | 6,488,359 | 6,637,873 |
| 10/485,738 | 6,618,117 | 10/485,737 | 6,803,989 | 7,234,801 | 7,044,589 | 7,163,273 |
| 6,416,154 | 6,547,364 | 10/485,744 | 6,644,771 | 7,152,939 | 6,565,181 | 7,325,897 |
| 6,857,719 | 7,255,414 | 6,702,417 | 7,284,843 | 6,918,654 | 7,070,265 | 6,616,271 |
| 6,652,078 | 6,503,408 | 6,607,263 | 7,111,924 | 6,623,108 | 6,698,867 | 6,488,362 |
| 6,625,874 | 6,921,153 | 7,198,356 | 6,536,874 | 6,425,651 | 6,435,667 | 10/509,997 |
| 6,527,374 | 7,334,873 | 6,582,059 | 10/510,152 | 6,513,908 | 7,246,883 | 6,540,332 |
| 6,547,368 | 7,070,256 | 6,508,546 | 10/510,151 | 6,679,584 | 7,303,254 | 6,857,724 |
| 10/509,998 | 6,652,052 | 10/509,999 | 6,672,706 | 10/510,096 | 6,688,719 | 6,712,924 |
| 6,588,886 | 7,077,508 | 7,207,654 | 6,935,724 | 6,927,786 | 6,988,787 | 6,899,415 |
| 6,672,708 | 6,644,767 | 6,874,866 | 6,830,316 | 6,994,420 | 6,954,254 | 7,086,720 |
| 7,240,992 | 7,267,424 | 7,128,397 | 7,084,951 | 7,156,496 | 7,066,578 | 7,101,023 |
| 11/165,027 | 11/202,235 | 11/225,157 | 7,159,965 | 7,255,424 | 11/349,519 | 7,137,686 |
| 7,201,472 | 7,287,829 | 11/504,602 | 7,216,957 | 11/520,572 | 11/583,858 | 11/583,895 |
| 11/585,976 | 11/635,488 | 7,278,712 | 11/706,952 | 11/706,307 | 7,287,827 | 11,944,451 |
| 11/740,287 | 11/754,367 | 11/758,643 | 11/778,572 | 11,859,791 | 11/863,260 | 11/874,178 |
| 11/936,064 | 11,951,983 | 12/015,483 | 12/050,938 | 6,916,082 | 6,786,570 | 10/753,478 |
| 6,848,780 | 6,966,633 | 7,179,395 | 6,969,153 | 6,979,075 | 7,132,056 | 6,832,828 |
| 6,860,590 | 6,905,620 | 6,786,574 | 6,824,252 | 7,097,282 | 6,997,545 | 6,971,734 |
| 6,918,652 | 6,978,990 | 6,863,105 | 10/780,624 | 7,194,629 | 10/791,792 | 6,890,059 |
| 6,988,785 | 6,830,315 | 7,246,881 | 7,125,102 | 7,028,474 | 7,066,575 | 6,986,202 |
| 7,044,584 | 7,210,762 | 7,032,992 | 7,140,720 | 7,207,656 | 7,285,170 | 11/048,748 |
| 7,008,041 | 7,011,390 | 7,048,868 | 7,014,785 | 7,131,717 | 7,284,826 | 7,331,101 |
| 7,182,436 | 7,104,631 | 7,240,993 | 7,290,859 | 11/202,217 | 7,172,265 | 7,284,837 |
| 7,066,573 | 11/298,635 | 7,152,949 | 7,334,877 | 11/442,133 | 7,326,357 | 7,156,492 |
| 11/478,588 | 7,331,653 | 7,287,834 | 11/525,861 | 11/583,939 | 11/545,504 | 7,284,326 |
| 11/635,485 | 11/730,391 | 11/730,788 | 11/749,148 | 11/749,149 | 11/749,152 | 11/749,151 |
| 11/759,886 | 11/865,668 | 11/874,168 | 11/874,203 | 11,971,182 | 12/021,086 | 12/015,441 |
| 11,965,722 | 6,824,257 | 7,270,475 | 6,971,811 | 6,878,564 | 6,921,145 | 6,890,052 |
| 7,021,747 | 6,929,345 | 6,811,242 | 6,916,087 | 6,905,195 | 6,899,416 | 6,883,906 |
| 6,955,428 | 7,284,834 | 6,932,459 | 6,962,410 | 7,033,008 | 6,962,409 | 7,013,641 |
| 7,204,580 | 7,032,997 | 6,998,278 | 7,004,563 | 6,910,755 | 6,969,142 | 6,938,994 |
| 7,188,935 | 10/959,049 | 7,134,740 | 6,997,537 | 7,004,567 | 6,916,091 | 7,077,588 |
| 6,918,707 | 6,923,583 | 6,953,295 | 6,921,221 | 7,001,008 | 7,168,167 | 7,210,759 |
| 7,337,532 | 7,331,659 | 7,322,680 | 6,988,790 | 7,192,120 | 7,168,789 | 7,004,577 |
| 7,052,120 | 11/123,007 | 6,994,426 | 7,258,418 | 7,014,298 | 7,328,977 | 11/177,394 |
| 7,152,955 | 7,097,292 | 7,207,657 | 7,152,944 | 7,147,303 | 7,338,147 | 7,134,608 |
| 7,264,333 | 7,093,921 | 7,077,590 | 7,147,297 | 20060038853 | 11/248,832 | 11/248,428 |
| 11/248,434 | 7,077,507 | 7,172,672 | 7,175,776 | 7,086,717 | 7,101,020 | 7,347,535 |
| 7,201,466 | 11/330,057 | 7,152,967 | 7,182,431 | 7,210,666 | 7,252,367 | 7,287,837 |
| 11/485,255 | 11/525,860 | 6,945,630 | 7,018,294 | 6,910,014 | 6,659,447 | 6,648,321 |
| 7,082,980 | 6,672,584 | 7,073,551 | 6,830,395 | 7,289,727 | 7,001,011 | 6,880,922 |
| 6,886,915 | 6,644,787 | 6,641,255 | 7,066,580 | 6,652,082 | 7,284,833 | 6,666,544 |
| 6,666,543 | 6,669,332 | 6,984,023 | 6,733,104 | 6,644,793 | 6,723,575 | 6,953,235 |
| 6,663,225 | 7,076,872 | 7,059,706 | 7,185,971 | 7,090,335 | 6,854,827 | 6,793,974 |
| 10/636,258 | 7,222,929 | 6,739,701 | 7,073,881 | 7,155,823 | 7,219,427 | 7,008,503 |
| 6,783,216 | 6,883,890 | 6,857,726 | 7,347,952 | 6,641,256 | 6,808,253 | 6,827,428 |
| 6,802,587 | 6,997,534 | 6,959,982 | 6,959,981 | 6,886,917 | 6,969,473 | 6,827,425 |
| 7,007,859 | 6,802,594 | 6,792,754 | 6,860,107 | 6,786,043 | 6,863,378 | 7,052,114 |
| 7,001,007 | 10/729,151 | 10/729,157 | 6,948,794 | 6,805,435 | 6,733,116 | 10/683,006 |
| 7,008,046 | 6,880,918 | 7,066,574 | 6,983,595 | 6,923,527 | 7,275,800 | 7,163,276 |
| 7,156,495 | 6,976,751 | 6,994,430 | 7,014,296 | 7,059,704 | 7,160,743 | 7,175,775 |
| 7,287,839 | 7,097,283 | 7,140,722 | 11/123,009 | 11/123,008 | 7,080,893 | 7,093,920 |
| 7,270,492 | 7,128,093 | 7,052,113 | 7,055,934 | 11/155,627 | 7,278,796 | 11/159,197 |
| 7,083,263 | 7,145,592 | 7,025,436 | 11/281,444 | 7,258,421 | 11/478,591 | 7,332,051 |
| 7,226,147 | 11/482,940 | 7,195,339 | 11/503,061 | 11/505,938 | 7,284,838 | 7,293,856 |
| 11/544,577 | 11/540,576 | 7,325,901 | 11/592,991 | 11/599,342 | 11/600,803 | 11/604,321 |
| 11/604,302 | 11/635,535 | 11/635,486 | 11/643,842 | 7,347,536 | 11/650,541 | 11/706,301 |
| 11/707,039 | 11/730,388 | 11/730,786 | 11/730,785 | 11/739,080 | 7,322,679 | 11/768,875 |
| 11/779,847 | 11/829,940 | 11,847,240 | 11/834,625 | 11/863,210 | 11/865,680 | 11/874,156 |
| 11/923,602 | 11,951,940 | 11,954,988 | 11,961,662 | 12/015,178 | 12/015,157 | 12/017,305 |
| 12/017,926 | 12/015,261 | 12/025,605 | 12/049,961 | 12/031,646 | 7,067,067 | 6,776,476 |
| 6,880,914 | 7,086,709 | 6,783,217 | 7,147,791 | 6,929,352 | 7,144,095 | 6,820,974 |
| 6,918,647 | 6,984,016 | 7,192,125 | 6,824,251 | 6,834,939 | 6,840,600 | 6,786,573 |
| 7,144,519 | 6,799,835 | 6,959,975 | 6,959,974 | 7,021,740 | 6,935,718 | 6,938,983 |
| 6,938,991 | 7,226,145 | 7,140,719 | 6,988,788 | 7,022,250 | 6,929,350 | 7,011,393 |
| 7,004,566 | 7,175,097 | 6,948,799 | 7,143,944 | 7,310,157 | 7,029,100 | 6,957,811 |
| 7,073,724 | 7,055,933 | 7,077,490 | 7,055,940 | 10/991,402 | 7,234,645 | 7,032,999 |
| 7,066,576 | 7,229,150 | 7,086,728 | 7,246,879 | 7,284,825 | 7,140,718 | 7,284,817 |
| 7,144,098 | 7,044,577 | 7,284,824 | 7,284,827 | 7,189,334 | 7,055,935 | 7,152,860 |
| 11/203,188 | 11/203,173 | 7,334,868 | 7,213,989 | 7,341,336 | 11/225,173 | 7,300,141 |
| 7,114,868 | 7,168,796 | 7,159,967 | 7,328,966 | 7,152,805 | 11/298,530 | 11/330,061 |
| 7,133,799 | 11/330,054 | 11/329,284 | 7,152,956 | 7,128,399 | 7,147,305 | 7,287,702 |
| 7,325,904 | 7,246,884 | 7,152,960 | 11/442,125 | 11/454,901 | 11/442,134 | 11/450,441 |
| 11/474,274 | 11/499,741 | 7,270,399 | 6,857,728 | 6,857,729 | 6,857,730 | 6,989,292 |
| 7,126,216 | 6,977,189 | 6,982,189 | 7,173,332 | 7,026,176 | 6,979,599 | 6,812,062 |

-continued

| | | | | | | |
|---|---|---|---|---|---|---|
| 6,886,751 | 10/804,057 | 10/804,036 | 7,001,793 | 6,866,369 | 6,946,743 | 7,322,675 |
| 6,886,918 | 7,059,720 | 7,306,305 | 10/846,562 | 7,334,855 | 10/846,649 | 7,347,517 |
| 6,951,390 | 6,981,765 | 6,789,881 | 6,802,592 | 7,029,097 | 6,799,836 | 7,048,352 |
| 7,182,267 | 7,025,279 | 6,857,571 | 6,817,539 | 6,830,198 | 6,992,791 | 7,038,809 |
| 6,980,323 | 7,148,992 | 7,139,091 | 6,947,173 | 7,101,034 | 6,969,144 | 6,942,319 |
| 6,827,427 | 6,984,021 | 6,984,022 | 6,869,167 | 6,918,542 | 7,007,852 | 6,899,420 |
| 6,918,665 | 6,997,625 | 6,988,840 | 6,984,080 | 6,845,978 | 6,848,687 | 6,840,512 |
| 6,863,365 | 7,204,582 | 6,921,150 | 7,128,396 | 6,913,347 | 7,008,819 | 6,935,736 |
| 6,991,317 | 7,284,836 | 7,055,947 | 7,093,928 | 7,100,834 | 7,270,396 | 7,187,086 |
| 7,290,856 | 7,032,825 | 7,086,721 | 7,159,968 | 7,010,456 | 7,147,307 | 7,111,925 |
| 7,334,867 | 7,229,154 | 11/505,849 | 11/520,570 | 7,328,994 | 7,341,672 | 11/540,575 |
| 11/583,937 | 7,278,711 | 7,290,720 | 7,314,266 | 11/635,489 | 11/604,319 | 11/635,490 |
| 11/635,525 | 7,287,706 | 11/706,366 | 11/706,310 | 11/706,308 | 11/785,108 | 11/744,214 |
| 11,744,218 | 11,748,485 | 11/748,490 | 11/764,778 | 11/766,025 | 11/834,635 | 11,839,541 |
| 11,860,420 | 11/865,693 | 11/863,118 | 11/866,307 | 11/866,340 | 11/869,684 | 11/869,722 |
| 11/869,694 | 11/876,592 | 11/945,244 | 11,951,121 | 11/945,238 | 11,955,358 | 11,965,710 |
| 11,962,050 | 12/015,478 | 12/015,423 | 12/015,434 | 12/023,015 | 12/030,755 | 12/025,641 |
| 12/056,228 | 12/036,279 | 12/031,598 | 12/050,949 | 123056217 | | |

BACKGROUND OF THE INVENTION

The Applicant has developed a wide range of printers that employ pagewidth printheads instead of traditional reciprocating printhead designs. Pagewidth designs increase print speeds as the printhead does not traverse back and forth across the page to deposit a line of an image. The pagewidth printhead simply deposits the ink on the media as it moves past at high speeds. Such printheads have made it possible to perform full colour 1600 dpi printing at speeds of around 60 pages per minute, speeds previously unattainable with conventional inkjet printers.

Printing at these speeds consumes ink quickly and this gives rise to problems with supplying ink to the printhead. Not only are the flow rates higher but distributing the ink along the entire length of a pagewidth printhead is more complex than feeding ink to a relatively small reciprocating printhead. In particular, the hydrostatic ink pressure requires careful control to avoid printhead flooding. The Applicant has previously described means for controlling hydrostatic ink pressure in an ink supply system for a pagewidth printhead (see U.S. application Ser. No. 11/677,049 filed Feb. 21, 2007 and U.S. application Ser. No. 11/872,714 filed Oct. 16, 2007, the contents of which are herein incorporated by reference).

Additionally, the Applicant's design of high speed A4 pagewidth printers requires periodic replacement of a printhead cartridge, which comprises the printhead. In order to replace a printhead cartridge, it is necessary to deprime a printhead, remove the printhead from the printer, replace the printhead with a new replacement printhead, and prime the replacement printhead once it is installed in the printer. Hence, the ink supply system must be able to perform prime and deprime operations efficiently and, preferably, with minimal ink wastage.

SUMMARY OF THE INVENTION

In a first aspect the present invention provides an ink supply system for supplying ink to an inkjet printhead at a predetermined hydrostatic pressure, said ink supply system comprising:

a pressure-regulating chamber having an outlet port connected to an ink inlet of said printhead, said chamber comprising a float valve configured for maintaining a predetermined level of ink in said chamber, said level of ink controlling said hydrostatic pressure; and an ink reservoir connected to an inlet port of said pressure-regulating chamber, said ink reservoir being positioned above said predetermined level of ink.

Optionally, said hydrostatic pressure, relative to atmospheric pressure, is defined as $\rho gh$, wherein $\rho$ is the density of ink, g is acceleration due to gravity and h is the height of the predetermined level of ink relative to the printhead.

Optionally, said pressure-regulating chamber is positioned below said printhead, and said hydrostatic pressure is negative relative to atmospheric pressure.

Optionally, said float valve comprises:

an arm pivotally mounted about a pivot;

a float mounted at one end of said arm; and a valve head mounted at an opposite end of said arm, wherein said valve head is positioned for sealing engagement with a valve seat at said inlet port.

Optionally, said inlet port and said outlet port of said pressure-regulating chamber are positioned towards a base of said chamber.

In a further aspect the ink supply system further comprising a printhead priming system.

In another aspect the ink supply system comprising:

an air pump communicating with a headspace above said ink in said chamber; and a valve positioned between said ink reservoir and said inlet port, wherein, in a priming configuration, said valve is configured to be shut and said pump is configured to positively pressurize said headspace thereby forcing ink from said chamber into an ink inlet of said printhead.

Optionally, a sensor is positioned for sensing ink in a downstream ink line connected to an ink outlet of said printhead, said sensor cooperating with said pump such that said pump is shut off when said sensor senses any ink.

In another aspect the ink supply system further comprising means for controlling an amount of ink flowing from said downstream ink line back into said pressure-regulating chamber.

Optionally, said means is selected from the group comprising:

an electronically-controlled valve;

a check-valve; and a loop section passing below said predetermined level of ink in said chamber.

Optionally, said sensor is an optical sensor.

In a further aspect the ink supply system further comprising means for minimizing phantom sensing of ink caused by ink bubbles in said downstream ink line.

In a further aspect the ink supply system comprising a bubble-bursting box, said box comprising:

at least one bubble-bursting chamber having a respective chamber inlet; and an air outlet.

Optionally, said air outlet is open to atmosphere or said air outlet communicates with a pump inlet of said air pump.

Optionally, said at least one bubble-bursting chamber is dimensioned to promote expansion and bursting of ink bubbles entering said chamber via said chamber inlet.

Optionally, said bubble-bursting box comprises a plurality of bubble-bursting chambers, each chamber corresponding to a respective ink channel of said ink supply system.

Optionally, said bubble-bursting box comprises an air chamber in fluid communication with said at least one bubble-bursting chamber via an air channel defined in a roof of said box, said air outlet being defined in said air chamber.

Optionally, said air channel is a hydrophobic serpentine channel comprising at least one ink-trapping stomach, said air channel minimizing transfer of ink to said air chamber when said box is tipped.

Optionally, said pump is a reversible pump.

Optionally, in a de-priming configuration, said pump is reversed and ink is pulled from said printhead towards said pressure-regulating chamber.

In a second aspect the present invention provides a priming system for priming an inkjet printhead having an ink inlet, an ink outlet and a plurality of nozzles, said priming system comprising:

an ink chamber having an outlet port connected to said ink inlet via an upstream ink line;

an air pump having a pump outlet communicating with a headspace above said ink in said ink chamber;

a sensor positioned for sensing ink in a downstream ink line connected to said ink outlet, said sensor cooperating with said pump such that said pump is shut off when said sensor senses any ink; and means for minimizing phantom sensing of ink caused by ink bubbles in said downstream ink line, wherein, in a priming configuration, said pump is configured to positively pressurize said headspace until said sensor senses ink.

Optionally, said ink chamber is a pressure-regulating chamber, and said priming system further comprises:

an ink reservoir in fluid communication with an inlet port of said pressure-regulating chamber, said ink reservoir being positioned above a level of ink in said chamber; and a valve positioned between said ink reservoir and said inlet port, wherein, in said priming configuration, said valve is configured to be shut.

Optionally, said pump is reversible for effecting de-priming operations.

Optionally, in a de-priming configuration, said pump is reversed and ink is pulled from said printhead towards said ink chamber.

Optionally, said ink outlet is in fluid communication with a pump inlet, thereby enabling both pushing and pulling of ink during a priming and/or a de-priming operation.

In a further aspect there is provided a priming system further comprising means for controlling, after priming, an amount of ink flowing from said downstream ink line back into said pressure-regulating chamber.

Optionally, said means is selected from the group comprising:

an electronically-controlled valve;

a check-valve; and a loop section passing below a level of ink in said chamber.

Optionally, said sensor comprises an optical sensor.

Optionally, said means for minimizing phantom sensing of ink comprises a bubble-bursting box, said box comprising:

one or more bubble-bursting chambers having a respective chamber inlet; and an air outlet.

Optionally, said sensor is positioned to sense ink above a bubble-bursting point in at least one of said bubble-bursting chambers.

Optionally, said at least one bubble-bursting chamber is transparent.

Optionally, said air outlet is:

open to atmosphere; or in fluid communication with a pump inlet of said pump, thereby enabling both pushing and pulling of ink through said printhead during a priming or a de-priming operation.

Optionally, said bubble-bursting box comprises a plurality of bubble-bursting chambers, each chamber corresponding to a respective ink channel of said ink supply system.

Optionally, each bubble-bursting chamber is dimensioned to promote expansion and bursting of ink bubbles entering said chamber via said chamber inlet.

Optionally, each bubble-bursting chamber has curved sidewalls, wherein a curvature of said sidewalls is greater than a curvature of said conduit.

Optionally, each bubble-bursting chamber is generally crescent-shaped, thereby maximizing said curvature in a minimal volume.

Optionally, said bubble-bursting box comprises an air chamber in fluid communication with said bubble-bursting chambers via an air channel defined in a roof of said box, said air outlet being defined in said air chamber.

Optionally, said air channel is a hydrophobic serpentine channel comprising at least one ink-trapping stomach, said air channel minimizing transfer of ink to said air chamber when said box is tipped.

Optionally, said printhead is replaceable.

Optionally, said printhead comprises one or more printhead integrated circuits mounted on an ink distribution manifold, each printhead integrated circuit comprising a plurality of nozzles, and said manifold having said ink inlet and said ink outlet.

In a third aspect the present invention provides a printer comprising:

an inkjet printhead having an ink inlet, an ink outlet and a plurality of nozzles;

an ink supply system for supplying ink to said inkjet printhead at a predetermined hydrostatic pressure, said ink supply system comprising:

a pressure-regulating chamber having an outlet port connected to said ink inlet of said printhead, said chamber comprising a float valve configured for maintaining a predetermined level of ink in said chamber, said level of ink controlling said hydrostatic pressure; and an ink reservoir connected to an inlet port of said pressure-regulating chamber, said ink reservoir being positioned above said predetermined level of ink.

Optionally, said hydrostatic pressure, relative to atmospheric pressure, is defined as $\rho gh$, wherein $\rho$ is the density of ink, g is acceleration due to gravity and h is the height of the predetermined level of ink relative to the printhead.

Optionally, said pressure-regulating chamber is positioned below said printhead, and said hydrostatic pressure is negative relative to atmospheric pressure.

Optionally, said float valve comprises:

an arm pivotally mounted about a pivot;

a float mounted at one end of said arm; and a valve head mounted at an opposite end of said arm, wherein said valve head is positioned for sealing engagement with a valve seat at said inlet port.

Optionally, said inlet port and said outlet port of said pressure-regulating chamber are positioned towards a base of said chamber.

In a further aspect the printer further comprising a printhead priming system.

In another aspect the printer comprising:

an air pump communicating with a headspace above said ink in said chamber; and a valve positioned between said ink reservoir and said inlet port, wherein, in a priming configuration, said valve is configured to be shut and said pump is configured to positively pressurize said headspace thereby forcing ink from said chamber into an ink inlet of said printhead.

Optionally, a sensor is positioned for sensing ink in a downstream ink line connected to an ink outlet of said printhead, said sensor cooperating with said pump such that said pump is shut off when said sensor senses any ink.

In another aspect the printer further comprising means for controlling an amount of ink flowing from said downstream ink line back into said pressure-regulating chamber.

Optionally, said means is selected from the group comprising:

an electronically-controlled valve;

a check-valve; and a loop section passing below said predetermined level of ink in said chamber.

Optionally, said sensor is an optical sensor.

In a further aspect the printer further comprising means for minimizing phantom sensing of ink caused by ink bubbles in said downstream ink line.

In another aspect the printer comprising a bubble-bursting box, said box comprising:

at least one bubble-bursting chamber having a respective chamber inlet; and an air outlet.

Optionally, said air outlet is open to atmosphere or said air outlet communicates with a pump inlet of said air pump.

Optionally, said at least one bubble-bursting chamber is dimensioned to promote expansion and bursting of ink bubbles entering said chamber via said chamber inlet.

Optionally, said bubble-bursting box comprises a plurality of bubble-bursting chambers, each chamber corresponding to a respective ink channel of said ink supply system.

Optionally, said bubble-bursting box comprises an air chamber in fluid communication with said at least one bubble-bursting chamber via an air channel defined in a roof of said box, said air outlet being defined in said air chamber.

Optionally, said air channel is a hydrophobic serpentine channel comprising at least one ink-trapping stomach, said air channel minimizing transfer of ink to said air chamber when said box is tipped.

Optionally, said pump is a reversible pump.

Optionally, in a de-priming configuration, said pump is reversed and ink is pulled from said printhead towards said pressure-regulating chamber.

In a fourth aspect the present invention provides a printer comprising:

an inkjet printhead having an ink inlet, an ink outlet and a plurality of nozzles;

a priming system for priming said printhead, said priming system comprising:

an ink chamber having an outlet port connected to said ink inlet via an upstream ink line;

an air pump having a pump outlet communicating with a headspace above said ink in said chamber;

a sensor positioned for sensing ink in a downstream ink line connected to said ink outlet, said sensor cooperating with said pump such that said pump is shut off when said sensor senses any ink; and means for minimizing phantom sensing of ink caused by ink bubbles in said downstream ink line, wherein, in a priming configuration, said pump is configured to positively pressurize said headspace until said sensor senses ink.

Optionally, said ink chamber is a pressure-regulating chamber, and said priming system further comprises:

an ink reservoir in fluid communication with an inlet port of said pressure-regulating chamber, said ink reservoir being positioned above a level of ink in said chamber; and a valve positioned between said ink reservoir and said inlet port, wherein, in said priming configuration, said valve is configured to be shut.

Optionally, said pump is reversible for effecting de-priming operations.

Optionally, in a de-priming configuration, said pump is reversed and ink is pulled from said printhead towards said ink chamber.

Optionally, said ink outlet is in fluid communication with a pump inlet, thereby enabling both pushing and pulling of ink during a priming and/or a de-priming operation.

In a further aspect the printer further comprising means for controlling an amount of ink flowing from said downstream ink line back into said pressure-regulating chamber.

Optionally, said means is selected from the group comprising:

an electronically-controlled valve;

a check-valve; and a loop section passing below a level of ink in said chamber.

Optionally, said sensor comprises an optical sensor.

Optionally, said means for minimizing phantom sensing of ink comprises a bubble-bursting box, said box comprising:

one or more bubble-bursting chambers having a respective chamber inlet; and an air outlet.

Optionally, said sensor is positioned to sense ink above a bubble-bursting point in at least one of said bubble-bursting chambers.

Optionally, said at least one bubble-bursting chamber is transparent.

Optionally, said air outlet is:

open to atmosphere; or in fluid communication with a pump inlet of said pump, thereby enabling both pushing and pulling of ink through said printhead during a priming or a de-priming operation.

Optionally, said bubble-bursting box comprises a plurality of bubble-bursting chambers, each chamber corresponding to a respective ink channel of said ink supply system.

Optionally, each bubble-bursting chamber is dimensioned to promote expansion and bursting of ink bubbles entering said chamber via said chamber inlet.

Optionally, each bubble-bursting chamber has curved sidewalls, wherein a curvature of said sidewalls is greater than a curvature of said conduit.

Optionally, each bubble-bursting chamber is generally crescent-shaped, thereby maximizing said curvature in a minimal volume.

Optionally, said bubble-bursting box comprises an air chamber in fluid communication with said bubble-bursting chambers via an air channel defined in a roof of said box, said air outlet being defined in said air chamber.

Optionally, said air channel is a hydrophobic serpentine channel comprising at least one ink-trapping stomach, said air channel minimizing transfer of ink to said air chamber when said box is tipped.

Optionally, said printhead is a replaceable pagewidth printhead.

Optionally, said printhead comprises one or more printhead integrated circuits mounted on an ink distribution manifold, each printhead integrated circuit comprising a plurality of nozzles, and said manifold having said ink inlet and said ink outlet.

In a fifth aspect the present invention provides an ink sensing device for an ink supply system, said device comprising:

a bubble-bursting box comprising:

one or more bubble-bursting chambers, each chamber having a respective chamber inlet for connection to an ink line; and an air outlet in fluid communication with each chamber; and a sensor positioned to sense ink above a bubble-bursting point in at least one of said bubble-bursting chambers, wherein said device is configured to minimize phantom sensing of ink caused by ink bubbles in said ink line.

Optionally, said bubble-bursting box comprises a plurality of bubble-bursting chambers, each chamber corresponding to a respective ink channel of an ink supply system.

Optionally, each bubble-bursting chamber is dimensioned to promote expansion and bursting of ink bubbles entering said chamber via said chamber inlet.

Optionally, each bubble-bursting chamber has curved sidewalls, wherein a curvature of said sidewalls is greater than a curvature of a conduit defining said ink line.

Optionally, each bubble-bursting chamber is generally crescent-shaped, thereby maximizing said curvature in a minimal volume.

Optionally, said bubble-bursting box comprises a common air chamber in fluid communication with each bubble-bursting chamber, said air outlet being positioned in said air chamber.

Optionally, each bubble-bursting chamber communicates with said air chamber via a respective air channel defined in a roof of said box.

Optionally, each air channel is a serpentine channel for minimizing transfer of ink to said air chamber when said box is tipped.

Optionally, each air channel is hydrophobic.

Optionally, each air channel comprises at least one ink-trapping stomach.

Optionally, each air channel terminates at a channel outlet defined in a roof of said box, each channel outlet being positioned to deposit ink into said air chamber.

Optionally, said air outlet is defined in a base of said air chamber, and each channel outlet is offset from said air outlet.

Optionally, a snorkel extends from said air outlet towards said roof, thereby maximizing an effective ink-collecting volume of said air chamber.

Optionally, said air chamber has an air vent defined therein.

Optionally, said air chamber has one or more air vents defined therein, the number of air vents regulating a pressure in said bubble-bursting box when said air outlet is connected to a pump.

Optionally, said sensor is an optical sensor.

Optionally, said sensor provides a feedback signal for a pump pumping ink into said bubble-bursting box.

Optionally, sensor senses ink in only one of said bubble-bursting chambers.

Optionally, said one bubble-bursting chamber comprises a float ball chamber in fluid communication with a primary bubble-bursting chamber, said float ball chamber containing a float ball, and said sensor optically sensing when said float ball reaches a predetermined height.

In another aspect there is provided an ink supply system comprising the bubble-bursting box comprising:

one or more bubble-bursting chambers, each chamber having a respective chamber inlet for connection to an ink line; and an air outlet in fluid communication with each chamber; and a sensor positioned to sense ink above a bubble-bursting point in at least one of said bubble-bursting chambers, wherein said device is configured to minimize phantom sensing of ink caused by ink bubbles in said ink line.

In a sixth aspect the present invention provided a bubble-bursting box for bursting bubbles of a liquid entering said box, said box comprising:

one or more bubble-bursting chambers, each chamber having a respective chamber inlet for connection to liquid conduit, said chamber inlet being defined in a base of each chamber; and a common air chamber in fluid communication with each bubble-bursting chamber, said air chamber having an air outlet defined in a base thereof, a cover for said bubble-bursting chambers and said air chamber, said cover defining a roof of said box, said cover having one or more air channels defined therein, each air channel providing fluid communication between a respective bubble-bursting chamber and said common air chamber.

Optionally, said liquid is ink.

Optionally, said bubble-bursting box comprises a plurality of bubble-bursting chambers, each chamber corresponding to a respective ink channel of an ink supply system for a printer.

Optionally, each bubble-bursting chamber is dimensioned to promote expansion and bursting of liquid bubbles entering said chamber via said chamber inlet.

Optionally, each bubble-bursting chamber has curved sidewalls, wherein a curvature of said sidewalls is greater than a curvature of said liquid conduit.

Optionally, each bubble-bursting chamber is generally crescent-shaped, thereby maximizing said curvature in a minimal volume.

Optionally, each air channel is a serpentine channel for minimizing transfer of liquid to said air chamber when said box is tipped.

Optionally, each air channel is hydrophobic.

Optionally, each air channel comprises at least one liquid-trapping stomach.

Optionally, each air channel terminates at a channel outlet defined in a roof of said air chamber, each channel outlet being positioned to deposit liquid into said air chamber.

Optionally, each channel outlet is offset from said air outlet.

Optionally, a snorkel extends from said air outlet towards said roof, thereby maximizing an effective liquid-collecting volume of said air chamber.

Optionally, said air chamber has an air vent defined therein.

Optionally, said air chamber has one or more air vents defined therein, the number of air vents regulating a pressure in said bubble-bursting box when said air outlet is connected to a pump.

Optionally, one of said bubble-bursting chamber comprises a float ball chamber in fluid communication with a primary bubble-bursting chamber, said float ball chamber containing a float ball.

Optionally, at least one of said bubble-bursting chambers is configured for use with an optical sensor, said optical sensor sensing a level of liquid in said at least one chamber.

Optionally, said at least one bubble-bursting chamber is transparent.

In a further aspect the present invention provided a liquid sensing device comprising:

(A) a bubble-bursting box comprising:

one or more bubble-bursting chambers, each chamber having a respective chamber inlet in a base thereof for connection to liquid conduit; and a common air chamber in fluid communication with each bubble-bursting chamber, said air chamber having an air outlet defined in a base thereof, and a cover for said bubble-bursting chambers and said air chamber, said cover defining a roof of said box, said cover having one or more air channels defined therein, each air channel providing fluid communication between a respective bubble-bursting chamber and said common air chamber; and (B) an optical sensor positioned to sense liquid above a bubble-bursting point in at least one of said bubble-bursting chambers.

Optionally, said device is configured to minimize phantom sensing of liquid caused by liquid bubbles in said liquid conduit.

Optionally, said box is transparent.

In a seventh aspect the present invention provided a printhead depriming system, said system comprising:

an ink reservoir;

an ink chamber positioned below said ink reservoir, said ink chamber comprising an outlet port connected to an ink inlet of said printhead via an upstream ink line, an inlet port connected to said ink reservoir, and a float valve configured for closing said inlet port; and an air pump communicating with a headspace above said ink in said ink chamber, such that actuation of said air pump generates a negative pressure in said headspace and draws ink from said printhead into said ink chamber so as to de-prime said printhead, wherein an increased level of ink in said ink chamber during said de-priming causes concomitant shutting of said float valve and isolates said ink reservoir from said printhead.

Optionally, said printhead is positioned above said ink chamber.

In another aspect the depriming system further comprising a downstream ink line connected to an ink outlet of said printhead, wherein ink is drawn from said downstream ink line, through said printhead and towards said ink chamber during said de-priming.

Optionally, said downstream ink line is in fluid communication with said air pump, thereby enabling both pushing and pulling of ink through said printhead during said depriming.

Optionally, said pump is reversible for effecting both depriming and priming operations.

Optionally, a check valve is positioned between said ink reservoir and said ink chamber for isolating said ink reservoir from said printhead during a priming operation.

Optionally, said float valve comprises:

an arm pivotally mounted about a pivot;

a float mounted at one end of said arm; and a valve head mounted at an opposite end of said arm, wherein said valve head is positioned for sealing engagement with a valve seat at said inlet port.

Optionally, said ink chamber is a pressure-regulating chamber for regulating a hydrostatic pressure of ink supplied to said printhead during normal printing.

Optionally, is configured for use with a replaceable page-width printhead.

Optionally, said printhead comprises one or more printhead integrated circuits mounted on an ink distribution manifold, each printhead integrated circuit comprising a plurality of nozzles, and said manifold having said ink inlet and an ink outlet.

In another aspect the present invention provided a printer comprising:

an inkjet printhead having an ink inlet and a plurality of nozzles; and a printhead depriming system, said depriming system comprising:

an ink reservoir;

an ink chamber positioned below said ink reservoir, said ink chamber comprising an outlet port connected to said ink inlet via an upstream ink line, an inlet port connected to said ink reservoir, and a float valve configured for closing said inlet port; and an air pump communicating with a headspace above said ink in said ink chamber, such that actuation of said air pump generates a negative pressure in said headspace and draws ink from said printhead into said ink chamber so as to de-prime said printhead, wherein an increased level of ink in said ink chamber during said de-priming causes concomitant shutting of said float valve and isolates said ink reservoir from said printhead.

Optionally, said printhead is positioned above said ink chamber.

In a further aspect the printer further comprising a downstream ink line connected to an ink outlet of said printhead, wherein ink is drawn from said downstream ink line, through said printhead and towards said ink chamber during said de-priming.

Optionally, said downstream ink line is in fluid communication with said air pump, thereby enabling both pushing and pulling of ink through said printhead during said depriming.

Optionally, said pump is reversible for effecting both depriming and priming operations.

Optionally, a check valve is positioned between said ink reservoir and said ink chamber for isolating said ink reservoir from said printhead during a priming operation.

Optionally, said float valve comprises:

an arm pivotally mounted about a pivot;

a float mounted at one end of said arm; and a valve head mounted at an opposite end of said arm, wherein said valve head is positioned for sealing engagement with a valve seat at said inlet port.

Optionally, said ink chamber is a pressure-regulating chamber for regulating a hydrostatic pressure of ink supplied to said printhead during normal printing.

Optionally, said printhead is a replaceable pagewidth printhead.

Optionally, said printhead comprises one or more printhead integrated circuits mounted on an ink distribution manifold, each printhead integrated circuit comprising a plurality of nozzles, and said manifold having said ink inlet and an ink outlet connected to a downstream ink line.

In an eighth aspect the present invention provides a printer comprising:

an inkjet printhead having an ink inlet, an ink outlet and a plurality of nozzles;

an ink chamber having an outlet port;

an upstream ink line providing fluid communication between said outlet port and said ink inlet;

a reversible air pump having a pump outlet communicating with a headspace in said ink chamber, said pump being configured to positively pressurize said headspace during a printhead priming operation or negatively pressurize said headspace during a printhead depriming operation; and a downstream ink line connected to said ink outlet, said downstream ink line being in fluid communication with a pump inlet so as to effect cooperative pulling and pushing of ink through said printhead during said priming and depriming operations.

In a further aspect there is provided a printer further comprising an ink reservoir positioned above said ink chamber and in fluid communication with an inlet port of said ink chamber.

Optionally, said ink reservoir is isolable from said ink chamber during both priming and depriming operations.

Optionally, said ink reservoir comprises a check valve configured to isolate said ink reservoir from said ink chamber when said headspace is positively pressurized during said printhead priming operation.

Optionally, said ink chamber comprises a float valve configured to isolate said ink reservoir from said ink chamber when said headspace is negatively pressurized during said printhead depriming operation.

Optionally, said float valve comprises:

an arm pivotally mounted about a pivot;

a float mounted at one end of said arm; and a valve head mounted at an opposite end of said arm, wherein said valve head is positioned for sealing engagement with a valve seat at said inlet port.

Optionally, said ink chamber is a pressure-regulating chamber for regulating a hydrostatic pressure of ink supplied to said printhead during normal printing.

Optionally, said pressure-regulating chamber is positioned below said printhead so as to provide a negative hydrostatic pressure.

Optionally, said printhead is a replaceable pagewidth printhead.

Optionally, said printhead comprises one or more printhead integrated circuits mounted on an ink distribution manifold, each printhead integrated circuit comprising a plurality of nozzles, and said manifold having said ink inlet and said ink outlet.

In a further aspect there is provided a printer further comprising means for controlling a flow of ink from said downstream ink line back into said ink chamber when said printhead is primed.

Optionally, said means is selected from the group comprising:

an electronically-controlled valve;

a check-valve; and a loop section passing below said level of ink in said chamber.

In a further aspect there is provided a printer further comprising a sensor positioned for sensing ink in said downstream ink line, said sensor cooperating with said pump such that said pump is shut off when said sensor senses any ink.

Optionally, said sensor comprises an optical sensor.

In a further aspect there is provided a printer further comprising means for minimizing phantom sensing of ink caused by ink bubbles in said downstream ink line.

In another aspect there is provided a printer comprising a bubble-bursting box, said box comprising:

one or more bubble-bursting chambers having a respective chamber inlet connected to said downstream ink line; and an air outlet in fluid communication with said pump inlet.

Optionally, said sensor is positioned to sense ink above a bubble-bursting point in at least one of said bubble-bursting chambers.

Optionally, said bubble-bursting box comprises a plurality of bubble-bursting chambers, each chamber corresponding to a respective ink channel of said ink supply system.

Optionally, each bubble-bursting chamber is dimensioned to promote expansion and bursting of ink bubbles entering said chamber via said chamber inlet.

Optionally, said bubble-bursting box comprises a common air chamber in fluid communication with said bubble-bursting chambers via an air channel defined in a roof of said box, said air outlet being defined in a base of said air chamber.

In a ninth aspect the present invention provided a method of priming a printhead whilst minimizing nozzle drooling, said method comprising the steps of:

(i) providing a printhead comprising:

an ink distribution manifold having an ink inlet and an ink outlet; and one or more printhead integrated circuits mounted on said manifold, each printhead integrated circuit comprising a plurality of nozzles;

(ii) providing an ink chamber in fluid communication with said ink inlet; and (iii) applying a positive pressure at said ink inlet whilst simultaneously applying a negative pressure at said ink outlet so as to draw ink through said manifold and prime said printhead whilst minimizing nozzle drooling.

Optionally, said printhead is a pagewidth inkjet printhead.

Optionally, said positive pressure is applied by positively pressurizing a headspace above ink in said ink chamber.

Optionally, said positive pressure is applied using a pump having a pump outlet communicating with said headspace.

Optionally, a pump inlet communicates with said ink outlet so as to apply said negative pressure at said ink outlet.

Optionally, a downstream ink line is connected to said ink outlet, and said method further comprises the steps of:

monitoring for the presence of ink in said downstream ink line; and shutting off said pump when ink is sensed in said downstream ink line.

Optionally, an optical sensor is provided for sensing said ink in said downstream ink line.

Optionally, phantom sensing of ink caused by ink bubbles in said downstream ink line is minimized.

Optionally, phantom sensing of ink is minimized by sensing for ink above a bubble-bursting point in a bubble-bursting chamber provided in said downstream ink line.

Optionally, said bubble-bursting chamber is in fluid communication with an air outlet, said air outlet being in fluid communication with a pump inlet.

In a tenth aspect the present invention provides a method of priming one or more printhead integrated circuits, said method comprising the steps of:

(i) providing a printhead assembly comprising:

an ink distribution manifold having an ink inlet and an ink outlet;

one or more printhead integrated circuits mounted on said manifold, each printhead integrated circuit comprising a plurality of nozzles;

an upstream ink line connected to said ink inlet; and a downstream ink line connected to said ink outlet, wherein at least part of said printhead assembly contains ink bubbles;

(ii) providing an ink chamber in fluid communication with said ink inlet via said upstream ink line;

(iii) priming said printhead integrated circuits by drawing ink from said ink chamber, through said manifold and into said downstream ink line using a pump;

(iv) bursting ink bubbles in said downstream ink line;

(v) sensing for ink downstream of a bubble-bursting point in said downstream ink line; and (v) shutting off said pump when said ink is sensed.

Optionally, said printhead is a pagewidth inkjet printhead.

Optionally, said priming is performed by positively pressurizing a headspace above ink in said ink chamber.

Optionally, a pump outlet of said pump communicates with said headspace.

Optionally, a pump inlet communicates with said ink outlet so as to apply negative pressure simultaneously at said ink outlet.

Optionally, a loop in said downstream ink conduit prevents ink from flowing back into said ink chamber when said pump is shut off, said loop passing below a level of ink in said ink chamber.

Optionally, a valve in said downstream ink conduit prevents ink from flowing back into said ink chamber when said pump is shut off Optionally, said bubbles are burst by expansion of said bubbles.

Optionally, said bubbles are burst using a bubble-bursting box provided in said downstream ink line, said bubble-bursting box comprising:

a bubble-bursting chamber having a respective chamber inlet defined in a base thereof, said chamber inlet being connected to a downstream ink conduit; and an air outlet in fluid communication said chamber.

Optionally, an optical sensor is positioned above a bubble-bursting point in said bubble-bursting chamber.

Optionally, said bubble-bursting chamber is dimensioned to promote expansion and bursting of ink bubbles entering said chamber via said chamber inlet.

Optionally, each bubble-bursting chamber has curved sidewalls, wherein a curvature of said sidewalls is greater than a curvature of said downstream ink conduit.

Optionally, each bubble-bursting chamber is generally crescent-shaped, thereby maximizing said curvature in a minimal volume.

Optionally, said bubble-bursting box comprises an air chamber in fluid communication with said bubble-bursting chamber, said air outlet being positioned in said air chamber.

Optionally, each bubble-bursting chamber communicates with said air chamber via a respective air channel defined in a roof of said box.

Optionally, each air channel is a hydrophobic serpentine channel for minimizing transfer of ink to said air chamber when said box is tipped.

Optionally, each air channel comprises at least one ink-trapping stomach.

Optionally, each air channel terminates at a channel outlet defined in a roof of said box, each channel outlet being positioned to deposit ink into said air chamber.

Optionally, said air outlet is defined in a base of said air chamber, and each channel outlet is offset from said air outlet.

In an eleventh aspect the present invention provides a method of replacing a printhead in an inkjet printer with minimal ink wastage, said method comprising the steps of:

(i) providing a printhead comprising:

an ink distribution manifold having an ink inlet and an ink outlet;

one or more printhead integrated circuits mounted on said manifold, each printhead integrated circuit comprising a plurality of nozzles;

(ii) providing an ink supply system comprising:

an ink chamber in fluid communication with said ink inlet via an upstream ink line;

a reversible air pump communicating with a headspace of said ink chamber; and a downstream ink line connected to said ink outlet;

(ii) actuating said pump so as to negatively pressurize said headspace, thereby depriming said printhead by drawing ink from said downstream ink line and said printhead into said ink chamber;

(iii) deactuating said pump and allowing an ink level in said ink chamber to equalize with an ink level in said upstream ink line;

(iv) removing said printhead from said printer, said removing including disconnecting said ink inlet and said ink outlet from respective upstream and downstream ink lines;

(v) replacing said printhead with a replacement printhead, said replacing including connecting an ink inlet and an outlet inlet of said replacement printhead with respective upstream and downstream ink lines;

(vi) actuating said pump so as to positively pressurize said headspace, thereby priming said printhead by drawing ink from said ink chamber, through said printhead and into said downstream ink line; and (vii) deactuating said pump and allowing an ink level in said ink chamber to equilibrate to a predetermined level.

Optionally, said ink chamber has sufficient capacity to accommodate ink drawn into said chamber during said depriming step.

Optionally, said downsteam ink line comprises a loop section passing below a level of ink in said ink chamber, wherein said predetermined ink level in said ink chamber equalizes with an ink level in said loop section after deactuation of said pump in step (vii).

Optionally, said downstream ink line comprises an inline electronically-operated valve.

In another aspect the method further comprising the steps of:

sensing ink in said downstream ink line using a sensor; and deactuating said pump in response to sensing ink in said downstream ink line.

Optionally, phantom sensing of ink caused by ink bubbles in said downstream ink line is minimized.

Optionally, phantom sensing of ink is minimized by sensing for ink above a bubble-bursting point in a bubble-bursting chamber provided in said downstream ink line.

Optionally, said ink chamber is a pressure-regulating chamber for controlling a hydrostatic pressure of ink supplied to said printhead during normal printing.

Optionally, said pressure-regulating chamber comprises a float valve for maintaining a predetermined level of ink in said chamber, said float valve controlling a supply of ink to said chamber by an ink reservoir in fluid communication therewith.

In another aspect there is provided a method further comprising the step of:

printing from said replacement printhead whilst controlling said hydrostatic pressure of ink using said pressure-regulating chamber.

Optionally, said float valve isolates said chamber from said ink reservoir during said depriming in step (ii).

Optionally, said ink reservoir comprises a check valve, said check valve isolating said chamber from said ink reservoir during said priming in step (vi).

In a twelfth aspect the present invention provides a printer comprising:

a printhead having an ink inlet and an ink outlet;

a pressure-regulating chamber having an outlet port connected to said ink inlet via an upstream ink conduit, said chamber containing ink at a first level below said printhead, wherein a headspace above said first level of ink is open to atmosphere; and a downstream ink conduit connected to said ink outlet and terminating above said first level of ink, said downstream ink conduit being open to atmosphere, wherein said downstream ink conduit comprises a loop section passing below said first level of ink, such that, in a printing configuration, a second level of ink in said loop is equal to said first level of ink in said chamber.

In a further aspect the printer comprising means for maintaining a predetermined first level of ink in said chamber, said predetermined first level of ink controlling a hydrostatic pressure of ink supplied to said ink inlet.

Optionally, said hydrostatic pressure, relative to atmospheric pressure, is defined as $\rho gh$, wherein $\rho$ is the density of ink, g is acceleration due to gravity and h is the height of the predetermined first level of ink relative to the printhead.

Optionally, said means for maintaining said predetermined first level of ink comprises an ink reservoir cooperating with a float valve contained in said pressure-regulating chamber.

Optionally, said float valve comprises:

an arm pivotally mounted about a pivot;

a float mounted at one end of said arm; and a valve head mounted at an opposite end of said arm, wherein said valve head is positioned for sealing engagement with a valve seat at an inlet port of said pressure-regulating chamber.

Optionally, said inlet port and said outlet port of said pressure-regulating chamber are positioned towards a base of said chamber.

In a further aspect the printer further comprising a printhead priming system.

In another aspect the printer comprising:

an air pump communicating with said headspace above said ink in said chamber; and a valve positioned between said ink reservoir and said inlet port, wherein, in a priming configuration, said valve is configured to be shut and said pump is configured to positively pressurize said headspace thereby forcing ink from said chamber into said downstream ink conduit.

Optionally, a sensor is positioned for sensing ink towards a terminus of said downstream ink conduit, said sensor cooperating with said pump such that said pump is shut off when said sensor senses any ink.

Optionally, said loop section controls an amount of ink flowing from said downstream ink line back into said pressure-regulating chamber so as to restore said printing configuration after priming.

Optionally, said sensor is an optical sensor.

In another aspect the printer further comprising means for minimizing phantom sensing of ink caused by ink bubbles in said downstream ink line.

In a further aspect the printer comprising a bubble-bursting box, said box comprising:

at least one bubble-bursting chamber having a respective chamber inlet; and an air outlet.

Optionally, said air outlet is open to atmosphere or said air outlet communicates with a pump inlet of said air pump.

Optionally, said at least one bubble-bursting chamber is dimensioned to promote expansion and bursting of ink bubbles entering said chamber via said chamber inlet.

Optionally, said bubble-bursting box comprises a plurality of bubble-bursting chambers, each chamber corresponding to a respective ink channel of said printer.

Optionally, said bubble-bursting box comprises an air chamber in fluid communication with said at least one bubble-bursting chamber via an air channel defined in a roof of said box, said air outlet being defined in said air chamber.

Optionally, said air channel is a hydrophobic serpentine channel comprising at least one ink-trapping stomach, said air channel minimizing transfer of ink to said air chamber when said box is tipped.

Optionally, said pump is a reversible pump.

Optionally, in a de-priming configuration, said pump is reversed and ink is pulled from said printhead towards said pressure-regulating chamber.

In a thirteenth aspect the present invention provides a printer comprising:

an inkjet printhead having a plurality of ink inlets, a plurality of ink outlets and an array of nozzles;

a plurality of ink chambers, each ink chamber having an outlet port connected to a corresponding ink inlet via a respective upstream ink conduit;

a single air pump having a pump outlet communicating with a headspace in each ink chamber, said pump being configured to positively pressurize each headspace during a printhead priming operation; and a plurality of downstream ink conduits, each downstream ink conduit being connected to a corresponding ink outlet, and each downstream ink conduit communicating with a pump inlet of said pump.

In another aspect the printer further comprising means for inhibiting ink in said downstream ink conduits from reaching said pump inlet.

Optionally, said means includes an expansion box, said expansion box comprising:

a plurality of expansion chambers, each expansion chamber having a respective chamber inlet defined in a base thereof, each chamber inlet being connected to a respective downstream ink conduit;

a common air chamber having an air outlet defined in a base thereof, said air outlet being connected to said pump inlet via a pump inlet conduit; and a cover for said expansion chambers and said common air chamber, said cover defining a roof of said box, said cover having a plurality of air channels defined therein, each air channel providing fluid communication between a respective expansion chamber and said common air chamber.

Optionally, each air channel is a serpentine channel for minimizing transfer of ink from said expansion chambers to said common air chamber.

Optionally, each air channel is hydrophobic.

Optionally, each air channel comprises at least one ink-trapping stomach.

Optionally, each air channel terminates at a channel outlet defined in a roof of said air chamber, each channel outlet being positioned to deposit ink into said air chamber.

Optionally, each channel outlet is offset from said air outlet.

Optionally, a snorkel extends from said air outlet towards said roof, thereby maximizing an effective ink-collecting volume of said air chamber.

Optionally, said air chamber has an air vent defined therein.

Optionally, said air chamber has one or more air vents defined therein, the number of air vents regulating a pressure in said ink expansion box.

Optionally, said means further comprises a timing circuit for controlling operation of said pump during printhead priming.

Optionally, said means further comprises an ink sensor for sensing ink in at least one of said expansion chambers, said sensor cooperating with said pump such that said pump is shut off when said sensor senses ink.

Optionally, said expansion chambers are configured to promote expansion and bursting of ink bubbles entering said chambers via said chamber inlets, thereby minimizing phantom sensing of ink in said at least one chamber.

Optionally, said air pump is reversible for effecting both priming and depriming operations.

In another aspect there is provided a printer further comprising a conduit junction, said conduit junction comprising:

a plurality of junction outlets, each junction outlet being connected to a headspace port of each ink chamber;

a junction inlet connected to said pump outlet.

Optionally, said conduit junction comprises an air vent such that each headspace is open to atmosphere.

Optionally, said downstream ink conduit comprises any one of:

an inline electronically-controlled valve; and a loop section passing below a level of ink in said ink chamber.

Optionally, said ink chamber maintains a predetermined level of ink when said pump is switched off.

Optionally, said ink chamber comprises a float valve cooperating with an ink reservoir for maintaining said predetermined level of ink.

In a fourteenth aspect the present invention provided a printer comprising:

an inkjet printhead having an ink inlet, an ink outlet and an array of nozzles;

an ink chamber having an outlet port connected to said ink inlet via an upstream ink conduit;

an air pump having a pump outlet communicating with a headspace in said ink chamber, said pump being configured to positively pressurize said headspace during a printhead priming operation; and a downstream ink conduit connected to said ink outlet, said downstream ink conduit communicating with a pump inlet of said pump, wherein said downstream ink conduit includes an expansion chamber for accommodating a volume of ink, thereby inhibiting said ink from reaching said pump inlet.

Optionally, said expansion chamber is in fluid communication with an air chamber, said air chamber having an air outlet connected to said pump inlet.

Optionally, said expansion chamber is part of an expansion box, said expansion box comprising:

at least one expansion chamber, said expansion chamber having a respective chamber inlet defined in a base thereof, said chamber inlet being connected to said downstream ink conduit;

a common air chamber having an air outlet defined in a base thereof, said air outlet being connected to said pump inlet via a pump inlet conduit; and a cover for said expansion chamber and said common air chamber, said cover defining a roof of said box, said cover having at least one air channel defined therein, said air channel providing fluid communication between said at least one expansion chamber and said common air chamber.

Optionally, said air channel is a serpentine channel for minimizing transfer of ink from said expansion chamber to said common air chamber.

Optionally, said air channel is hydrophobic.

Optionally, said air channel comprises at least one ink-trapping stomach.

Optionally, said air channel terminates at a channel outlet defined in a roof of said air chamber, said channel outlet being positioned to deposit ink into said air chamber.

Optionally, said channel outlet is offset from said air outlet.

Optionally, a snorkel extends from said air outlet towards said roof, thereby maximizing an effective ink-collecting volume of said air chamber.

Optionally, said air chamber has an air vent defined therein.

Optionally, said air chamber has one or more air vents defined therein, the number of air vents regulating a pressure in said expansion box.

In a further aspect there is provided a printer comprising a timing circuit for controlling operation of said pump during printhead priming.

In another aspect there is provided a printer comprising an ink sensor for sensing ink in said expansion chamber, said sensor cooperating with said pump such that said pump is shut off when said sensor senses ink.

Optionally, said expansion chamber is configured to promote expansion and bursting of ink bubbles entering said chamber, thereby minimizing phantom sensing of ink in said chamber.

Optionally, said air pump is reversible for effecting both priming and depriming operations.

In a further aspect there is provided a printer further comprising a conduit junction, said conduit junction comprising:

a plurality of junction outlets, each junction outlet being connected to a headspace port of each ink chamber;

a junction inlet connected to said pump outlet.

Optionally, said conduit junction comprises an air vent such that each headspace is open to atmosphere.

Optionally, said downstream ink conduit comprises any one of:

an inline electronically-controlled valve; and a loop section passing below a level of ink in said ink chamber.

Optionally, said ink chamber maintains a predetermined level of ink when said pump is switched off.

Optionally, said ink chamber comprises a float valve cooperating with an ink reservoir for maintaining said predetermined level of ink.

In a fifteenth aspect the present invention provided a method of priming one or more inkjet printheads, said method comprising the steps of:

(i) providing a printhead assembly comprising:

an ink distribution manifold having an ink inlet and an ink outlet;

one or more inkjet printheads mounted on said manifold, each inkjet printhead comprising an array of nozzles;

an upstream ink line connected to said ink inlet; and a downstream ink line connected to said ink outlet;

(ii) providing an ink chamber in fluid communication with said ink inlet via said upstream ink line;

(iii) providing an air pump having a pump outlet in fluid communication with a headspace of said ink chamber, and a pump inlet in fluid communication with said downstream ink line;

(iii) actuating said air pump so as to draw ink from said ink chamber, through said manifold and into said downstream ink line, thereby priming said inkjet printheads;

(iv) receiving said ink in an expansion chamber in said downstream ink line; and (v) deactuating said pump.

Optionally, said downsteam ink line comprises a loop section passing below a level of ink in said ink chamber, wherein an ink level in said loop section equalizes with an ink level in said ink chamber after deactuation of said pump in step (v).

Optionally, said downstream ink line comprises an inline electronically-operated valve.

In another aspect the method further comprising the steps of:

sensing ink in said downstream ink line using a sensor; and deactuating said pump in response to sensing ink in said downstream ink line.

Optionally, phantom sensing of ink caused by ink bubbles in said downstream ink line is minimized.

Optionally, phantom sensing of ink is minimized by sensing for ink above a bubble-bursting point in a bubble-bursting chamber provided in said downstream ink line.

Optionally, said ink chamber is a pressure-regulating chamber for controlling a hydrostatic pressure of ink supplied to said printhead during normal printing.

Optionally, said pressure-regulating chamber comprises a float valve for maintaining a predetermined level of ink in said chamber, said float valve controlling a supply of ink to said chamber by an ink reservoir in fluid communication therewith.

In a further aspect there is provided a method further comprising the step of:

printing from said replacement printhead whilst controlling said hydrostatic pressure of ink using said pressure-regulating chamber.

Optionally, said ink reservoir comprises a check valve, said check valve isolating said ink chamber from said ink reservoir during said priming in step (iii).

Optionally, said expansion chamber is part of an expansion box, said expansion box comprising:

at least one expansion chamber, said expansion chamber having a respective chamber inlet defined in a base thereof, said chamber inlet being connected to said downstream ink conduit;

a common air chamber having an air outlet defined in a base thereof, said air outlet being connected to said pump inlet via a pump inlet conduit; and a cover for said expansion chamber and said common air chamber, said cover defining a roof of said box, said cover having at least one air channel defined therein, said air channel providing fluid communication between said at least one expansion chamber and said common air chamber.

DETAILED DESCRIPTION OF THE PREFERRED EMBODIMENTS

Print Engine and Printhead Cartridge Overview

Figure 1:
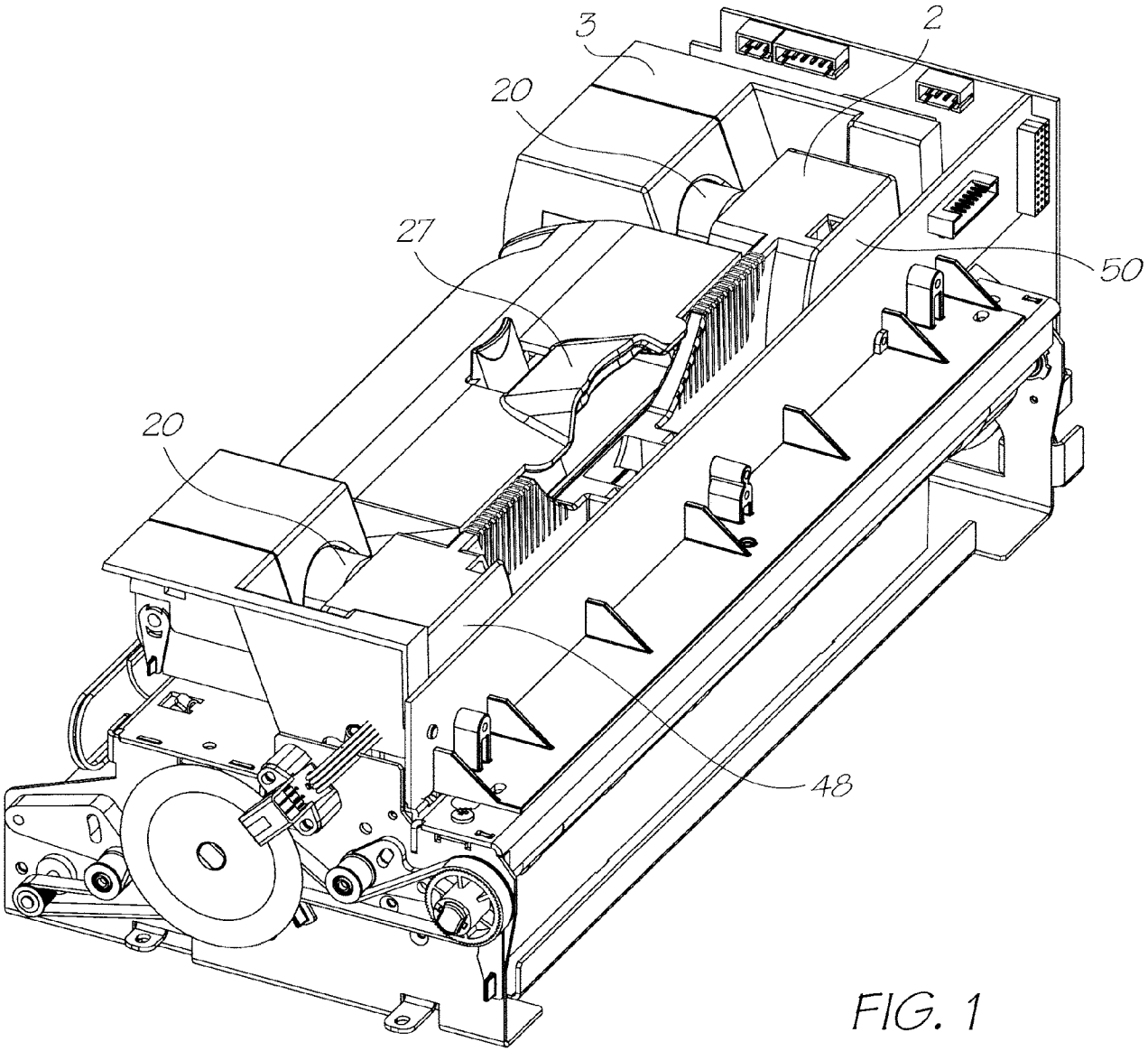
FIG. 1 shows a printhead cartridge installed in a print engine of a printer.
Figure 2:
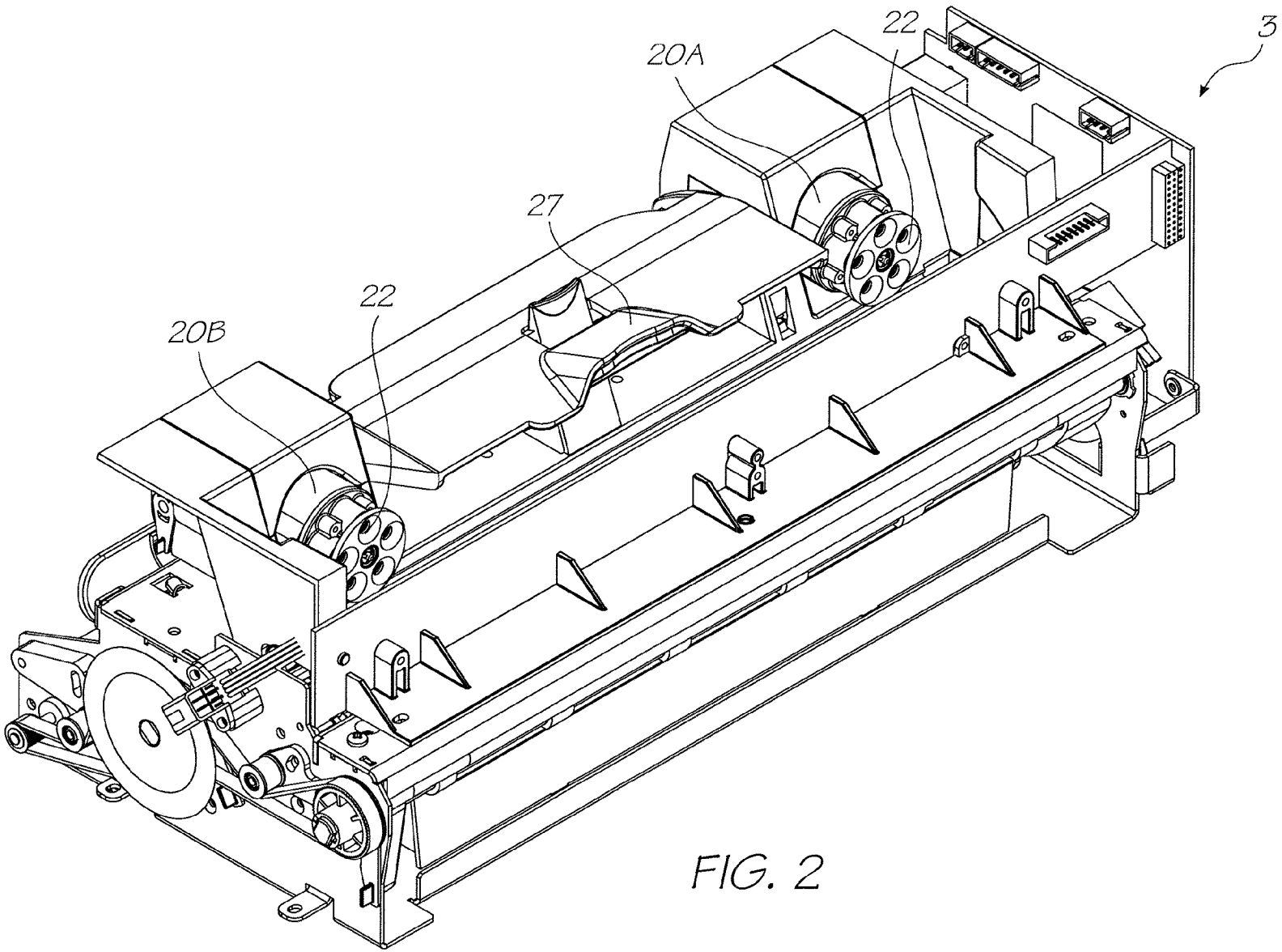
FIG. 2 shows the print engine without the printhead cartridge installed to expose inlet and outlet ink manifolds.

FIG. 1 shows a printhead cartridge 2 installed in a print engine 3. The print engine 3 is the mechanical heart of a printer which can have many different external casing shapes, ink tank locations and capacities, as well as media feed and collection trays. The printhead cartridge 2 can be inserted in and removed from the print engine 3 enabling periodic replacement. To remove the printhead cartridge 2, a user lifts a latch 27 and lifts the cartridge out from the print engine 3. FIG. 2 shows the print engine 3 with the printhead cartridge 2 removed.

When inserting the printhead cartridge 2 into the print engine 3, electrical and fluidic connections are made between the cartridge and the print engine. Contacts 33 on the printhead cartridge 2 (see FIG. 4) engage with complementary contacts (not shown) on the print engine 3. In addition, an ink inlet manifold 48 and an ink outlet manifold 50 on the printhead cartridge 2 mate with complementary sockets 20 on the print engine 3. The ink inlet manifold 48 provides a plurality of ink inlets for the printhead cartridge 2, each corresponding to a different color channel. Likewise, the ink outlet manifold 50 provides a plurality of ink outlets for the printhead cartridge 2, each corresponding to a different color channel. As will be explained in more detail below, the fluidics system of the present invention typically requires ink to flow through the printhead cartridge 2, from an ink inlet to an ink outlet, in order to achieve priming and depriming of the printhead.

Referring again to FIG. 2, with the printhead cartridge 2 removed, apertures 22 are revealed in each of the sockets 20. Each aperture 22 receives a complementary spout 52 and 54 on the inlet and outlet manifolds 48 and 50, respectively (see FIG. 5).

Figure 19:
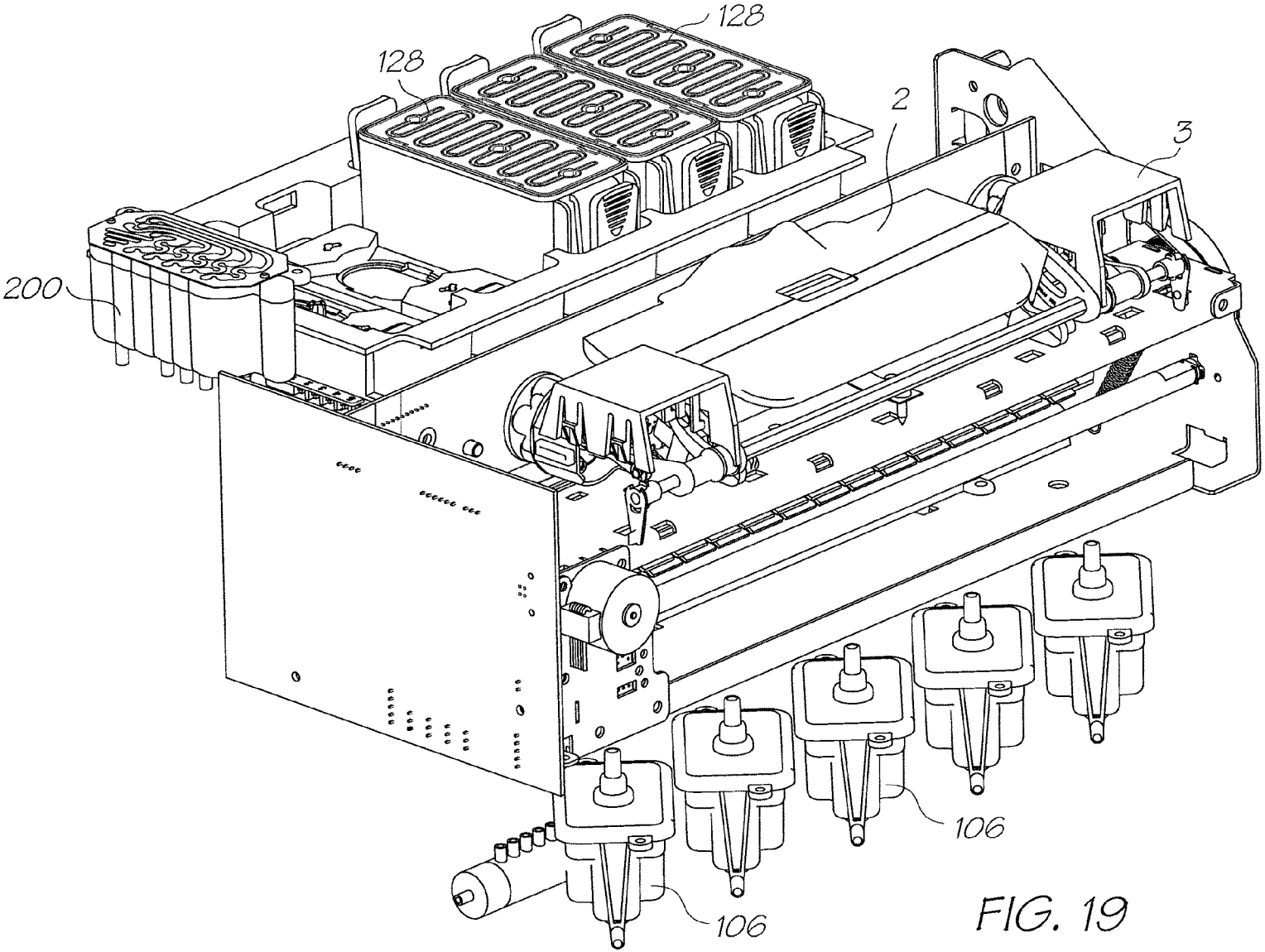
FIG. 19 is a perspective of the print engine shown in FIG. 1 with fluidics components.

Ink is supplied to a rear of an inlet socket 20B from pressure-regulating chambers 106, which are usually mounted towards a base of the print engine 3 (see FIG. 19). The pressure-regulating chambers receive ink by gravity from ink tanks 128 mounted elsewhere on the print engine 3.

Ink exits from a rear of an outlet socket 20A, which is connected via conduits to a bubble-bursting box (not shown in FIG. 2). Details of the fluidic system and its components will be described in greater detail below.

Figure 3:
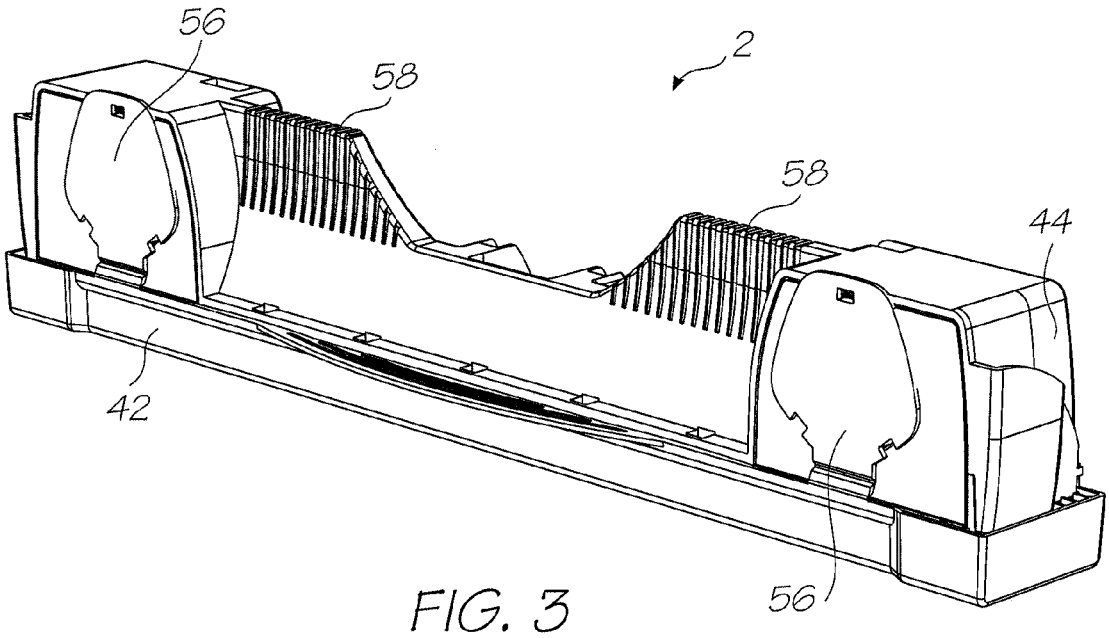
FIG. 3 is a perspective of the complete printhead cartridge.

FIG. 3 is a perspective of the complete printhead cartridge 2 removed from the print engine 3. The printhead cartridge 2 has a top molding 44 and a removable protective cover 42. The top molding 44 has a central web for structural stiffness and to provide textured grip surfaces 58 for manipulating the cartridge during insertion and removal. A base portion of the protective cover 42 protects printhead ICs 30 and the line of contacts 33 (see FIG. 4) prior to installation in the printer. Caps 56 are integrally formed with the base portion and cover ink inlet spouts 52 and outlet spouts 54 (see FIG. 5).

Figure 4:
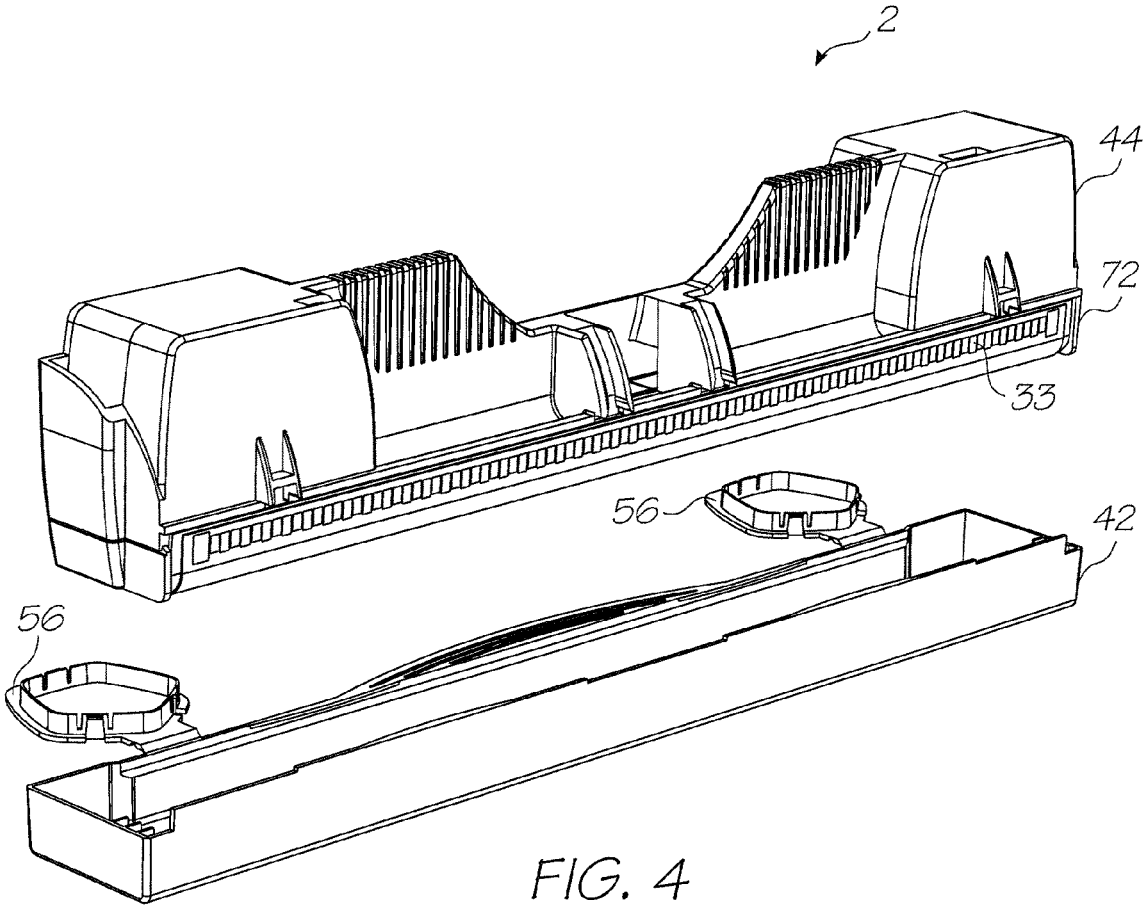
FIG. 4 shows the printhead cartridge of FIG. 3 with the protective cover removed.

FIG. 4 shows the printhead cartridge 2 with its protective cover 42 removed to expose printhead ICs (not shown in FIG. 4) on a bottom surface and the line of contacts 33 on a side surface of the printhead cartridge. The protective cover 42 may be either discarded or fitted to a printhead cartridge being replaced so as to contain any leakage from residual ink.

Figure 5:
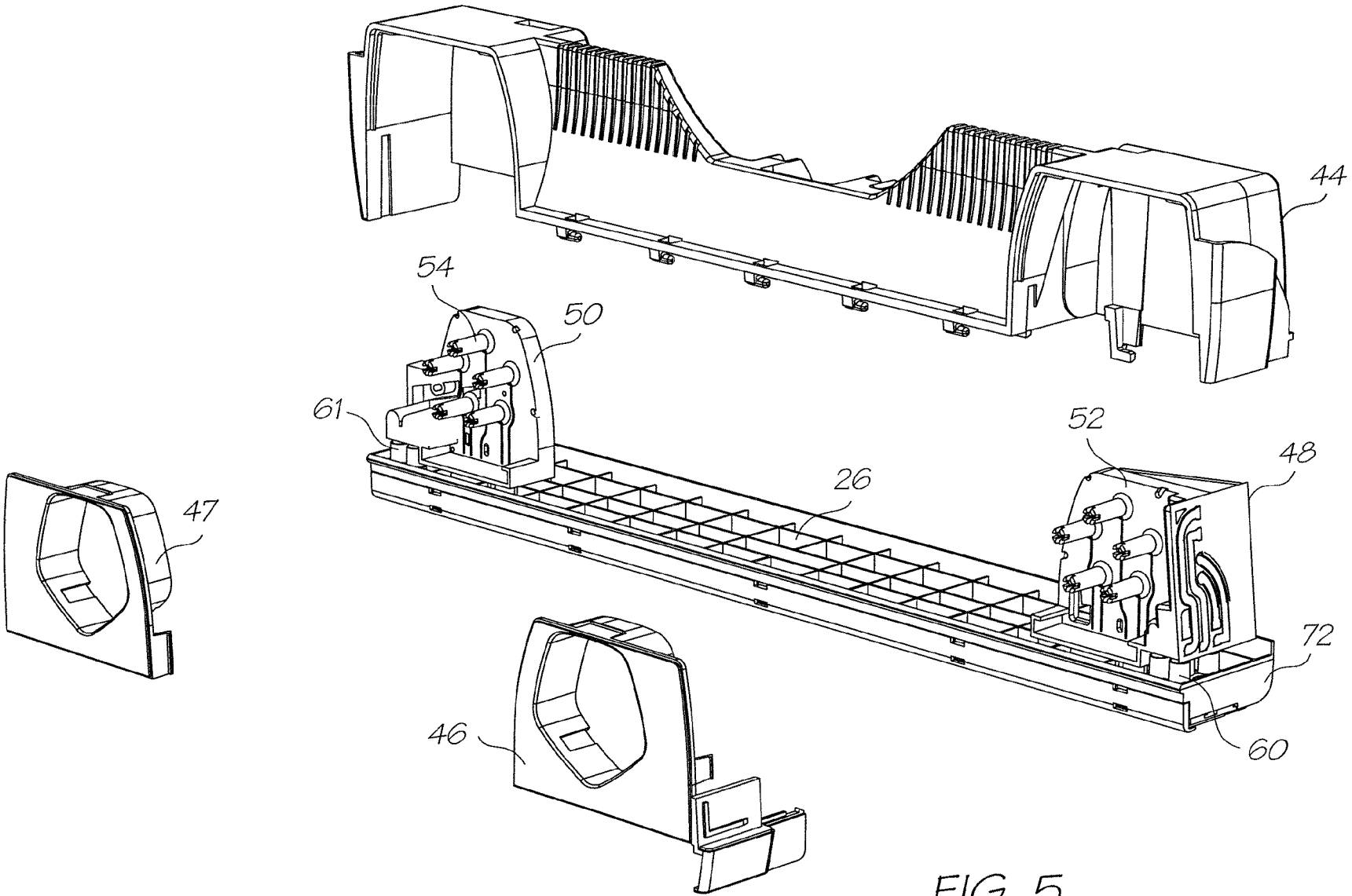
FIG. 5 is an exploded perspective of the printhead cartridge shown in FIG. 3.

FIG. 5 is partially exploded perspective of the printhead cartridge 2. The top cover molding 44 has been removed to reveal the inlet manifold 48 and the outlet manifold 50. Inlet and outlet shrouds 46 and 47 have also been removed to expose the five inlet spouts 52 and five outlet spouts 54. The inlet and outlet spouts 52 and 54 connect with corresponding ink inlets 60 and ink outlets 61 in an LCP cavity molding 72 attached to the inlet and outlet manifolds 48 and 50. The ink inlets 60 and ink outlets 61 are each in fluid communication with corresponding main channels 24 in an LCP channel molding 68 (see FIG. 6).

Figure 6:
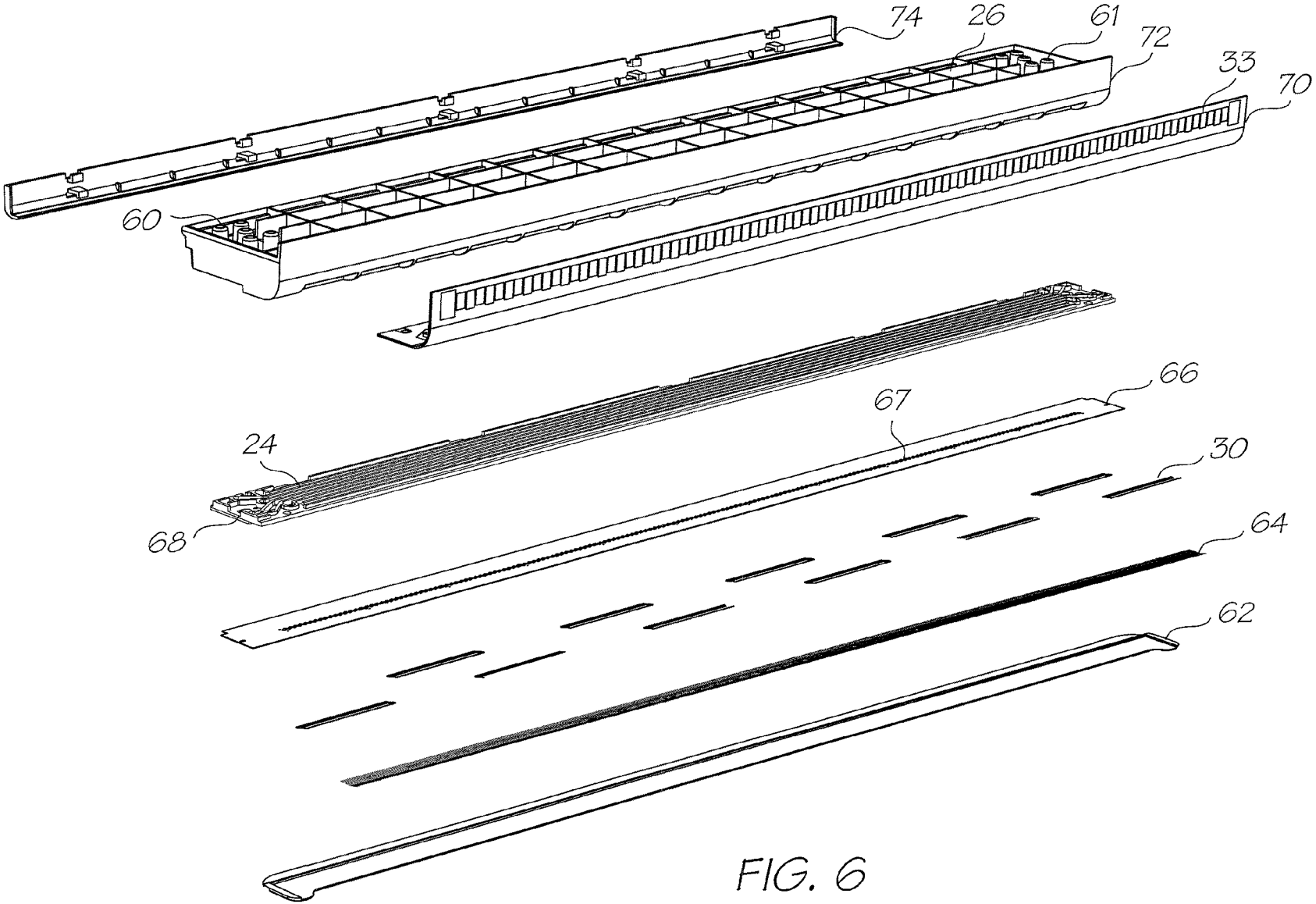
FIG. 6 is an exploded perspective of a printhead, which forms part of the printhead cartridge shown in FIG. 3.

Referring now to FIG. 6, the five main channels 24 extend the length of the LCP channel molding 68 and feed into a series of fine channels (not shown) on the underside of the LCP molding 68. The LCP cavity molding 72, having a plurality of air cavities 26 defined therein, mates with a topside of the LCP channel molding 68 such that the air cavities fluidically communicate with the main channels 24. The air cavities 26 serve to dampen shock waves or pressure pulses in ink being supplied along the main channels 24 by compressing air in the cavities.

A die attach film 66 has one surface bonded to an underside of the LCP channel molding 68 and an opposite surface bonded to a plurality of printhead ICs 30. A plurality of laser-ablated holes 67 in the film 66 provide fluidic communication between the printhead ICs 30 and the main channels 24. Further details of the arrangement of the printhead ICs 30, the film 66 and the LCP channel molding 68 can be found in the US Publication No. 2007/0206056, the contents of which is incorporated herein by reference. Further details of the inlet manifold 48 and outlet manifold 50 can be found in, for example, U.S. application Ser. No. 12/014,769 filed Jan. 16, 2008, the contents of which is incorporated herein by reference.

Electrical connections to the printhead ICs 30 are provided by a flex PCB 70 which wraps around the LCP moldings 72 and 68, and connects with wirebonds 64 extending from bond pads (not shown) on each printhead IC 30. The wirebonds 64 are protected with wirebond protector 62. As described above, the flex PCB 70 includes the contacts 33, which connect with complementary contacts in the print engine 3 when the printhead cartridge 2 is installed for use.

Fluidics System

From the foregoing, it will be appreciated that the printhead cartridge 2 has a plurality of ink inlets 60 and ink outlets 61, which can feed ink through main channels 24 in the LCP channel molding 68 to which printhead ICs 30 are attached. The fluidics system, which supplies ink to and from the printhead, will now be described in detail. For the avoidance of doubt, a "printhead" may comprise, for example, the LCP channel molding 68 together with the printhead ICs 30 attached thereto. Thus, any printhead assembly with at least one ink inlet and at least one ink outlet may be termed "printhead" herein.

Figure 7:
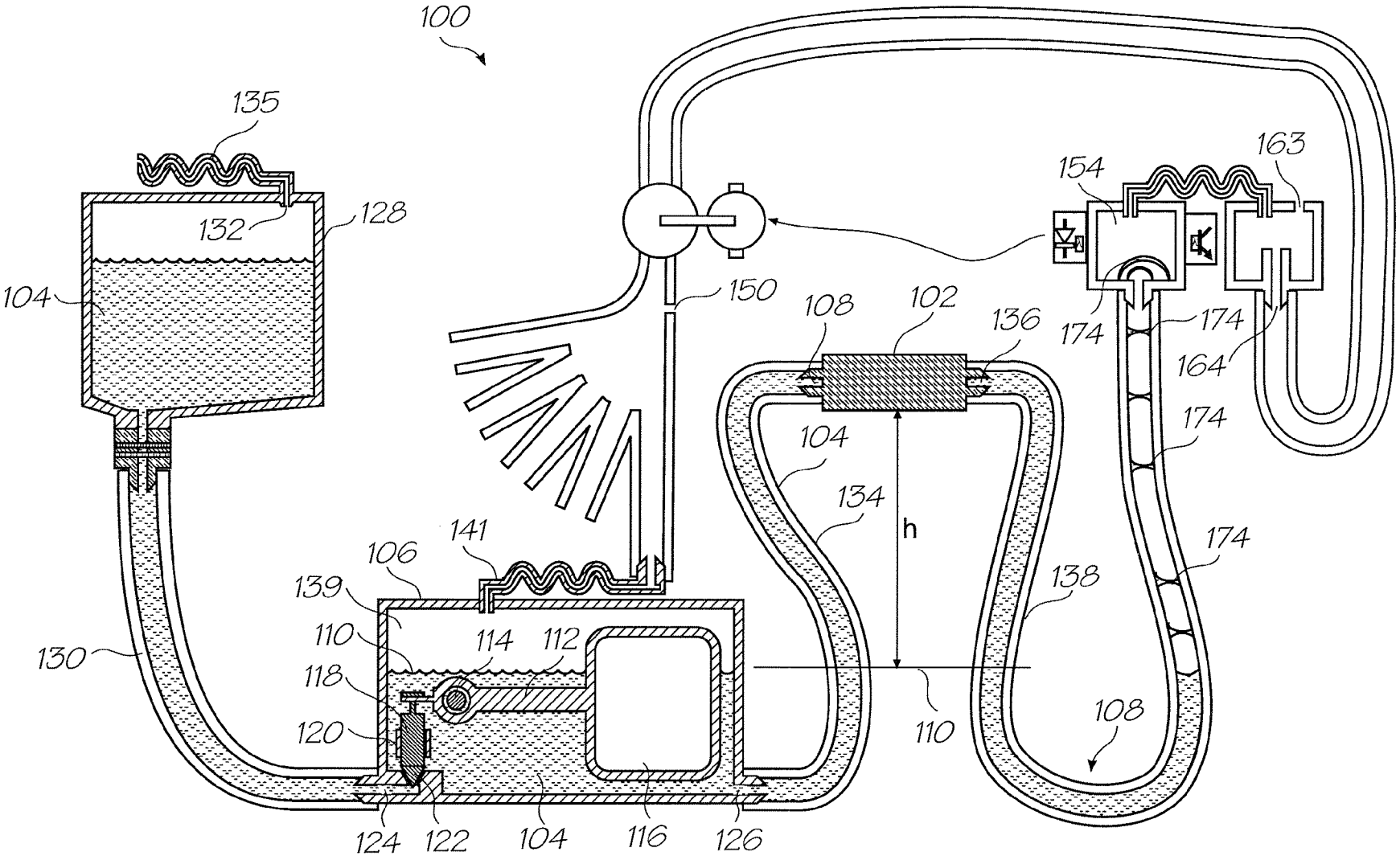
FIG. 7 is a schematic of the fluidics system according to the present invention, configured for normal printing.

Referring to FIG. 7, there is shown schematically a fluidic system 100 in accordance with the present invention. Relative positioning of each component of the system 100 will be described herein with reference to the schematic drawings. However, it will be appreciated that the exact positioning of each component in the print engine 3 will be a matter of design choice of the person skilled in the art.

Figure 20:
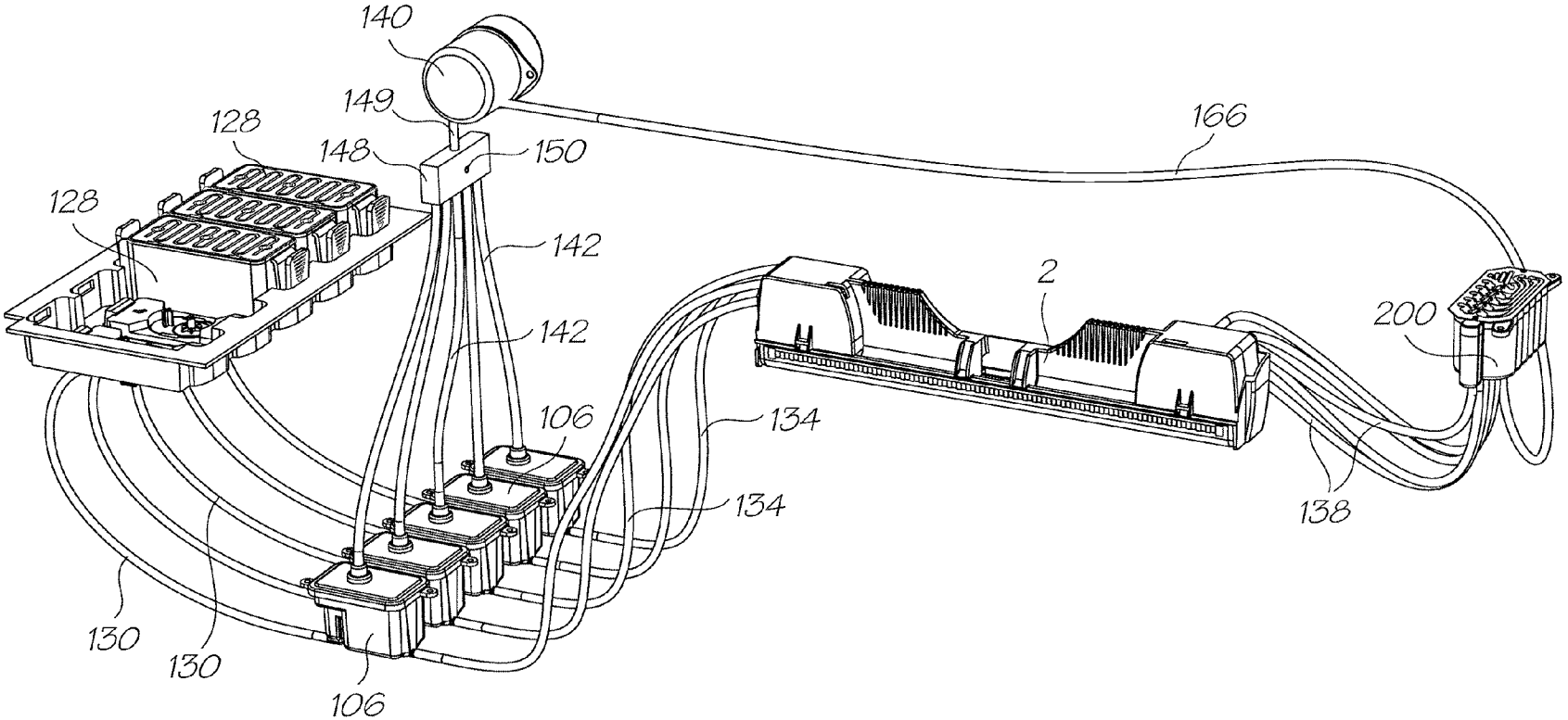
FIG. 20 shows fluidic connections for a five channel ink supply system according to the present invention.

For simplicity, the fluidics system 100 is shown for one color channel. Single color channel printheads are, of course, within the ambit of the present invention. However, the fluidics system 100 is more usually used in connection with a full color inkjet printhead having a plurality of color channels (e.g. five color channels as shown in FIGS. 5 and 6). Whilst the following discussion generally relates to one color channel, the skilled person will readily appreciate that multiple color channels may use corresponding fluidics systems. Indeed, a multi color channel fluidics system is shown in FIG. 20.

Normal Printing

As shown in FIG. 7, the system 100 is configured in a normal printing mode—that is, a printhead 102 is primed with ink and a hydrostatic pressure of ink 104 supplied to the printhead is regulated. Typically, during normal printing, it is necessary to maintain a constant hydrostatic ink pressure, which is negative relative to atmospheric pressure. A negative hydrostatic ink pressure is necessary to prevent printhead face flooding when printing ceases. Indeed, most commercially available inkjet printers operate at negative hydrostatic ink pressures, which is usually achieved through the use of a capillary foam in an ink tank.

In the fluidic system 100, a pressure-regulating chamber 106 supplies ink 104 to an ink inlet 108 of the printhead. The pressure-regulating chamber 106 is positioned below the printhead 102 and maintains a predetermined set level 110 of ink therein. The height of the printhead 102 above this set level 110 controls the hydrostatic pressure of ink 104 supplied to the printhead. The actual hydrostatic pressure is governed by the well-known equation: $p=\rho gh$, where p is the hydrostatic ink pressure, $\rho$ is the ink density, g is acceleration due to gravity and h is the height of the set level 110 of ink relative to the printhead 102. The printhead 102 is typically positioned at a height of about 10 to 300 mm above the set level 110 of ink, optionally about 50 to 200 mm, optionally about 80 to 150 mm, or optionally about 90 to 120 mm above the set level.

Gravity provides a very reliable and stable means for controlling the hydrostatic ink pressure. Provided that the set level 110 remains constant, then the hydrostatic ink pressure will also remain constant.

The pressure-regulating chamber 106 comprises a float valve for maintaining the set level 110 during normal printing. The float valve comprises an arm 112, which is pivotally mounted about a pivot 114. A float 116 is mounted at one end of the arm 112, and a valve head in the form of a poppet 118 is attached to an opposite end of the arm. The valve poppet 118 is slidably received in a valve guide 120 and sealingly engages with a valve seat 122 positioned in an inlet port 124 of the pressure-regulating chamber 106. The inlet port 124 is positioned towards a base of the chamber 106.

The set level 110 is determined by the buoyancy of the float 116 in the ink 104 (as well as the position of the chamber 106 relative to the printhead 102). The poppet valve 118 should seal against the seat 122 at the set level 110, but should unseal upon any downward movement of the float 116. Preferably, there should be minimum hysteresis in the float valve so as to minimize variations in hydrostatic pressure. The hysteresis of the float valve should preferably be about ±2 mm or less. Potential sources of hysteresis include pivot friction, valve guide friction, sticking between the compliant poppet valve and the valve seat, and looseness in the lever arm to poppet valve linkage.

From FIG. 7, it will be seen that as ink 104 is drawn from an outlet port 126 of the chamber 106 during normal printing, the float 116 incrementally moves downwards, which opens the inlet port 124 and allows ink to refill the chamber from an ink reservoir 128. In this way, the set level 110 is maintained and the hydrostatic ink pressure in the printhead 102 remains constant.

The float 116 preferably occupies most of the volume of the chamber 106 so as to provide maximum valve closure force. This closure force is amplified by the lever arm 112. However, the float 116 should be configured so that it does not touch sidewalls of the chamber 106 so as to avoid sticking.

Ink 104 is supplied to the pressure-regulating chamber 106 by the ink reservoir 128 positioned at any height above the set level 110. The ink reservoir 128 is typically a user-replaceable ink tank or ink cartridge, which connects with a supply conduit 130 when installed in the printer. The supply conduit 130 provides fluidic communication between the ink reservoir 128 and the inlet port 124 of the pressure-regulating chamber 106.

The ink reservoir 128 vents to atmosphere via a first air vent 132, which opens into a headspace of the ink reservoir. Accordingly, the ink 104 can simply drain into the pressure-regulating chamber 106 when the float valve opens the inlet port 124. The vent 132 comprises a hydrophobic serpentine channel 135, which minimizes ink losses through the vent when the ink cartridge is tipped. The vent 132 may also be protected by a one-time use sealing strip (not shown), which is removed prior to installation of an ink cartridge in the printer.

The printhead 102 has an ink inlet 108, which connects to the outlet port 126 via an upstream ink conduit 134. It will be understood that pressure-regulation as described above may be achieved with printheads having an ink inlet, but no ink outlet.

However, for the purposes of priming (described below), the printhead 102 shown in FIGS. 7 to 13 also has an ink outlet 136, which is connected to a downstream ink conduit 138. The downstream ink conduit 138 has a loop section 180, which loops below the set level 110 and then rises back up above the height of the set level and the printhead 102. Ink 104 in the upstream ink conduit 134 and pressure-regulating chamber 150 is open to atmosphere via a second air vent 150 in communication with the headspace 139. Likewise, ink in the downstream ink conduit 138 is open to atmosphere via a third air vent 163. The loop 180 in the downstream ink conduit 138 ensures that ink at the outlet 136 of the printhead 102 is at the same hydrostatic pressure as ink at the inlet 108. This is because ink in the downstream ink conduit 138 is held in the loop 180 at the set level 110 by virtue of both the upstream and downstream conduits being open to atmosphere, thereby allowing equilibration in the loop 180 to the set level.

Of course, the loop 180 may alternatively be replaced with, for example, an electronically-controlled valve (see valve 172 in FIG. 11), which can isolate the ink outlet 136 from atmosphere so that the printhead 106 effectively has no ink outlet during normal printing. However, the loop 180 provides a simple means of controlling hydrostatic pressure at the ink outlet 136 without the need for a complex electronically-operated valve.

Printhead Priming

Printhead priming requires ink 104 to be fed into the ink inlet 108 of the printhead 102 via an upstream ink conduit 134 interconnecting the ink inlet and the outlet port 126 of the pressure-regulating chamber 106. In order to provide optimum control of both priming and depriming, ink is fed through the printhead 102 and exits via the ink outlet 136 which is connected to the downstream ink conduit 138. Once the ink 104 is fed through the main channels 24 in the LCP channel molding 68, the printhead ICs 30 are primed by capillary action.

In principle, the ink 104 may be fed through the printhead 102 either by positively pressurizing an inlet side of the printhead, or by negatively pressurizing an outlet side of the printhead. However, a number of problems exist depending on whether the printhead to be primed is wet (e.g. containing ink bubbles) or dry. A dry pagewidth printhead primes adequately when about 1 kPa of positive pressure is applied to the ink inlet side of the printhead. At this priming pressure, no undesirable 'drooling' of ink from printhead nozzles is observed. However, if the printhead is wet and contains residual ink bubbles, then the requisite positive priming pressure increases to about 3 kPa. At this higher priming pressure, drooling of ink from nozzles is observed, which requires removal by printhead maintenance.

The drooling phenomenon in a wet printhead can be mitigated by priming using a negative pressure applied at the ink outlet 136. However, if a dry printhead is primed using a negative pressure, then excessive air ingestion through the printhead nozzles causes the ink to foam, which is also undesirable. Since wet and dry printhead have different optimum priming conditions, there is a need to provide a priming system which can adequately prime a printhead in either state.

Figure 8:
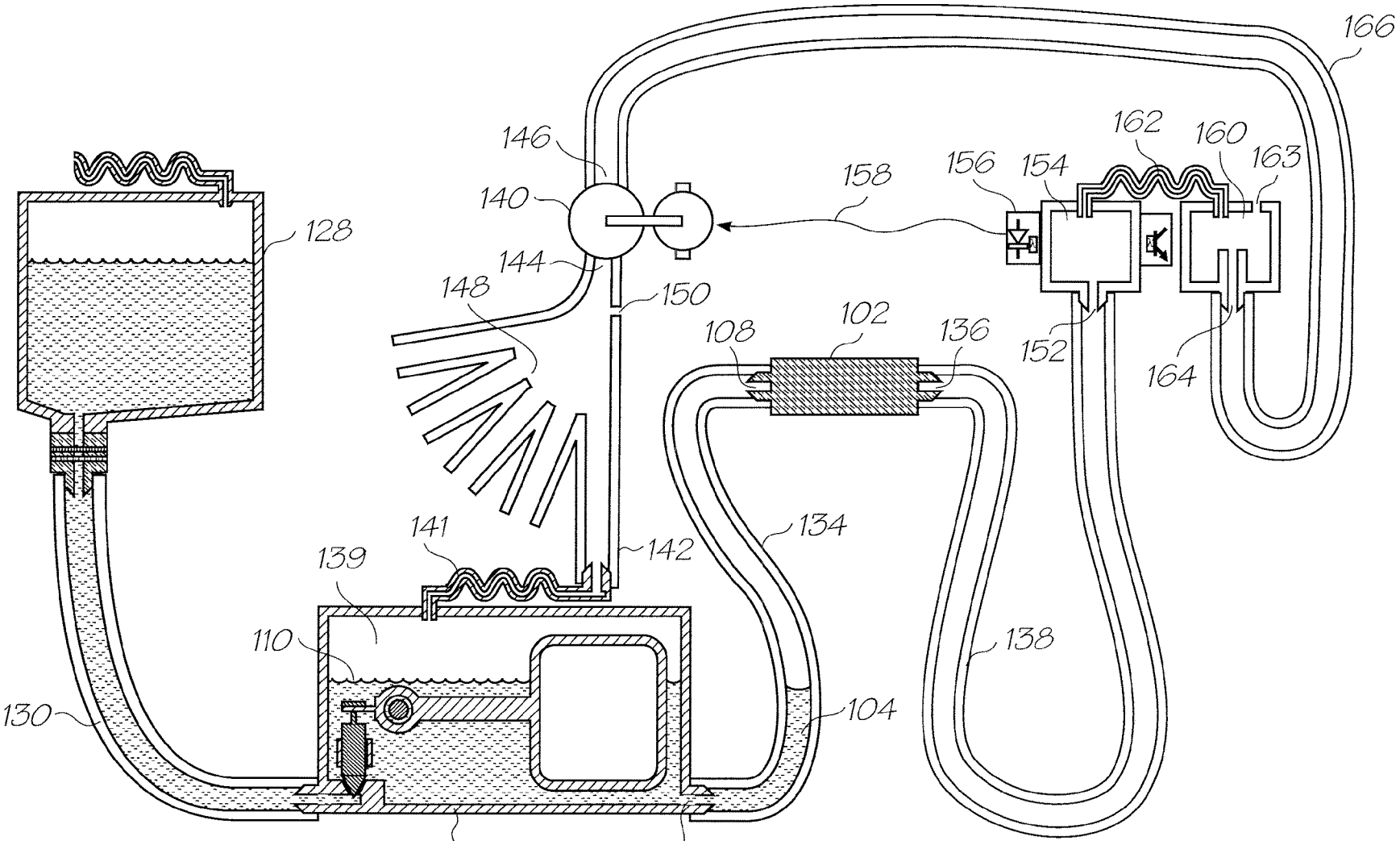
FIG. 8 shows the fluidics system of FIG. 7 in a configuration ready for printhead priming.

FIG. 8 shows the fluidics system 100 in a state ready for priming a dry, unprimed printhead 102. A priming sub-system of the fluidics system 100 will now be discussed in detail with reference to FIGS. 8 to 10. A headspace 139 of the pressure-regulating chamber 106 is in fluid communication with a reversible air pump 140 via a pump outlet conduit 142 interconnecting a headspace port 141 and a pump outlet 144. The pump 140 has an arbitrary pump outlet 144 and a pump inlet 146. Since the pump is reversible, the pump outlet 144 and inlet 146 may be reversed. However, for the sake of clarity, the system 100 is described with reference to the arbitrary pump outlet and inlet designations defined above.

The pump outlet conduit 142 comprises a conduit junction 148, which connects with corresponding pressure-regulating chambers 106 (each of which are, in turn, connected to a corresponding ink reservoir 128) for each color channel of the printhead 102. The conduit junction 148 thus enables a single air pump 140 to pressurize a plurality of chambers 106 in parallel so as to prime each color channel of the printhead 102 simultaneously using the same priming pressure.

The pump outlet conduit 142 has a second air vent 150, which equalizes the pressure inside the chamber 106 with atmospheric pressure when the pump 140 is switched off. At atmospheric pressure, the float valve is closed and ink 104 in the upstream ink conduit 134 equalizes with the set level of ink 104 in the chamber 106, as shown in FIG. 8.

On the outlet side of the printhead 102, the downstream ink conduit 138 loops below the set level 110 and connects with a chamber inlet 152 of a bubble-bursting chamber 154 positioned above the printhead 102. An optical sensor 156 is positioned adjacent the bubble-bursting chamber 154 for sensing ink in the chamber. The sensor 156 provides a feedback signal 158 to the pump 140 when ink 104 is sensed in the chamber 154. The bubble-bursting chamber 154 is in fluid communication with an air chamber 160 via an air channel 162. The air chamber 160 is vented to atmosphere via a third air vent 163. An air outlet 164 defined in a base of the air chamber 160 is in fluid communication with the pump inlet 146 via an interconnecting pump inlet conduit 166. Bubble-bursting chambers 154 (for each color channel of the printhead 102) and a common air chamber may be combined in one unit in the form of a bubble-bursting box. A detailed description of the bubble-bursting box is provided below, although the schematic depiction in FIGS. 8 to 10 is sufficient for the present purpose of describing printhead priming.

Thus, FIG. 8 shows the fluidics system prior to priming a dry printhead 102. Ink 104 in the upstream ink conduit has equalized with the ink 104 in the pressure-regulating chamber 106 by virtue of the second air vent 150 in fluid communication with the headspace 139. When the pump 140 is switched on (in a forward direction), air is pumped into the pressure-regulating chamber 106 and positively pressurizes the headspace 139. The use of an air pump to pressurize the headspace 140 means that priming (and depriming) can be achieved using a single low-cost, robust component. In contrast, inline peristaltic ink pumps are more costly and may be prone to failure.

Figure 9:
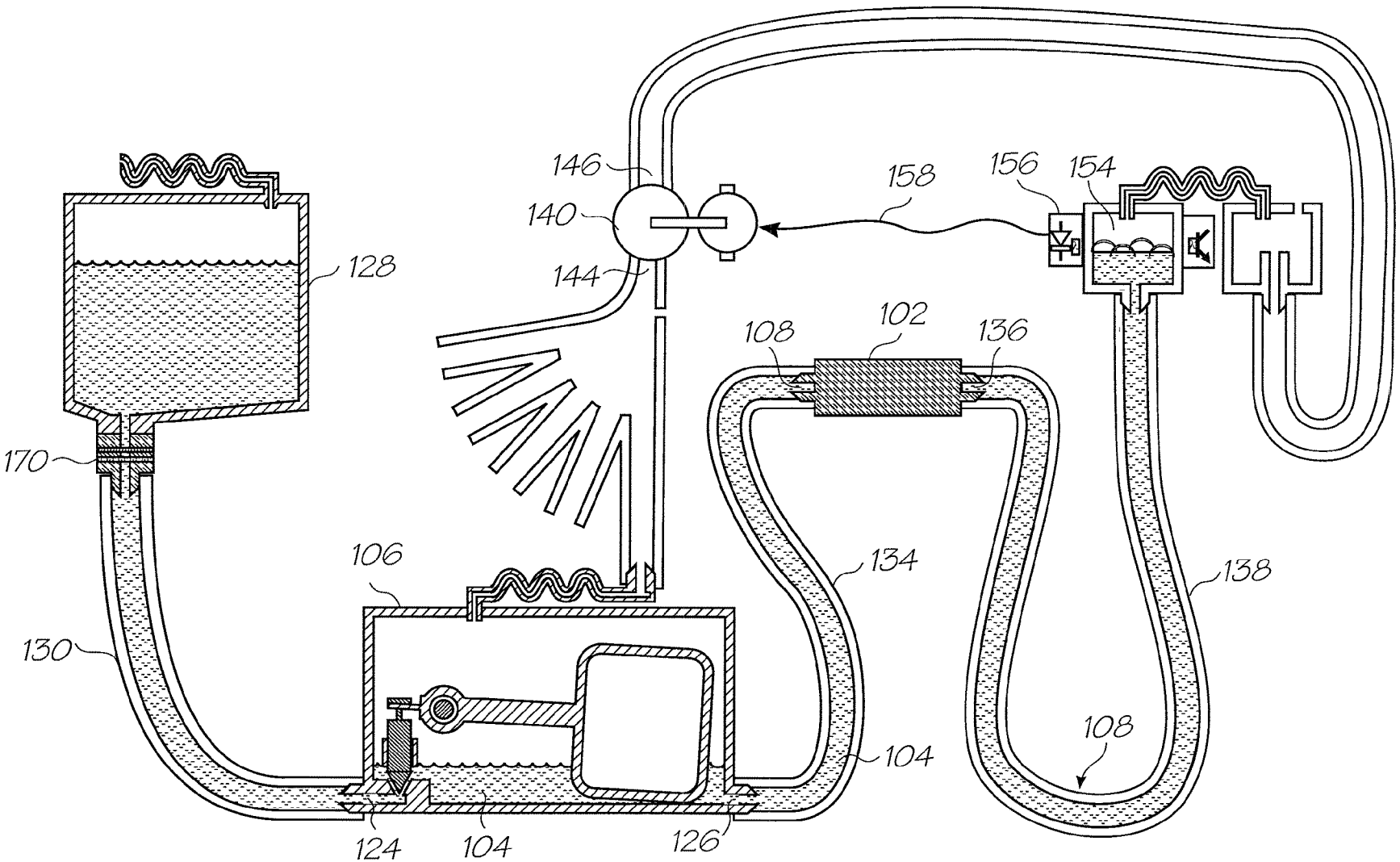
FIG. 9 shows the fluidics system of FIG. 7 configured for printhead priming.
Figure 10:
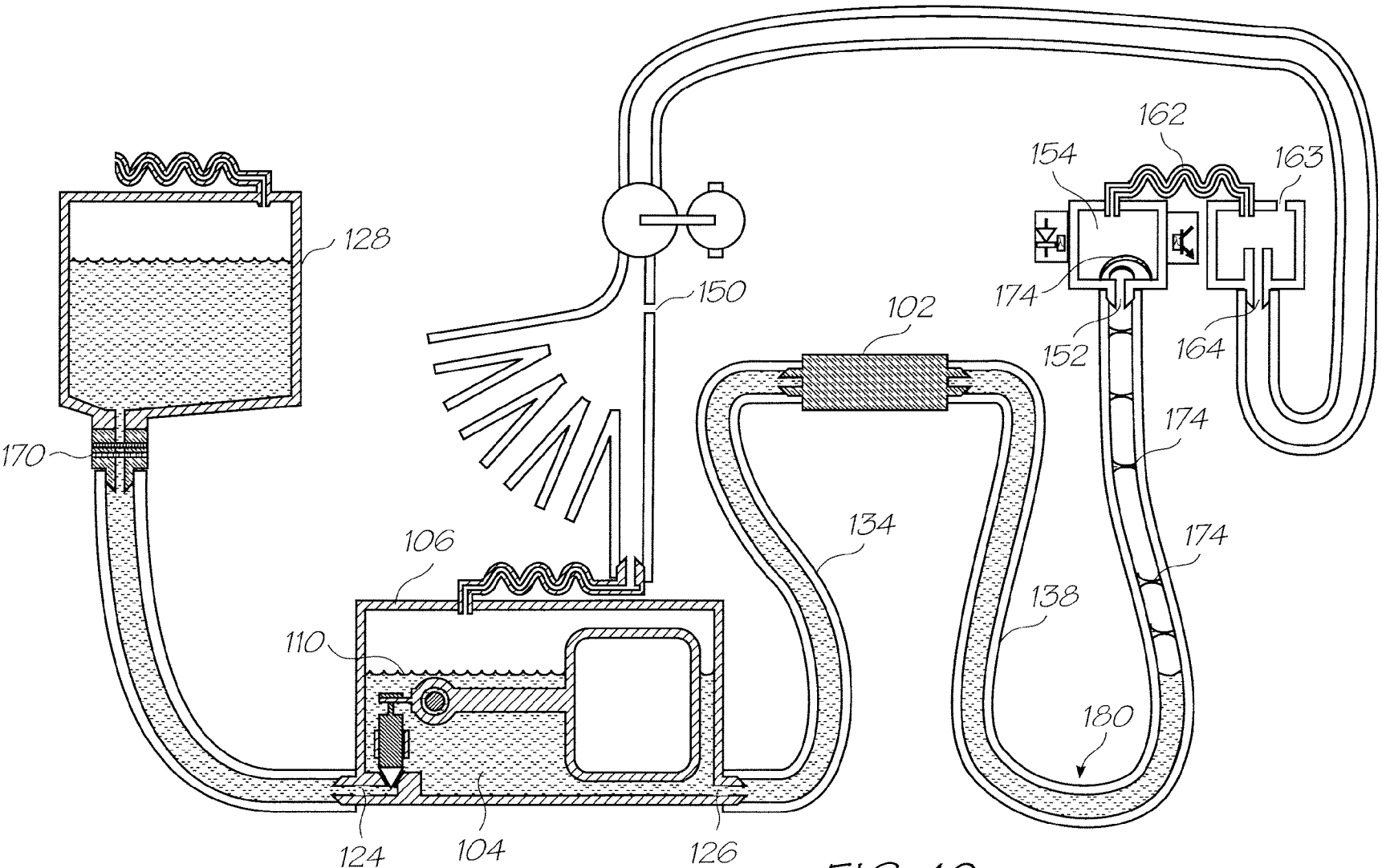
FIG. 10 shows the fluidics system of FIG. 7 after printhead printhead priming.

As shown in FIG. 9, the level of ink 104 in the pressure-regulating chamber drops as the headspace 139 is pressurized and ink is forced up the upstream ink conduit 134. Although the float valve opens the inlet port 124 of the chamber 106 when the ink level drops, the ink is still isolated from the ink reservoir 128 by virtue of a one-way check valve 170. The check valve 170 is positioned in the ink supply conduit 130 interconnecting the ink reservoir 128 and the inlet port 124, typically as part of the coupling to the ink reservoir. The check valve 170 allows ink to drain into the chamber 106, but does not allow ink to flow in the opposite direction. Hence, the positively pressurized headspace 139 forces the ink 104 from the pressure-regulating chamber into the ink inlet 108 and through the printhead 102. To this end, it is important that the pressure-regulating chamber 106 contains sufficient ink 104 to prime the printhead 102.

Since the pump inlet 146 is in fluid communication with the ink outlet 136, the ink outlet experiences a suction force so that ink 104 is both pushed and pulled through the printhead 102 when the pump 140 is switched on in the forward direction. Significantly, this pushing and pulling action minimizes any nozzle drooling during the priming operation, irrespective of whether the printhead 102 is wet or dry prior to priming. This should be contrasted with arrangement shown in FIG. 11 where the air outlet 164 is not in fluidic communication with the pump inlet 146.

Referring again to FIG. 9, it can be seen that ink 104 is drawn through the printhead 102 during priming and enters the bubble-bursting chamber 154 via the downstream ink conduit 138. When the optical sensor 156 senses ink 104 in the bubble-bursting chamber, it sends a feedback signal 158 to the pump 140 (typically via a microprocessor, not shown), which instructs the pump to switch off. The optical sensor 156 and feedback signal 158 guarantee that the printhead is fully primed when the pump 140 is switched off.

Turning now to FIG. 10, when the pump 140 is switched off, the check valve 170 opens and ink 104 in the pressure-regulating chamber 106 returns to its set level 110 by virtue of more ink draining from the ink reservoir 128 and replenishing the ink used for priming. Additionally, some downstream ink is allowed to drain from the bubble-bursting chamber 154 back through the printhead 102 and into the pressure-regulating chamber 106 via the outlet port 126. However, the loop 180 in the downstream conduit 138 prevents the printhead 102 from depriming. Thus, as shown in FIG. 10, ink 104 in the loop 180 equalizes with the set level 110 of ink in the pressure-regulating chamber 106 by virtue of both the upstream and downstream conduits 134 and 138 both being open to atmosphere via the air vents 150 and 163.

Figure 11:
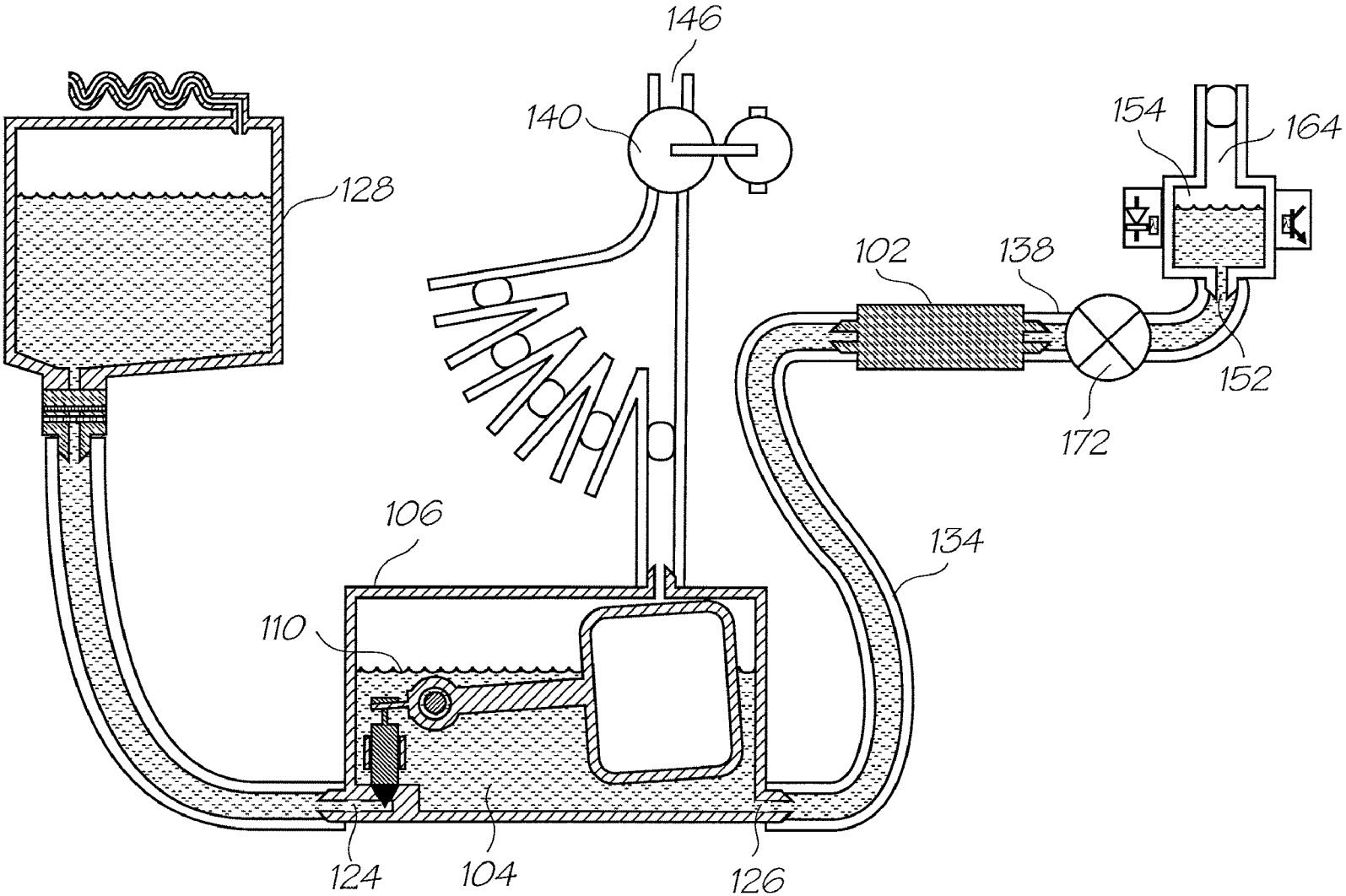
FIG. 11 shows an alternative fluidics system according to the present invention.

As an alternative to the loop 180 in the downstream conduit 138, an electronically-controlled valve 172 may be positioned in the downstream conduit so as to control the flow of ink therethrough. Such an arrangement is shown in FIG. 11. The valve 172 may be opened during priming and then closed simultaneously with the pump 140 being switched off so as to prevent drainage back through the printhead 102. Generally, the loop arrangement 180 is preferred to the electronically-controlled valve 172, because it reduces the number of expensive components required in the fluidics system 100.

Referring again to FIG. 10, it will be seen that the portion of the downstream conduit 138 from which ink has drained, as well as the bubble-bursting chamber 154, now contain a plurality of ink bubbles 174. These and other ink bubbles 174 are potentially problematic in future priming operations, as will be described in more detail below.

Printhead Depriming

Figure 12:
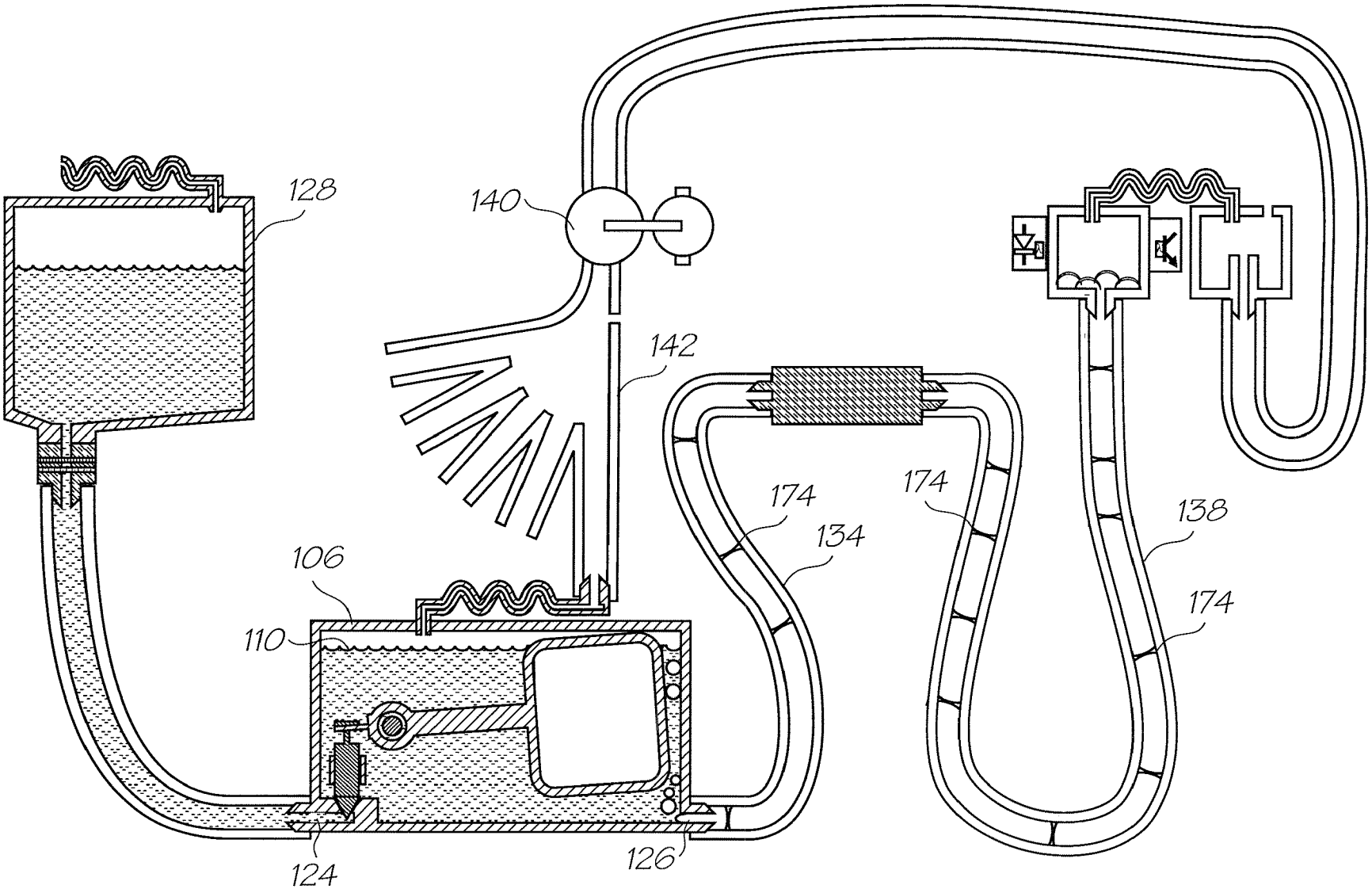
FIG. 12 shows the fluidics system of FIG. 7 configured for printhead depriming.

In order to replace a printhead 102, the old printhead must first be deprimed. Without such depriming, replacement of printheads would be an intolerably messy operation. FIG. 12 shows the fluidics system 100 configured for a printhead depriming operation. In FIG. 12, the air pump 140 is reversed and ink is drawn from the downstream conduit 138, through the printhead 102, and into the pressure-regulating chamber 106 via the outlet port 126.

Since the level of ink 104 in the pressure-regulating chamber 106 now rises, the float valve closes the inlet port 124, thereby isolating the chamber 106 from the ink reservoir 128. Hence, the float valve not only regulates the hydrostatic ink pressure during normal printing, but also serves to isolate the pressure-regulating chamber 106 from the ink reservoir 128 during depriming. This additional function of the float valve is important, because it prevents ink 104 from being sucked from the ink reservoir 128, into the pump outlet conduit 142, and into the pump 140 during depriming operations. Of course, the pressure-regulating chamber should have sufficient capacity to accommodate the ink received therein during depriming, as shown in FIG. 12.

Significantly, there is minimal or no ink wastage during depriming, because ink in the printhead 102 and downstream conduit 138 is all recycled back into the pressure-regulating chamber 106.

Figure 13:
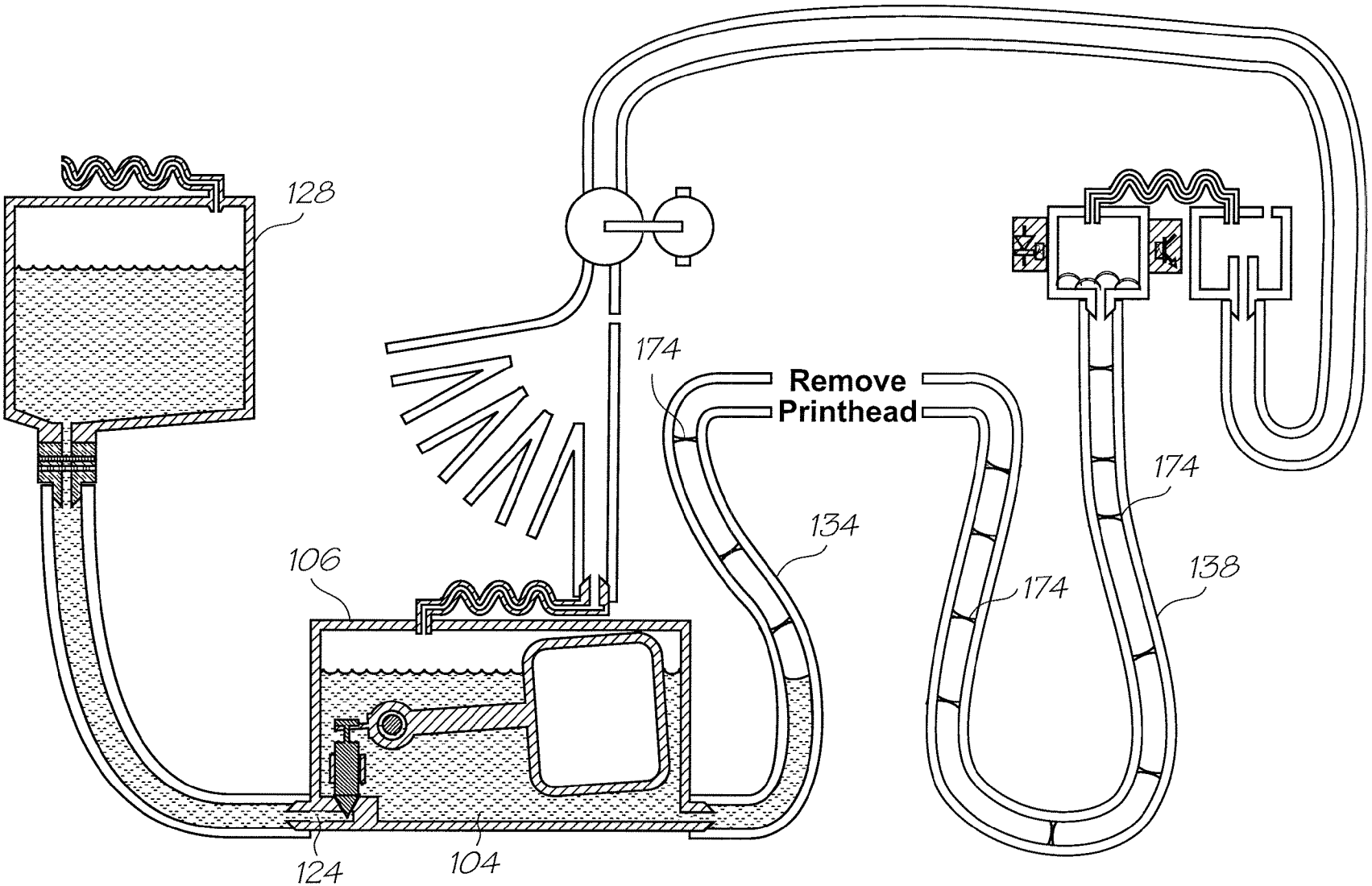
FIG. 13 shows the fluidics system of FIG. 7 in a deprimed configuration with the printhead removed.

Once all the ink in the downstream conduit 138, the printhead 102 and the upstream conduit 134 has been drawn into the pressure-regulating chamber 106, the pump 140 is switched off. The pump 140 is typically switched off after predetermined period of time. Referring now to FIG. 13, it can be seen that when the pump is switched off, some ink 104 from the pressure-regulating chamber 106 flows into the upstream conduit 134 until it equalizes with the level of ink in the chamber 106. Since, at this stage of depriming, the volume of ink 104 in the pressure-regulating chamber is relatively high, the ink equalizes at a level higher than the set level 110, and the float valve keeps the inlet port 124 closed. Hence, ink 104 is prevented from draining from the ink reservoir 128 into the upstream conduit 134, because the float valve isolates the ink reservoir. Again, this isolating function of the float valve during the printhead depriming operation is an important feature of the present fluidics system 100.

Still referring to FIG. 13, when the pump is switched off, the printhead 102 may be removed and replaced with a replacement printhead. Significantly, a plurality of ink bubbles 174 are now present in both the upstream conduit 134 and the downstream conduit 138. It is important that these ink bubbles 174 do not deleteriously affect subsequent priming operations of the replacement printhead.

Replacement Printhead Priming

Figure 14:
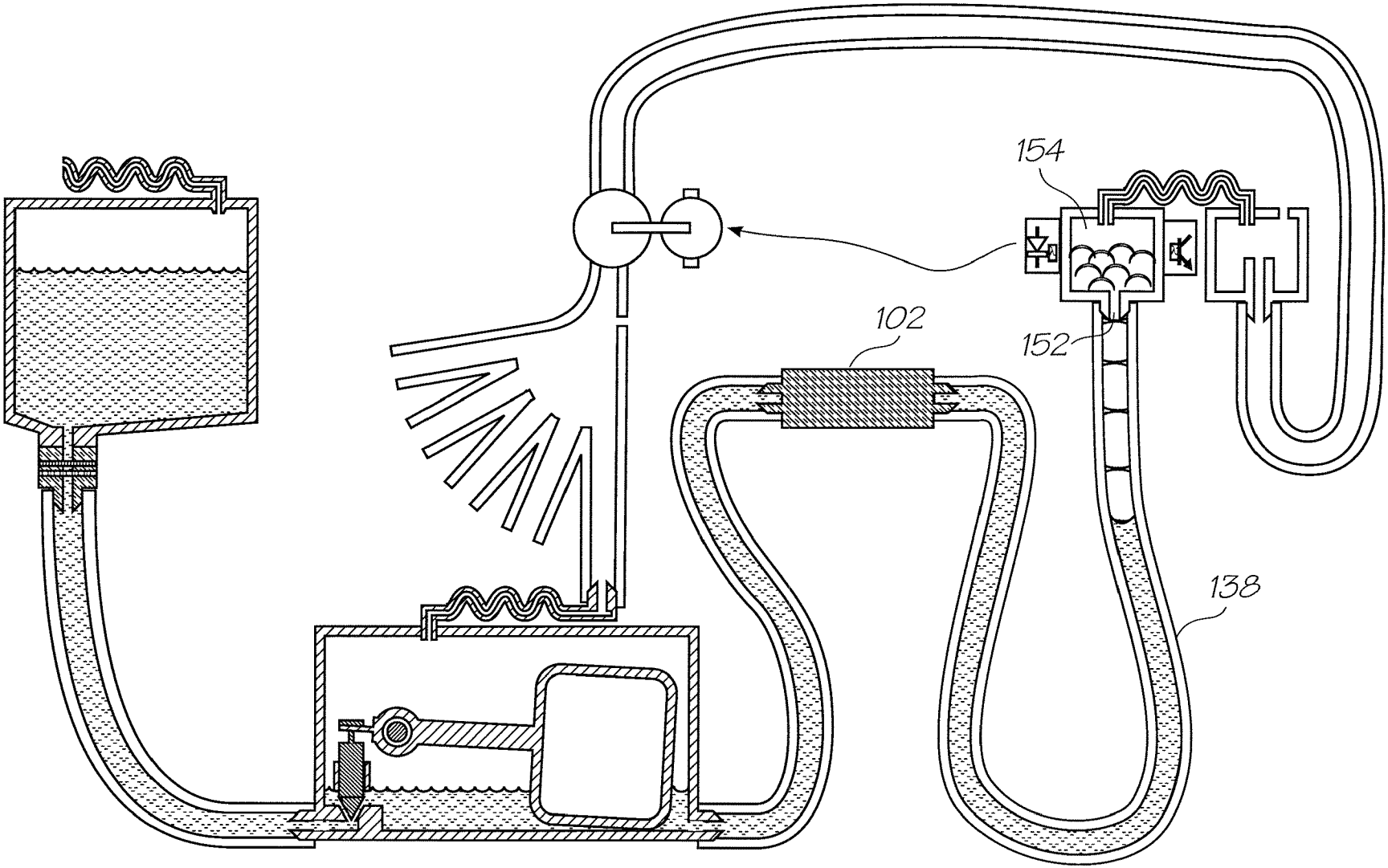
FIG. 14 shows the fluidics system of FIG. 13 with a new printhead installed and primed.

FIG. 14 shows a replacement printhead priming operation, following installation of a replacement printhead 102 in the deprimed fluidics system shown in FIG. 13. For clarity, the replacement printhead is still designated as a printhead 102 in the following discussion.

In contrast with the priming operation shown in FIGS. 8 to 10, there are now ink bubbles 174 in the upstream and downstream conduits 134 and 138, which must be flushed through the system. However, since (as described above) the pump 140 both pushes and pulls ink 104 through the printhead 102 during priming, the ink bubbles 174 in the upstream conduit 134 do not cause a significant increase in the requisite priming pressure and nozzle drooling is avoided.

As discussed above, printhead priming relies on accurate detection of ink 104 in the downstream ink conduit 138. When ink 104 is sensed in the downstream conduit 138, the system 'knows' that the printhead 102 is primed and the pump 140 may be switched off. Typically, an optical sensor is used for the sensing the ink 104.

However, now that the downstream conduit 138 contains a plurality of residual ink bubbles 174, there is potential for phantom sensing of ink by the optical sensor. In other words, if the sensor senses ink bubbles 174, rather than the advancing ink front from the body of ink 104 being pumped through the system, then a feedback signal 158 may still be sent to the pump 140, even if the printhead 102 has not fully primed. It is important to minimize phantom sensing of ink caused by ink bubbles 174 in the downstream conduit 138 so as to provide efficacious priming of replacement printheads. The pump 140 should be switched off only when the advancing ink front is sensed by the sensor, not when the residual trapped ink bubbles 174 are sensed.

The bubble-bursting chamber 154 provides a means by which phantom sensing of ink bubbles 104 can be avoided. As will be described in more detail below, the bubble-bursting chamber 154 is shaped so as to promote stretching and bursting of ink bubbles 174 entering the chamber via the chamber inlet 152. Generally, the bubble-bursting chamber 154 has a larger diameter and a shallower sidewall curvature than the downstream conduit 138 feeding into chamber. This configuration means that the ink bubbles 174 entering via the chamber inlet 152 typically all burst inside the chamber 154 at or below a predetermined bubble-bursting point. The optical sensor 156 is positioned to sense ink above the bubble-bursting point, so that it does not sense any ink bubbles 174. Only the advancing ink front from the body of ink 104 is able to reach the sensor 156 and trigger the feedback signal 158, which switches off the pump 140. Once the pump 140 is switched off, the ink 104 drains to the loop 180 and equalizes with the set level 110, as explained above with reference to FIG. 10.

Accordingly, the fluidics system 100 is suitable for a multitude of functions, including controlling hydrostatic ink pressure during normal printing, printhead priming, printhead depriming, and enabling printhead replacement.

Further features of the bubble-bursting box and other individual components of the fluidics system 100 will now be described in more detail below.

Bubble-Bursting Box

Figure 15:
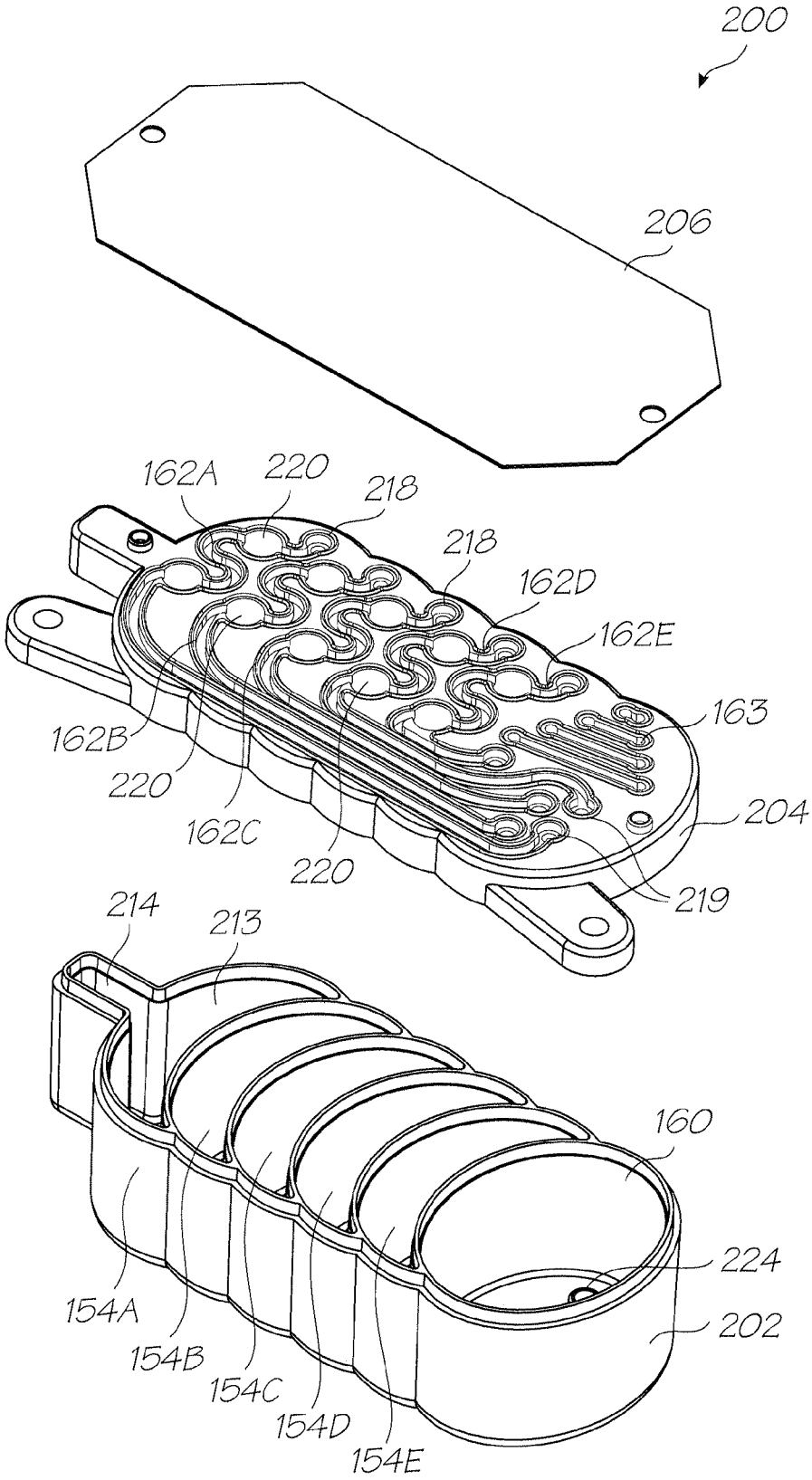
FIG. 15 is an exploded top perspective of a bubble-bursting box according to the present invention.
Figure 16:
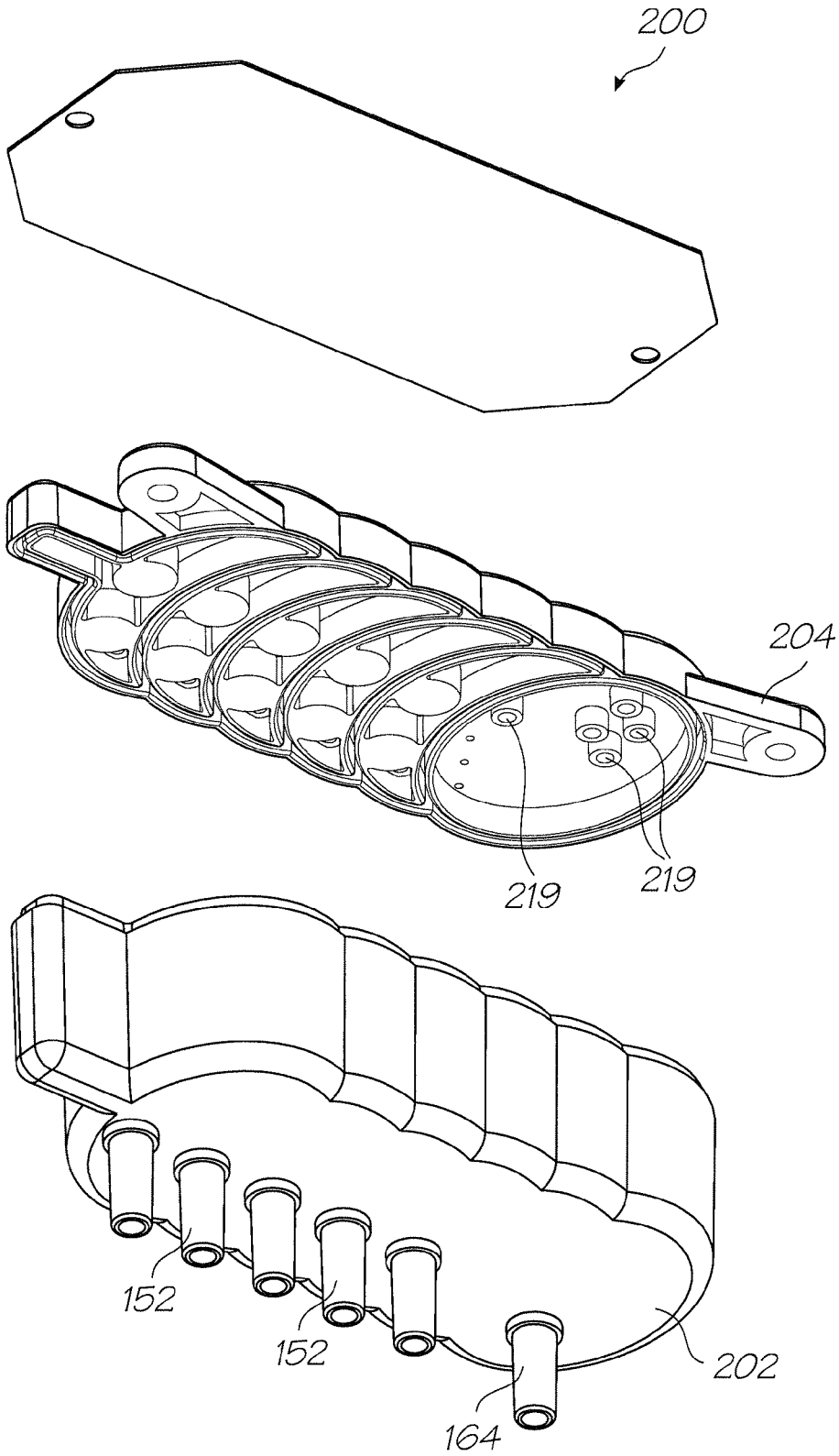
FIG. 16 is an exploded bottom perspective of the bubble-bursting box shown in FIG. 15.
Figure 17:
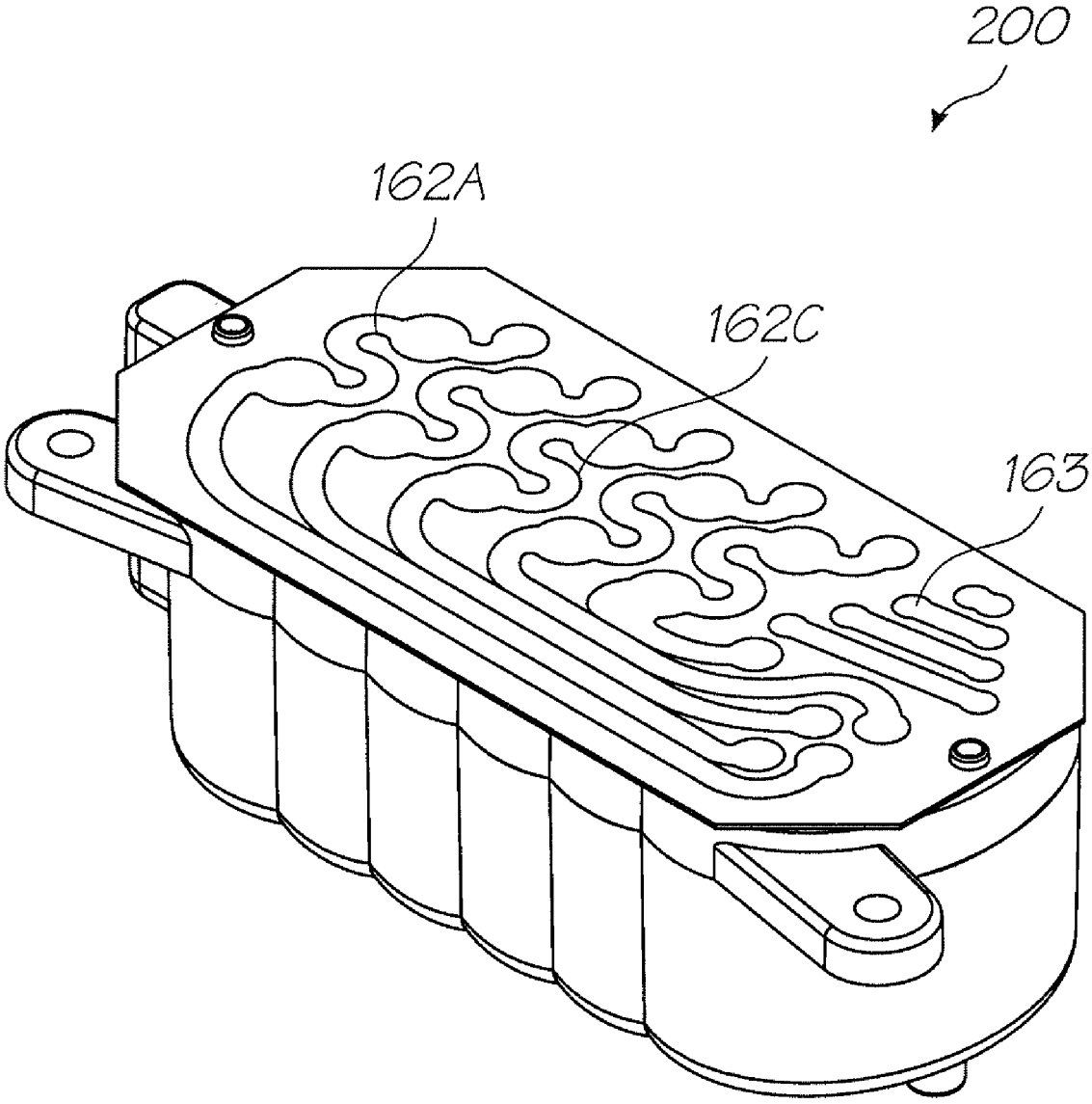
FIG. 17 is a perspective of the assembled bubble-bursting box shown in FIG. 15.

Referring to FIGS. 15 to 17, the bubble-bursting box 200 is a two-part molded unit comprising a chamber molding 202 and a cover molding 204 having a polymeric sealing film 206 bonded thereto. The bubble-bursting box 200 is a common unit for a plurality of ink channels so that only one box is required in a multi-channel printhead (see FIG. 20). The bubble-bursting box 200 is configured for use with five ink channels, in accordance with the printhead cartridge 2 described above. Hence, the chamber molding 202 comprises five bubble-bursting chambers 154A-E, each having a respective chamber inlet 152 in base thereof. The chamber molding 202 further comprises a common air chamber 160 for each bubble-bursting chamber 154.

Each bubble-bursting chamber 154 has curved sidewalls providing a generally crescent-shaped chamber. This shape is ideally suited for expanding and, hence, bursting ink bubbles 174 entering via respective chamber inlets 152. An end chamber 154A comprises a main chamber 213 and a float ball chamber 214, which is configured for containing a float ball (not shown). The float ball chamber 214 is in fluid communication with the main chamber 213 so that the height of the float ball represents the height of ink in the main chamber 214 and, indeed, all the other chambers 154B-E experiencing equal priming pressures. Since all chambers 154A-E are in fluid communication with the pump 140 and experience equal priming pressures, only one chamber (e.g. the end chamber 154A) is required to have a sensor.

The optical sensor 156 (not shown in FIGS. 15 to 17) is positioned adjacent the float ball chamber 214 to sense the float ball above a predetermined bubble-bursting point. Accordingly, the float ball chamber 214 is typically transparent or at least has a transparent window enabling the optical sensor 156 to sense the float ball. Of course, a float ball may alternatively not be utilized and the optical sensor 156 may simply sense the ink itself.

The cover molding 204 comprises a plurality of air channels 162A-E, each providing fluid communication between a respective bubble-bursting chamber 154A-E and the common air chamber 160. Each air channel 162 has a channel inlet 218 opening into a roof of a respective bubble-bursting chamber 154 and a channel outlet 219 opening into a roof of the common chamber 160.

The air channels 162 are generally serpentine and each channel comprises two ink-trapping stomachs 220. Further, the cover molding 204 is typically comprised of a hydrophobic material so that the serpentine air channels 162 have hydrophobic sidewalls. These features together minimize the possibility of ink in the bubble-bursting chambers 154A-E being deposited into the common air chamber 160 via the air channels 162A-E. Hence, the bubble-bursting box 200 is resilient to being tipped or even turned upside down. The air channels 162 defined in the cover molding 204 are sealed with the polymeric sealing film 206.

The air chamber 160 has an air outlet 164 defined in a base thereof. This air outlet 164 is connected to the pump inlet 146 via pump inlet conduit 166 when the box 200 is installed in a printer. The air outlet 164 is generally centrally positioned in the base of the air chamber 160 and, as shown in FIGS. 15 and 16, the channel outlets 219 are offset from the air outlet. By offsetting the channel outlets 219 from the air outlet 164, it is ensured that, even if a small quantity of ink is deposited into an ink collection zone in the air chamber 160, no ink can exit through the air outlet 164 and potentially foul the air pump 140. Additionally, a snorkel 224 extends towards the roof of the air chamber 160 from the air outlet 164. The snorkel 224 increases the effective ink-collecting volume of the air chamber 160. As shown in FIG. 15, the snorkel 224 is relatively short, although this may lengthened if desired.

The cover molding 204 also has a plurality of air vents 163 defined therein, which are positioned to vent the air chamber 160 to atmosphere. The microscopic air vents 163 are configured so that they can be digitally punctured to provide an optimum priming pressure in combination with the air pump 140. The greater the number of vents 163 that have been punctured, the lower the priming pressure will be. It is not intended that users will puncture the vents 163; they are merely provided to facilitate manufacture of the box 200 in such a way that the box may be 'tuned' for use with a variety of different printers, each with its own optimal priming pressure.

From the foregoing, it will be appreciated that the design of the bubble-bursting box 200 minimizes (and preferably prevents) any ink from the reaching the air pump 140 during priming. Thus, each bubble-bursting chamber 154 also functions as an expansion chamber, which can accommodate a relatively large volume of ink. This minimizes the possibility of ink reaching the air pump 140. It is important that the air pump 140 is protected in this way, because malfunctioning of the air pump would affect the overall operation of the printer. Even if the air pump 140 is robust enough to potential ink fouling, any color mixing in the pump inlet conduit 166 and redistribution of mixed ink to the pressure-regulating chambers 106 would typically be catastrophic for the printer.

In some embodiments, the bubble-bursting box may be used without the ink sensor. Control of printhead priming may be achieved through use of a timer, which cooperates with the air pump 140 so as to limit its operation to a known priming (or depriming) period of time. The bubble-bursting box 200 in the downstream ink conduit 138 safeguards against any fouling of the pump 140 or color mixing in the event of, for example, unexpected pressure surges during priming.

Pressure-Regulating Chamber

Figure 18:
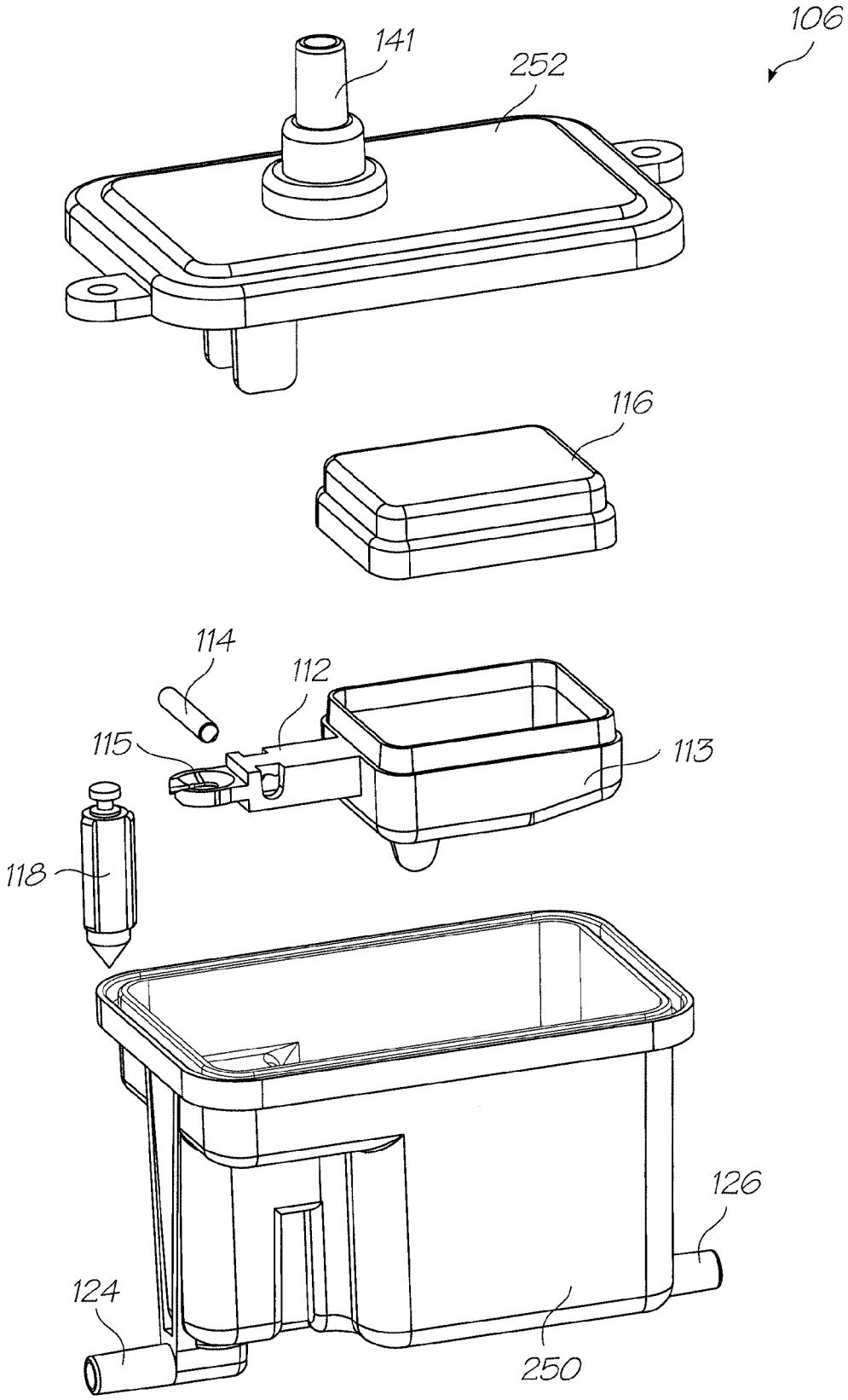
FIG. 18 is an exploded perspective of a pressure-regulating chamber.

The pressure-regulating chamber 106 is shown in exploded form in FIG. 18. The pressure-regulating chamber 106 comprises a main housing 250 having the inlet port 124 and outlet port 126, and a cover portion 252 having the headspace port 141. The cover portion 242 is fixed to the main housing 250 to form the chamber 106. The main housing 250 and cover portion 252 are typically comprised of molded plastics.

A pivot arm assembly comprises the arm 112 having a float cradle 113 at one end and a poppet mounting 115 at an opposite end. The float 116 is mounted in the float cradle 113 and the valve poppet 118 is mounted in the poppet mounting 115. The arm 112 is pivotally mounted about the pivot 114, which is fixed between sidewalls of the main chamber 250. The pivot 114 is positioned to provide maximum leverage force to the poppet valve 118. All components of the pivot arm assembly are typically formed from molded plastics, with the exception of the stainless steel pivot 112.

It will be appreciated that the pressure-regulating chamber 106 is a relatively inexpensive construction requiring no special manufacturing techniques.

Print Engine with Fluidics Components

The print engine 3 typically has a bank of pressure-regulating chambers 106 mounted towards a base thereof. By mounting the pressure-regulating chambers 106 at the base of the print engine 3, there is minimal impact on the overall configuration, and particularly the overall height, of the print engine.

Each color channel usually has its own ink reservoir 128 and pressure-regulating chamber 106. Hence, the print engine 3 has five ink reservoirs 128 and five pressure-regulating hambers 106. Typical color channel configurations for the five-channel print engine 3 are CMYKK or CMYK(IR).

The pressure-regulating chambers 106, unlike the ink reservoirs 128 and the print cartridge 2, are not intended to be user-replaceable in the print engine 3.

FIG. 19 shows the print engine 3 comprising the bank of pressure-regulating chambers 106, the bubble-bursting box 200 and a plurality of ink reservoirs 128 in the form of user-replaceable ink cartridges. Fluidic connections between these components are not shown in FIG. 19, but it will be appreciated that these connections are made with suitable hoses in accordance with the fluidics system 100 herein.

Multi Channel Fluidic Connections

Whilst FIG. 19 shows the relative positioning of each component of the fluidics system in the printhead engine 3, FIG. 20 shows the fluidic connections for a five channel printhead cartridge 2. Although FIG. 20 shows fluidic connections for a five channel printhead, it will be appreciated that similar fluidic connections may be used for any desired number of color channels.

Thus, a bank of ink cartridges 128 supply ink via respective supply conduits 130 to respective pressure-regulating chambers 106. Each chamber 106 has a headspace in fluid communication with a respective pump outlet conduit 142 which all feed into a conduit junction 148. The conduit junction 148 is connected to an air outlet of the pump 140 via a common junction conduit 149. The conduit junction 148 has the second air vent 150 defined therein.

Outlet ports of each chamber 106 are connected to an ink inlet of the printhead cartridge 2 via upstream ink conduits 134. Downstream ink conduits 138 have one end connected to an ink outlet of the printhead cartridge 2 and an opposite end connected to respective bubble-bursting chambers of the bubble-bursting box 200. The pump inlet conduit 166 connects the air outlet of the bubble-bursting box 200 to an air inlet of the pump 140.

It will, of course, be appreciated that the present invention has been described purely by way of example and that modifications of detail may be made within the scope of the invention, which is defined by the accompanying claims.

The invention claimed is:

1. An ink sensing device for an ink supply system, said device comprising:

a bubble-bursting box comprising:

one or more bubble-bursting chambers, each chamber having a respective chamber inlet for connection to an ink line; and an air outlet in fluid communication with each chamber; and a sensor positioned to sense ink above a bubble-bursting point in at least one of said bubble-bursting chambers, wherein said device is configured to minimize phantom sensing of ink caused by ink bubbles in said ink line.

2. The device of claim 1, wherein said bubble-bursting box comprises a plurality of bubble-bursting chambers, each chamber corresponding to a respective ink channel of an ink supply system.

3. The device of claim 1, wherein each bubble-bursting chamber is dimensioned to promote expansion and bursting of ink bubbles entering said chamber via said chamber inlet.

4. The device of claim 3, wherein each bubble-bursting chamber has curved sidewalls, wherein a curvature of said sidewalls is greater than a curvature of a conduit defining said ink line.

5. The device of claim 4, wherein each bubble-bursting chamber is generally crescent-shaped, thereby maximizing said curvature in a minimal volume.

6. The device of claim 1, wherein said bubble-bursting box comprises a common air chamber in fluid communication with each bubble-bursting chamber, said air outlet being positioned in said air chamber.

7. The device of claim 6, wherein each bubble-bursting chamber communicates with said air chamber via a respective air channel defined in a roof of said box.

8. The device of claim 7, wherein each air channel is a serpentine channel for minimizing transfer of ink to said air chamber when said box is tipped.

9. The device of claim 7, wherein each air channel is hydrophobic.

10. The device of claim 7, wherein each air channel comprises at least one ink-trapping stomach.

11. The device of claim 7, wherein each air channel terminates at a channel outlet defined in a roof of said box, each channel outlet being positioned to deposit ink into said air chamber.

12. The device of claim 11, wherein said air outlet is defined in a base of said air chamber, and each channel outlet is offset from said air outlet.

13. The device of claim 12, wherein a snorkel extends from said air outlet towards said roof, thereby maximizing an effective ink-collecting volume of said air chamber.

14. The device of claim 1, wherein said air chamber has an air vent defined therein.

15. The device of claim 14, wherein said air chamber has one or more air vents defined therein, the number of air vents regulating a pressure in said bubble-bursting box when said air outlet is connected to a pump.

16. The device of claim 1, wherein said sensor is an optical sensor.

17. The device of claim 1, wherein said sensor provides a feedback signal for a pump pumping ink into said bubble-bursting box.

18. The device of claim 1, wherein sensor senses ink in only one of said bubble-bursting chambers.

19. The device of claim 17, wherein said one bubble-bursting chamber comprises a float ball chamber in fluid communication with a primary bubble-bursting chamber, said float ball chamber containing a float ball, and said sensor optically sensing when said float ball reaches a predetermined height.

20. An ink supply system comprising the bubble-bursting box according to claim 1.

* * * * *